US005634522A

United States Patent [19]

Hershberger

[11] Patent Number: 5,634,522

[45] Date of Patent: Jun. 3, 1997

[54] LIQUID LEVEL DETECTION FOR ARTIFICIAL LIFT SYSTEM CONTROL

[76] Inventor: Michael D. Hershberger, 1605 Tyler Rd., SE., Kalkaska, Mich. 49646

[21] Appl. No.: 660,052

[22] Filed: May 31, 1996

Related U.S. Application Data

[60] Provisional application No. 60/006,164 Nov. 2, 1995.

[51] Int. Cl. [6] ..... E21B 43/00

[52] U.S. Cl. ..... 166/372; 166/53

[58] Field of Search ..... 166/372, 53, 64

[56] References Cited

U.S. PATENT DOCUMENTS

| | | | |
|---|---|---|---|
| Re. 34,111 | 10/1992 | Wynn . | |
| 4,010,642 | 3/1977 | McArthur . | |
| 4,150,721 | 4/1979 | Norwood . | |
| 4,352,376 | 10/1982 | Norwood . | |
| 4,354,524 | 10/1982 | Higgins . | |
| 4,355,365 | 10/1982 | McCracken et al. . | |
| 4,526,228 | 7/1985 | Wynn . | |
| 4,685,522 | 8/1987 | Dixon et al. . | |
| 4,791,990 | 12/1988 | Amani . | |
| 4,901,798 | 2/1990 | Amani . | |
| 4,921,048 | 5/1990 | Crow et al. . | |
| 4,989,671 | 2/1991 | Lamp . | |
| 5,033,550 | 7/1991 | Johnson et al. . | |
| 5,132,904 | 7/1992 | Lamp | 166/53 X |
| 5,458,200 | 10/1995 | Lagerlef et al. | 166/372 |
| 5,488,993 | 2/1996 | Hershberger | 166/372 |

*Primary Examiner*—William P. Neuder

*Attorney, Agent, or Firm*—Varnum, Riddering, Schmidt & Howlett LLP

[57] ABSTRACT

A method of producing gas through liquid level detection in oil or gas wells uses various types of artificial lift systems that include sub surface gas lift, beam pumps, progressive cavity pump and submersible pumps. The artificial lift systems are controlled in response to a known liquid level within the well bore to prevent the well from pumping off and damaging the artificial lift system or from reducing the liquid level in the well bore to an unnecessarily low level to thereby increase the energy required by the artificial lift system to remove the liquid from the well bore. The liquid level detection method includes the detection of at least the pressure on a side string tube in the well bore to determine the level of liquid in the well bore for automated control of liquid removal from the well bore to be removed to the surface through a production tube to allow improved gas or oil production, increase artificial lift efficiency and to allow for control of the artificial lift system to prevent damage to the system. Another method measures production from the well in conjunction with automated liquid level control to maximize liquid level in the well bore without interfering with production. A timing method allows for control of the quantity of gas injected during the injection cycle of a sub surface gas lift artificial lift system.

49 Claims, 25 Drawing Sheets

LIQUID LEVEL DETECTION FOR ARTIFICIAL LIFT SYSTEM CONTROL

CROSS REFERENCE TO RELATED APPLICATIONS

This application claims the benefit of U.S. provisional application Ser. No. 60/006,164 filed Nov. 2, 1995.

BACKGROUND OF THE INVENTION

1. Field of the Invention

This invention relates to producing wells having an artificial lift system for removing liquid from an underground formation. In one of its aspects, the invention relates to improved methods of and systems for control of artificial lift systems utilizing pressure measurements and pressure manipulation to detect the liquid level in the well bore to thereby increase the efficiency, operational predictability and to automate the artificial lift systems. In another of its aspects, the invention relates to the monitoring of production gas from a gas producing well and detection of the liquid level in the well bore to thereby control the artificial lift system to maximize gas production from the well while simultaneously maximizing artificial lift system performance and efficiency.

2. Description of Related Art

Artificial lift systems are commonly used to extract fluids, such as oil, water and natural gas, from underground geological formations. Oftentimes, the formations are more than 1,000 feet below the surface of the earth. The internal pressure of the geological formation is often insufficient to naturally raise commercial quantities of the liquid or gas from the formation through a bore hole. When the formation has a sufficient internal pressure to naturally lift the liquid from the formation, the natural pressure is often inadequate to produce the desired flow rate. Therefore, it is desirable to artificially lift the liquid from the formation by means of an artificial lift system.

Typically, the formation can comprise several separate layers containing the liquid and gas or can comprise a single large reservoir. A bore hole is drilled into the earth and passes through the different layers of the formation until the deepest layer is reached. Due to economic considerations, many bore holes extend only to the deepest part of the productive formation. In certain applications it is desired to extend the bore hole beyond the bottom of the productive formation. The portion of the bore hole that extends beyond the bottom of the formation and into the substrata is known as a "rat hole." The location and depth of the bore hole is carefully controlled because of the great expense in drilling the bore hole.

After the bore hole is drilled, the bore hole is usually lined with a casing along its entire length to prevent collapse of the bore hole, to control reservoir pressure and to protect surface water from contamination. However, the bore hole is often only lined with the casing to the top of the gas and liquid containing formation, leaving the lower section of the bore hole uncased. The uncased section is referred to as an open hole. The casing is cemented in place and sealed at surface by a wellhead and can have one or more pipes, tubes or strings (metal rods) disposed therein and extending into the bore hole from the wellhead. One of the tubes is typically a production tube, which is used to carry liquid to the surface.

Currently, many different types of artificial lift systems are used to lift the liquid from the formation. The most common artificial lift systems are: progressive cavity pumps, beam pumps and subsurface gas lift (SSGL). A progressive cavity pump is relatively expensive, approximately $20,000 to install, but can deliver relatively large volumes of liquid and remove all the liquid from the formation. A progressive cavity pump can comprise an engine or electric motor driven hydraulic pump connected to a hydraulic motor mounted on the top of the wellhead and connected to a pump at the bottom of a production tube. The hydraulic motor turns a rod string that is connected to a pump rotor, which turns with respect to a pump stator. Alternately, some progressive cavity pumps are driven by an electric motor attached to the top of the well head. The pump rotor is helical in shape and forms a series of progressive cavities as it turns to lift or pump the liquid from the bottom of the well bore into the production tube and to the surface. Although the progressive cavity pump is satisfactory in raising liquid from the formation, the hydraulic pump system requires a containment building and liner in the event of an oil leak. The possibility of an oil leak in the progressive cavity pump system also raises environmental concerns because many of the bore holes are drilled in environmentally sensitive or wilderness areas. The progressive cavity pump also requires, in certain applications, at least 100 feet of a rat hole, which adds extra cost. Of the previously mentioned artificial lift systems, the progressive cavity pump has the highest maintenance costs and greatest amount of down time requiring rig service. This down time often results from a lack of good liquid level control which allows the well to be pumped off causing damage to the pump system. Also, a soft seal stuffing box which must be lubricated regularly is used to seal around the rotating rod string and acoustic annular liquid levels must be obtained at regular intervals to ensure that the liquid is adequately high above the pump so that it does not run dry and destroy itself.

A beam pump is also relatively expensive, approximately $18,000, to install but can also remove all the liquid from the formation. The beam pump comprises a pivotally mounted beam that is positioned over the wellhead and connected to a rod string extending into the production tube within the casing in the bore hole. The lower end of the rod string is connected to a pump disposed near the bottom of the well bore. The beam pump can be operated by a gas engine or an electric motor. The beam pump has several disadvantages. First, there are many environmental concerns. There may be leakage in the engine or gear box of the power source, requiring construction of a containment area. Further, if an electric motor is used in place of the gas engine, it is necessary to run a power line to the electric motor, which often destroys or degrades the surrounding environment. The beam pump, like the progressive cavity pump, has many moving components that require regular lubrication. The beam pump also uses a soft seal stuffing box to seal around the reciprocating rod string to contain liquids and gases produced up the production tube.

The SSGL is the least expensive artificial lift system to install, approximately $7,500. The SSGL uses pressurized gas carried by a separate tube, commonly referred to as a side string, from the surface to the lower end of the production tube to eject the liquid in the production tube to the surface upon injection of a blast of pressurized gas. The production tube usually has at its lower end a one-way valve called a "standing valve" which permits liquid standing in the formation to enter the production tube and rise in the production tube to the level of liquid in the formation. Often the SSGL system will have a plunger disposed within the production tube, but a plunger is an optional device to provide mechanical advantage for the blast of injection gas.

The SSGL is the most environmentally friendly, maintenance free and energy efficient of the three commonly used artificial lift systems. Unlike the other artificial lift systems, the subsurface gas lift system requires no systematic lubrication of the gas regulator and the motor valve. The SSGL maintains greater integrity of the well head in controlling the possibility of liquid leaks because the well head components are hard piped with no friction oriented soft seal such as is found in the stuffing boxes of the progressive cavity and beam pumps. The SSGL is virtually silent during operation and has very little surface equipment compared to a beam pump or progressive cavity pump. Therefore, it has less audible and visual impact on the surrounding environment.

The greatest disadvantage of the SSGL is that it becomes less efficient and more difficult to control as more and more liquid is removed from the formation. The SSGL can only raise the column of liquid in the production tube. The column of liquid in the production tube is equal to the level of liquid in the annulus and therefore the level of liquid in the formation if the production tube and annulus are equalized into a common line at surface. As more and more liquid is removed from the formation, the level of liquid in the formation decreases. Therefore, as the level of liquid in the production tube decreases and a continuously smaller and smaller amount of liquid is raised for substantially the same amount of energy. As the liquid level in the subsurface gas lift system decreases or the influx of liquid to the well bore becomes erratic, there becomes a point where it is no longer operationally predictable, safe or productive to use the subsurface gas lift system. Oftentimes, the subsurface gas lift system is operated as a crippled and inefficient system without a plunger or replaced with a beam pump and its accompanying undesirable attributes. Optionally, a "rat hole" can be bored with the bore hole in a subsurface gas lift system so that most of the liquid can be raised from the formation by placing the gas injection point below the level of the formation and in the rat hole. However, many bore holes were drilled without a rat hole before artificial lift became a generally accepted method of production and the cost associated with boring a rat hole is such that most companies still prefer to drill little, if any, rat hole.

Another disadvantage that is common to all artificial lift systems is that as the liquid level decreases or the influx of liquid to the well bore becomes erratic, the systems become operationally more difficult to efficiently control without damaging themselves regardless of the depth of the rat hole. In the event of no liquid level, the progressive cavity pump will quickly torque up and destroy the down hole pump, twist off the rod string or destroy the stator assembly. The beam pump will begin to pound as gas is drawn into the pump, the end result of which will be a scored or damaged pump barrel and eventually a parted rod string. The SSGL may "dry cycle," a condition where the plunger arrives at the surface and bottom of the well with no liquid cushion and, therefore, possibly at a damaging velocity. As the level of liquid decreases in an SSGL system, there is an increased need to use the mechanical advantage provided by a plunger to optimize the use of injection gas. The installation of a plunger into a well bore that has a continually declining or erratic liquid level requires constant vigilance on the part of the system operator to reduce the volume of gas injected into the production tube to keep the plunger from developing higher and higher velocity as the liquid level decreases. If the SSGL injection is left without adjustment the plunger velocity often increases to a point where the lubricator and the standing valve will be damaged by plunger impact.

In summary, the damage to the progressive cavity and the beam pumps will require a work-over rig for repairs. The damage to the SSGL seldom requires more than a small wire line truck for a few hours to retrieve and repair the damaged components. However, each of these systems, if controlled improperly, can have catastrophic failures that can be physically dangerous to the operator, costly to repair and can inflict environmental damage.

Most production companies have a mix of all the lift system types throughout their fields and while SSGL is the most environmentally friendly and energy efficient, there are fields in which the beam pump and progressive cavity pump systems are used exclusively. For various reasons that include high rates of liquid production, easy access to electricity, lack of a pipeline distribution system to supply high pressure gas for a SSGL system, lack of compressor capacity to support SSGL systems or engineering preference, many wells use beam pumps, progressive cavity pumps and in some circumstances submersible electric pumps. All of these pumps will suffer damage if the liquid level in the well declines to a point where gas enters the pump or the well enters a pumped off condition.

There are various methods that can be used in conjunction with these pump systems to control pump off. In the case of a beam pump or progressive cavity pump, there are flow monitoring devices that can be installed in the liquid ejection line at surface to monitor the liquid flow to make sure it does not contain excessive quantities of gas or does not stop flowing. If an excessive quantity of gas or a no flow condition is detected, the pump will be shut down. In this method, a pump that is driven by an electric motor may be automatically shut down for a period of time and then restarted to pump until the well is pumped off again. A pump that is driven by a gas engine will be shut down and must be restarted by an operator. This method of pump off detection is inherently weak in that pump off is only detected after-the-fact. The influx of gas into the production tube can cause gas locking of the pump, excessive wear due to lack of liquids or excessive corrosion due to free gas in the production tube. Further, there is no provision for constant monitoring of the liquid level in the well bore to make sure the liquid has been reduced to a level below the productive formation. Therefore, acoustic annular liquid levels must be taken at regular intervals to optimize the performance and efficiency of the artificial lift system.

Another method of monitoring pump off in a system using an electricity driven submersible or progressive cavity pump is to monitor the current draw caused by the pump motor. In the case of the progressive cavity pump, if gas is being drawn into the pump, the current draw may increase because of increased friction, due to the lack of lubrication and cooling provided by the production liquids, which in turn causes the electric motor to work harder. In this method, the pump can be shut down for a period of time to allow liquid to enter the well bore before starting the pump again. However, this method of detection is also an after-the-fact detection of pump off and does not compensate for variations of liquid volume entering the well bore. In the case of the submersible electric pump the current draw may decrease as gas enters the pump due to the impellers spinning in a gaseous fluid. In this case, the system would be shut down to keep the pump from overheating due to lack of cooling liquids. Again, detection is after-the-fact and damage may be done to the pump.

In another prior art control system for the electric progressive cavity pump and the submersible electric pump system, the current load is monitored and this value is used to automatically adjust a variable speed drive on the electric motor. This control method resembles the use of a rheostat where power to the system is controlled to allow for speed adjustment of the electric motor and therefore speed adjustment of the pump. In this method, the motor speed is adjusted based on current load to control system pump off. However, adjustments are made in response to after-the-fact detection of pump off and the system is still unable to detect precise liquid levels in the well bore.

With the submersible electric pump, the progressive cavity pump and beam pump system, another inefficiency can develop if the well bore is configured with a deep rat hole. If the pump is placed substantially below the productive formation and into the rat hole and the liquid in the annulus is reduced down to the level of the pump, it will require significantly more energy to lift the liquid from the well bore than would be required if the liquid level in the annulus was up to the bottom of the productive formation or at the top of the rat hole. For example, if a well is 1000 feet deep to the base of the productive formation and has a 200 feet deep rat hole for a total well depth of 1200 feet, and the liquid being pumped has the density of fresh water with a pressure gradient of 0.433 psi per vertical foot, the head pressure of a liquid column inside the production tube at a depth of 1000 feet will be 433 psi and at a depth of 1200 feet the liquid head pressure will be 519.6 psi. In this scenario if a pump is set to a depth of 1200 feet (200' into the rat hole below the productive formation) and the liquid level in the annulus is lowered to the level of the pump, the pump must overcome 1200 feet of hydrostatic head pressure or 519.6 psi to lift the liquid to the surface of the ground. Alternately, if the pump is set to a depth of 1200 feet but the liquid level in the annulus is maintained up to the bottom of the productive formation (200 feet above the pump in the annulus) the pump will only need to overcome 433 psi of hydrostatic head pressure to lift the liquid to the surface due to the equalizing force of the liquid in the annulus. In the scenario where the liquid level is reduced unnecessarily low in the annulus it will require approximately 20% more energy to lift a given volume of liquid to the surface than if the liquid level was maintained up to the bottom of the productive formation due to the lack of the balancing effect of the liquid in the annulus.

Therefore, there is a need to provide a method and system to conserve energy and increase longevity of the well bore equipment by precise control of the liquid level within the well bore to avoid pump off in artificial lift systems. A systemic method of control of the liquid level will improve the efficiency of the pump while further reducing the manpower requirements to operate the system by reducing the need for operator intervention with the artificial lift system to control liquid level to optimize well production and to prevent the system from damaging itself. There is further a need to have cost effective oil or gas well artificial lift systems that are relatively environmentally and operationally safe, low maintenance, operationally predictable, easy to use, have an acceptable level of efficiency and have the ability to automatically compensate to meet the variable conditions of a dynamic well bore.

SUMMARY OF INVENTION

The invention relates to a method and system of producing gas and liquid from a gas and liquid-containing underground stratum comprising a well bore extending between the surface of the ground to the stratum, the well bore having a casing and a production tube defining an annulus through which gas from the stratum passes and is collected at the surface of the ground through a production line. The production tube extends from the surface of the ground and is in fluid communication with the gas and liquid-containing stratum through which the liquid is collected from the well and removed to the surface by artificially raising the liquid in the production tube to the surface to thereby release gas from the formation to the well bore and production line. A side string tube extends from the surface of the ground through the annulus and is in fluid communication with the gas and liquid-containing stratum. An artificial lift system is provided for artificially raising the liquid in the production tube to the surface to thereby release gas from the formation to the well bore and production line.

According to the invention, the level of liquid in the well bore is reiteratively measured by reiteratively detecting at least the pressure in the side string tube, comparing the measured level of liquid with a predetermined value representative of a desired level of liquid in the well bore and controlling the artificial raising of the liquid in the production tube in accordance with the measured level and predetermined value so that the measured level reaches the predetermined value.

In one embodiment of the invention, the artificial raising of the liquid in the production tube is accomplished by injecting a volume of gas into a bottom portion of the production tube through the side string tube when the measured level of liquid (as detected by pressure) reaches the predetermined value.

According to a further aspect of the invention, a relatively small amount of gas is injected into the side string tube to clear any liquid that may be present in the side string tube, just prior to or during the detection of the pressure in the side string tube.

According to an even further aspect of the invention, the pressure in the production tube is detected, and the differential pressure between the detected side string pressure and the production tube pressure is calculated and compared to the predetermined value.

According to a further aspect of the invention, the rate of gas production in the production line is monitored and the predetermined value representative of the desired level of liquid in the well bore is adjusted to maximize gas production and liquid level. Preferably, the adjustment of the predetermined value is performed over a plurality of gas lift injection cycles or otherwise over a period of time for artificial lift systems incorporating a pump.

Still further according to the invention in a SSGL system, the time required to artificially raise the liquid in the production tube to the surface of the ground is measured and compared with a predetermined and desired time of liquid rise. The volume of gas injected into the production tube during the injection step is adjusted until the measured time of liquid rise to surface is substantially equal to the predetermined and desired time of liquid rise to surface.

According to another aspect of the invention, a pump is operatively associated with the production tube for artificially raising the liquid in the production tube. Depending on the well conditions, the pump can be started, stopped, sped up or slowed down to control the level of liquid in the well bore.

According to an even further aspect of the invention, the time is monitored at which the level of liquid in the well bore is measured and the predetermined set point representative of desired liquid level is altered when the time substantially equals a first predetermined time, such as the time just before a peak power draw from a power company, to thereby artificially raise the liquid in the production tube when the level of liquid in the well bore is different from the desired level. Preferably, the predetermined set point is lowered to a lower set point to thereby lower the level of liquid in the well bore to a reduced level, such that artificially raising the liquid in the production tube can be omitted during peak hours without interference with well production.

In a system for producing gas according to the invention, a first pressure sensor detects the pressure in the side string tube at surface and generates a first pressure signal representative of the detected pressure in the side string tube. A controller is operably connected to the first pressure sensor for reiteratively computing the level of liquid in the production tube or well bore in response at least in part to the first pressure signal. The computed level of liquid in the production tube or well bore is compared to a predetermined value representative of the desired level of liquid in the well bore and the artificial lift system is controlled to allow the level of liquid in the well bore to reach the desired level of liquid in the well bore.

In the embodiment of the invention wherein the artificial lift system comprises a gas injection system with an injection valve for periodically injecting a blast of gas into a lower portion of the production tube through the side string tube, the controller is operably connected to the injection valve and is adapted to control the initiation of the blast of gas into the production tube to artificially lift the liquid in the production tube to the surface of the ground. The controller actuates the injection valve to initiate the injection of gas into the side string tube when the measured level of liquid in the production tube reaches a predetermined value representative of the desired level of liquid in the production tube and well bore. Preferably, the controller is adapted to compute the level of liquid in the production tube in response to the first pressure signal after liquid has been substantially cleared from the side string tube by the injection of a minuscule volume of gas.

In a preferred embodiment of the invention wherein the artificial lift system comprises a gas injection system, a second pressure sensor is fluidly attached to the production tube to sense the pressure therein and to generate a second pressure signal representative of the pressure in the production tube. A controller is operably coupled to the second pressure sensor and is adapted to compute the level of liquid in the production tube in response at least in part to the first and second pressure signals. In a preferred embodiment of the invention, the controller is adapted to compute the level of liquid in the production tube in response to the difference between the first and second pressure signals.

In another embodiment of the invention, the artificial lift system comprises a beam pump. In still another embodiment of the invention, the artificial gas lift system comprises a progressive cavity pump. In still another embodiment of the invention, the artificial lift system is an electrically driven submersible pump.

In a preferred embodiment of the invention wherein the artificial lift system incorporates a pump, a second pressure sensor is fluidly attached to the annulus to sense the pressure therein and to generate a second pressure signal representative of the pressure in the annulus. A controller is operably coupled to the second pressure sensor and is adapted to compute the level of liquid in the well bore in response at least in part to the first and second pressure signals.

According to one aspect of the invention, the controller is adapted to compute the level of liquid in the well bore in response to the difference between the first and second pressure signals. Preferably the controller is adapted to generate an output signal for controlling the initiation of the artificial lift system when the liquid level in the well bore as detected by pressure reaches a predetermined value.

According to another embodiment of the invention in an SSGL artificial lift system, an arrival detector is mounted at an upper portion of the production tube or on the lubricator to detect the arrival of the ejected liquid or plunger from the lower portion of the production tube and to generate an arrival signal representative thereof. The controller is operably coupled to the arrival detector and is adapted to compute the time required to artificially lift the liquid or plunger from the lower portion of the production tube to the arrival detector, to compare the computed trip time of the liquid or plunger to a predetermined and desired trip time, and to control the operation of the injection valve to adjust the volume of gas injected into the side string tube during subsequent injection cycles until the computed trip time of the lifted liquid or plunger substantially equals the predetermined and desired trip time.

In yet another embodiment of the invention, a production detector in the production line measures the rate of gas production and generates a production signal responsive thereto. The controller is further operably coupled to the production detector and is adapted to compute the rate of gas production responsive to the production signal and to adjust the predetermined value representative of the desired liquid level in the production tube or well bore to maximize the gas production in the production line.

The invention can be applied to a single producing well with the controller physically at the wellhead. Alternatively, a controller can be used to control a plurality of wells. The controller can be located geographically remote from each of the wells and in communication with the sensors and control valves at the well head through electrical communication lines or through telemetry.

The invention contemplates several different, but related, methods of pressure monitoring for control of the gas injection cycle in a well using a subsurface gas lift artificial lift system, each with the objective of detecting the level of liquid in the production tube and therefore the well bore to initiate the gas injection cycle. These methods have varying accuracy according to the operational need dictated by the well bore configuration. In one embodiment of the invention, operational efficiency and control is enhanced by volumetric measurement of production gas to control the injection cycling of gas into the well by automated control of the liquid level in the well bore. In still another embodiment of the invention, injection volumes are regulated based on liquid or plunger travel time to surface or calculated average liquid or plunger time. It is to be understood, however, that each of the embodiments can be used by itself or combined with one another to achieve the desired system efficiency or control of a subsurface gas lift system.

The invention also contemplates several variations of pressure monitoring for control of the artificial lift systems in wells using the beam pump, progressive cavity pump or the electric submersible pump methods of artificial lift, each with the objective of detecting the level of liquid in the well bore prior to making adjustments to the artificial lift system. These methods have varying accuracy according to the operational need dictated by the well bore configuration. In one embodiment of the invention, operational efficiency and control is enhanced by volumetric measurement of production gas to control the operation of the artificial lift system by automated control of the liquid level in the well bore.

Fundamental to an understanding of how the pressure monitoring and control system of the invention can have a positive impact on artificial lift system performance is an understanding of the variations in pressures that can and do exist at various points in the artificial lift system. These pressures, measured at the appropriate time and interpreted correctly, will give a very accurate determination of the liquid level in the production tube and/or well bore.

Pressures in a bore hole are commonly referred to in the terms of pressure gradients. "Gradient" is defined as psi per vertical foot in the bore hole. Fresh water will have a gradient of 0.433 psi per vertical foot, whereas low pressure gas gradient may be as minimal as 0.002 psi per vertical foot. In effect, a 1000' column of fresh water will have a bottom hole or head pressure of 433 psi whereas the low pressure gas will have a bottom hole or head pressure of 2 psi.

In a well using the subsurface gas lift (SSGL) method of artificial lift, subsequent to the injection portion of the SSGL cycle, liquid will enter the bottom of the production tube through the standing valve attached to the injection mandrel and displace the gas in the production tube into the ejection line and to the collector at surface until the well bore has achieved static equilibrium. (Static equilibrium is commonly defined as the time when head pressure at the injection mandrel is substantially equalized between the inside of the production tube and the annular section of the well bore. Therefore, a no-flow condition exists between production tube and the annulus.) The column of liquid entering the production tube and displacing the gas into the flow line at surface will at the same time try to enter into the side string tube attached to the injection mandrel above the standing valve. However, the side string tube, unlike the production tube, is closed at surface. Therefore, the liquid can only enter the side string tube until the cumulative head pressure of the gas and liquid in the side string tube at the injection mandrel is equal to the cumulative head pressure of the gas and liquid in the production tube at the injection mandrel. At this point, the difference between the side string injection line pressure at surface and the production tube pressure at surface multiplied by the appropriate liquid gradient pressure factor will give the approximate liquid level in the production tube. The reason the liquid level is only approximate is due to the fact that liquid has entered the side string tube to compress the gas in the side string tube which causes there to be two different gradients in the side string tube, one for gas and one for liquid, the level of which is unknown. At this point, pressure manipulation will accurately determine actual liquid level in the production tube. Manipulation is accomplished by the injection of a minuscule volume of gas into the side string injection line attached to the side string tube. This volume will displace the liquid in the side string tube, causing only gas to be present in the side string tube. This volume is estimated based on the diameter of the side string tube and the estimated height of liquid in the side string tube. Typically, the amount of gas is determined by monitoring the pressure in the side string injection line at surface as the gas is injected into the side string tube and the volume is typically very small as compared to the amount of gas injected during the SSGL injection cycle. The pressure in the side string injection line will increase as the minuscule volume of gas is injected into the side string tube until all of the liquid in the side string tube is forced into the production tube at which time the pressure will stabilize. This step can be carried out manually by an operator or automatically by a controller. As a practical matter, the minuscule volume of gas can be injected continuously between injection cycles to maintain the side string tube free of liquid. As a result, the difference between the pressures in the side string injection line at surface and the production tube at surface multiplied by the appropriate liquid gradient factor is used to compute the level of liquid in the production tube with great accuracy. The computations are done reiteratively until the computed level of liquid in the production tube is equal to a predetermined level which is based on the well bore characteristics. When the predetermined level and the computed levels are equal, the SSGL injection cycle can then be initiated by the controller if desirable. This known level of liquid in the production tube can thus be used to greatly improve the efficiency of the SSGL system by effecting the cycling only when an optimum liquid level has been achieved while eliminating the single greatest control problem for SSGL, the "destructive dry cycle" that often causes mechanical damage and can cause environmental damage.

The pressure monitoring and calculation and control steps are preferably carried out for a first time period to determine the level of liquid in the production tube and the artificial lifting step is carried out subsequent to the first time period. Preferably, the initiation of the artificial lifting step is carried out at the completion of the first time period. Preferably, the artificial lifting step comprises the injection of a blast of high-pressure gas for a second time period, through the side string tube, into the lower portion of the production tube to lift the liquid in the production tube to the surface.

In the most primitive embodiment of the invention, the side string pressure is detected throughout the SSGL non-injection or off cycle to determine the level of liquid in the production tube; the detected pressure is compared with a predetermined pressure representative of the desired level of liquid in the production tube and; the SSGL injection cycle is initiated when the detected pressure is substantially equal to the predetermined pressure. In this case, the computation of the liquid level in the production tube will simply be the use of the detected pressure in the side string tube at surface. This method will require the greatest amount of operator intervention to work with nominal efficiency. This method will only give a rough estimate of the liquid level in the production tube due to the fact that there will be an influx of liquid into the side string tube and the production tube pressure at surface will only be an estimated average due to fluctuations in flow line pressure. Therefore, this system will perform best on wells with substantial rat hole or with high liquid levels where side string pressures will become noticeably elevated due to production tube liquid gradient.

In a more sophisticated embodiment of the invention, a minuscule volume of gas is injected into the side string injection line sufficient to displace the influx of liquid in the side string tube into the production tube, the side string pressure is monitored throughout the SSGL non-injection or off cycle as a measure of the level of liquid in the production tube and the measured pressure is compared with a predetermined value representative of the desired level of liquid in the production tube. The injection of a minuscule volume of gas in the side string tube eliminates the unknown side string tube liquid level so that the controller can more accurately detect the level of liquid in the production tube. The SSGL gas injection cycle is initiated when the detected pressure substantially equals the predetermined pressure representative of a desired liquid level in the production tube and therefore the well bore. While this method will more accurately reveal the level of liquid in the production tube to the controller, the system timing will still have an arbitrary pressure initiation base that will be dependent on the operator estimating an average production tube pressure at surface. Therefore, this method will perform best on wells with substantial rat hole or with relatively high liquid levels in which the side string injection line pressure will become noticeably elevated due to the production tube liquid gradient.

In a third embodiment of the invention, the side string injection line pressure and the production tube pressure at surface is monitored and detected throughout the SSGL non-injection or off cycle and a differential pressure representative of the level of liquid in the production tube is computed based on the detected pressures; the computed differential pressure is compared to a predetermined value representative of the desired level of liquid in the production tube; and the SSGL gas injection cycle is initiated when the computed pressure is substantially equal to the predetermined value. Thus, the SSGL gas injection cycle is controlled to permit the level of liquid in the production tube to rise to a predetermined level before initiation of the gas injection cycle. This method makes the system dynamic in that variations in production tube pressure at surface will have no effect on the differential pressure between the side string injection tube at surface and the production tube at surface. This differential pressure multiplied by the appropriate gradient factor for the liquid in the production tube will compute a relatively accurate estimation of the liquid level in the production tube regardless of fluctuations in the production tube surface pressure caused by changes in the pressure on the flow line. The pressures in this method still represent an estimate of the liquid level in the production tube due to the fact that there will be some influx of liquid into the side string tube. Therefore, while this method will more accurately detect the liquid level than the first two embodiments, it will still perform best on wells with at least some rat hole or with higher than average liquid levels where side string pressures will become marginally elevated due to production tube liquid gradient.

In a fourth embodiment of the invention, the same steps as the third embodiment are followed with the addition of the step of injecting a minuscule or relatively small volume of gas into the side string injection tube sufficient to displace the influx of liquid in the side string tube into the production tube while determining a differential pressure representative of the level of liquid in the production tube. In this method, any error resulting from the unknown side string tube liquid level is eliminated. The liquid level is thus more accurately determined for initiating the SSGL gas injection cycle. In this method, the system is dynamic in that variations in the production tube pressure at surface will have no impact on the differential pressure between the production tube and the side string pressures. Furthermore, because the side string tube will have only a gas gradient within it, the differential pressure multiplied by the appropriate liquid gradient factor will determine an exact liquid level in the production tube. In this method, the operator will be able to choose very accurately, by virtue of pressure, the liquid level that he or she desires to carry in the well bore and production tube to best optimize the available rat hole, conserve on injection volumes, increase well production and control the SSGL system.

In yet another embodiment of the invention, any of the foregoing methods are followed and gas production is measured relative to the liquid level in the well bore, and the liquid level within the well bore is automatically adjusted to maximize well production while simultaneously optimizing liquid level in the production tube to maximize the quantity of liquid delivered in each injection cycle. In many well bores, the lower section of the "productive" formation above the rat hole does not actually contribute to production. Reduction of the liquid level below the point in the formation that is not contributing production causes the level of liquid in the production tube to decrease. This unnecessary reduction in liquid level causes inefficiency in the SSGL system by increasing the need for SSGL cycles, thus using more injection gas to deliver a given quantity of liquid. In this new interactive and dynamic method of control, production gas is measured at the well head to establish the current production volumes. The controller is programmed with conventional software to use time weighted production volume averages to determine the current well bore production based on actual measurements. The predetermined liquid level pressure (PSI) or differential pressure (DP) set point for the initiation of the SSGL injection cycle is automatically adjusted upward so that the liquid level in the well bore rises before initiating the SSGL injection cycle as determined by any of the previous liquid level determination methods. As the liquid level rises, there will come a time when the gas production will decline within the specified time weighted average. At that point, the predetermined liquid level set point will be automatically reduced to decrease the level of liquid within the well bore before initiation of the SSGL cycle. The well bore response in the form of increased volumetric production is then monitored. As the production increases within the specified time and volume parameters, the predetermined set point for the desired liquid level will continue to be reduced until no more increase in production volume is detected within the specified time parameters. At that time, the set point will remain unchanged for a specified time period. At the end of the specified nonmanagement period, the liquid level management procedure described above will be repeated until the next dormant period. It is to be understood that the automated liquid level management method will be done with adjustments taking place over the course of many hours and possibly days, the end result being the maximum liquid level sustainable within a given well bore with minimal interference with production and a reduced need of injection gas.

In another embodiment of the invention, the plunger travel time to surface is monitored beginning at the start of the SSGL injection period and the plunger trip time within the production tube is computed. Plunger efficiency to remove the greatest quantity of the liquid that has entered the production tube is based on a liquid seal between the plunger O.D. and the production tube I.D. This liquid seal is created by turbulent flow around the plunger. Therefore, the seal is dependent upon the velocity of the plunger. If the plunger travels either too slow or too fast, liquid will escape past the plunger and not be ejected from the production tube, causing a waste of compression energy and the need for more cycles to eject the liquid. Furthermore, current operational technique has proven that it is more predictable to control a short, relatively high pressure, high volumetric rate, blast of injection gas into the production tube and provide a restricted orifice at the surface for the liquid to pass through to abruptly slow a high speed plunger rather than to use a relatively long injection period of lower pressures and lower volumetric rates. This restricted orifice at the surface creates another inefficiency in the SSGL system in that as the liquid arrives, it causes the production tube pressure at the surface to rise dramatically which, in turn, causes the need for more injection gas volume and a vicious cycle of inefficiency ensues. Field testing has revealed that in SSGL systems the average plunger velocity in the production tube is 1.8 times the optimum published speed and 1.25 times that of the maximum efficient velocity published in industry standard journals. Another issue to consider is that this average velocity does not reveal what the initial velocity off bottom must be to allow the injection gas to be shut off 20 to 30 seconds into a one-minute plunger trip to the surface. In this new and unique method, a predetermined optimum plunger trip time window is computed based on production tubing depth, well bore pressures and other pertinent factors known to those workers in this field. The actual plunger trip time is measured and compared to the predetermined optimum plunger trip time window at the end of each injection cycle. If the plunger trip time to surface is too long or the plunger does not arrive, the SSGL injection period is lengthened to increase average plunger velocity to thereby decrease plunger trip time and to encourage plunger arrival at surface. If the plunger trip time to surface is too short a period, the injection period will be decreased to reduce average plunger velocity to thereby increase plunger trip time and to control plunger impact into the lubricator at surface. With this method, it is possible to better manage the quantity of injection gas used per cycle, reduce the rate at which the gas is injected, reduce pressure needed on the high pressure injection line going to the well, increase the size of the restrictive orifice at surface to reduce production tube pressures and better control the average velocity of the plunger throughout the length of the production tube.

In some bore holes, a plunger is not installed in the production tube in a well in which an SSGL artificial lift system is used. In these systems, the arrival time of the liquid column at the surface is monitored and used to compute the trip time of the liquid column during the injection of the gas during the SSGL cycle. The trip time of the liquid column is compared to a predetermined and desired trip time and the SSGL injection period is adjusted to maintain the average velocity of the liquid column during the SSGL injection cycle within a predetermined range.

In wells using the beam pump, progressive cavity pump or electric submersible pump methods of artificial lift the pressure monitoring and liquid detection methods of the invention can be used to substantially improve the operational control and efficiency of these systems. In these types of artificial lift systems the side string tube is not fluidly connected with the I.D. of the production tube as in the SSGL system but rather is fluidly connected with and terminated in the annulus. The side string termination point in the annulus may vary according to the desired accuracy of liquid level detection, well bore characteristics or engineering preference as long as the termination point is as deep in the well bore as the lowest desired liquid level. Also, in artificial lift systems incorporating a pump, when a second pressure transmitter is used to detect the pressure at surface, this second pressure transmitter is fluidly attached to detect the annulus pressure rather than being attached to detect the liquid ejection line and production tube pressure as in an SSGL system because in the pump system the liquid level in the annulus is being specifically measured rather than the liquid level in the production tube. While there are subtle differences between how the invention is applied to artificial lift systems incorporating a pump as compared to artificial lift systems using sub surface gas lift, all of the previously mentioned well bore pressure gradient information is applicable and will be used herein as the basis for the following descriptions of the embodiments of the invention as applied to artificial lift systems incorporating a pump.

The pressure monitoring and calculation steps are preferably carried out for a first time period to determine the level of liquid in the well bore and the artificial lifting step is carried out during and/or subsequent to the first time period. Preferably, the control of the artificial lifting step is carried out at the completion of the first time period. Preferably, the control of the artificial lifting step comprises the altering of the pump operation to lift the liquid in the production tube to the surface of the ground. Preferably the altering of pump operation can include turning the pump system on or off, or increasing or decreasing the speed of the artificial lift pump to increase or decrease the volume of liquid being lifted from the well bore into the production tube and to the surface of the ground to thereby control the liquid level in the well bore at a predetermined and desired liquid level as detected by pressure.

In the first and most primitive embodiment of the invention the side string pressure is continuously detected to determine the level of liquid in the well bore. The detected pressure is compared with a predetermined pressure representative of the desired level of liquid in the well bore and the pump operation is altered to maintain the detected pressure representative of liquid level substantially equal to the predetermined pressure to thereby maintain the desired liquid level in the well bore. In this case, the computation of the liquid level in the well bore will simply be the use of the detected pressure in the side string tube. This method will require the placement of the termination point of the side string tube in the annulus to be very close to the desired liquid level and will require the greatest amount of operator intervention to work with nominal efficiency. This method will only give a rough estimate of the liquid level in the well bore due to the fact that there will be an influx of liquid into the side string tube and the annulus pressure at surface will only be an estimated average due to fluctuations in flow line pressure. Further, this method is inherently weak because there is not a source of injection gas at surface it will be necessary for the liquid level in the well bore to fall below the termination point of the side string tube occasionally to allow the side string tube to be cleared of all liquids because the smallest release of pressure at surface will cause the side string tube pressure at surface to decline, falsely indicating a low liquid level in the well bore.

In a second and more sophisticated embodiment of the invention, a minuscule volume of gas is injected into the side string injection line sufficient to displace the influx of liquid in the side string tube into the annulus, the side string pressure is monitored as a measure of the level of liquid in the well bore and the measured pressure is compared with a predetermined pressure representative of the desired level of liquid in the well bore. The injection of a minuscule amount of gas in the side string tube eliminates the unknown side string tube liquid level so that the controller can more accurately detect the level of liquid in the well bore. The pump operation is altered when the detected pressure substantially equals the predetermined pressure representative of a desired liquid level in the well bore. Further, in this embodiment, if the side string tube is terminated substantially below the highest desired liquid level it is possible to allow the pump operations to be altered with a substantial variation of liquid level in the well bore as detected by pressure. While this method will more accurately reveal the level of liquid in the well bore to the controller, the system control will still have an arbitrary pressure initiation base that will be dependent on the operator estimating an average annulus and production line pressure at surface. Therefore, this method will perform best on wells with substantial rat hole or with relatively high liquid levels in which the side string injection tube pressure will become noticeably elevated due to the well bore liquid gradient.

In a third embodiment of the invention, the side string injection tube pressure and the annulus pressure at surface are monitored and detected continuously and a differential pressure representative of the level of liquid in the well bore is computed based on the detected pressures; the computed differential pressure is compared to a predetermined value representative of the desired level of liquid in the well bore; and pump operations are altered when the computed pressure is substantially equal to the predetermined value. Thus, the artificial lilting is controlled to permit the level of liquid in the well bore to rise to a predetermined level before lilting the liquid to the surface of the ground. This method makes the system dynamic in that variations in annulus or flow line pressure at surface will have no effect on the differential pressure between the side string injection tube at surface and the annulus pressure at surface. This differential pressure multiplied by the appropriate gradient factor for the liquid in the well bore will compute a relatively accurate estimation of the liquid level in the well bore regardless of fluctuations in the annulus surface pressure caused by changes in the pressure on the flow line. The pressures in this method still represent an estimate of the liquid level in the well bore due to the fact that there will be some influx of liquid into the side string tube. Therefore, while this method will more accurately detect the liquid level than the first two embodiments, it will still perform best on wells with at least some rat hole or with higher than average liquid levels where side string pressures will become marginally elevated due to well bore liquid gradient. Further, because no gas is being injected down the side string tube the smallest leak will eventually cause the side string pressure to decline and falsely indicate a low liquid level as detected by pressure, therefore the termination point of the side string tube in the annulus must be very close to the desired level of liquid in the well bore to allow the liquids to intermittently fall below the termination point of the side string tube to thereby clear all liquid from the side string tube.

In a fourth embodiment of the invention, the same steps as the third embodiment are followed with the addition of the step of injecting a minuscule or relatively small volume of gas into the side string injection tube sufficient to displace the influx of liquid in the side string tube into the annulus while determining a differential pressure representative of the level of liquid in the well bore. In this method, any error resulting from the unknown side string tube liquid level is eliminated. The liquid level is thus more accurately determined for altering pump operation. In this method, the system is dynamic in that variations in the annulus and flow line pressure at surface will have no impact on the differential pressure between the annulus and the side string pressures. Furthermore, because the side string tube will have only a gas gradient within it, the differential pressure multiplied by the appropriate liquid gradient factor will determine an exact liquid level in the well bore. In this method, the operator will be able to choose very accurately, by virtue of pressure, the liquid level that he or she desires to carry in the well bore to best optimize the available rat hole to conserve energy necessary keep the productive formation dewatered and optimize production. Also in this embodiment, if the side string tube is terminated substantially below the highest desired liquid level in the well bore it is possible to allow the pump operations, if desirable, to be altered with a substantial variation of liquid level in the well bore as detected by pressure.

In yet another embodiment of the invention, any of the foregoing methods are followed and gas production is measured relative to the liquid level in the well bore, and the liquid level within the well bore is adjusted to maximize well production while simultaneously optimizing liquid level in the well bore. In many well bores, the lower section of the "productive" formation above the rat hole does not actually contribute to production. This unnecessary reduction in liquid level causes inefficiency in the artificial lift system incorporating a pump in that more energy is required to lift a given volume of liquid to the surface of the ground. In this new interactive and dynamic method of control, production gas is measured at the well head to establish the current production volumes. The controller is programmed with conventional software to use time weighted production volume averages to determine the current well bore production based on actual measurements. The predetermined liquid level pressure (PSI) or differential pressure (DP) set point for the altering of pump operation is automatically adjusted upward so that the liquid level in the well bore rises as determined by any of the previous liquid level determination methods. As the liquid level rises, there will come a time when the gas production will decline within the specified time weighted average. At that point, the predetermined liquid level set point will be automatically reduced to alter the pump operation to decrease the level of liquid within the well bore. The well bore response in the form of increased volumetric production is then monitored. As the production increases within the specified time and volume parameters, the predetermined set point for the desired liquid level will continue to be automatically decreased until no more increase in production volume is detected within the specified time parameters. At that time, the predetermined liquid level set point will remain unchanged for a specified time period. At the end of the specified nonmanagement period, the liquid level management procedure described above will be repeated until the next dormant period. It is to be understood that the automated liquid level management method will be done with adjustments taking place over the course of many hours and possibly days, the end result being the maximum liquid level sustainable within a given well bore with minimal interference with production and a reduced need for artificial lift energy.

In yet another embodiment of the invention the liquid level detection method is used to alter pump operation for the timely use of energy. As is commonly known, peak electrical load hours require electric utility companies to invest large sums to meet the high demand caused by residential use for short periods of time in the morning and evening. Often oil and gas wells are drilled in great numbers in small geographical areas and the artificial lift systems powered by electricity use electrical energy from the same electrical power grid as the surrounding residences. If the power requirements for the oil or gas well artificial lift systems can be reduced or eliminated during the peak residential load hours a benefit will be realized to all the parties involved in electricity production and usage. In this method, the time is monitored relative to the peak load time established by the electrical utility company and pump operations are altered to balance the liquid removal requirements of the well bore with the need to reduce electrical energy consumption at appropriate and critical times. Obviously, the artificial lift system pump can be shut down to prevent the system from drawing power during peak hours but this shut down may cause the liquid level to rise in the well bore and reduce production down the gas production line. In this new and unique method the controller detects a time prior to peak load hours and adjusts the predetermined (PSI or DP) set point of liquid level in the well bore to a minimum value. Subsequently the pump operation is altered to reduce the liquid level in the well bore to substantially equal the predetermined value, then during the peak load hours the pump system can be shut down or pump speed reduced so as to eliminate or reduce the artificial lift system power draw from the electrical power grid. Further, because the liquid level has been reduced to a minimum level the empty rat hole in the well becomes storage for liquid entering the well bore to minimized the effect of liquid level on production volumes due to the fact that the liquid must first fill the rat hole before it can begin to cover the productive formation and interfere with production. In this method, while the pump will require increased amounts of energy to reduce the liquid level into the rat hole below the productive formation, the energy will be required at an off peak load time when the electrical grid has power to spare. In this embodiment the prudent and timely use of electrical energy will benefit all parties involved with the electrical grid while allowing the operator to minimize the impact on production.

The invention uses variations of a method of liquid level detection to provide improved control methods and apparatus for various types of gas or oil well artificial lift systems which enhance efficiency, improve production, are cost effective, environmentally friendly, contribute to operational predictability and safety, are diverse enough to accommodate various well bore configurations, and are able to automatically accommodate a dynamic well bore and support the prudent and timely use of energy resources.

BRIEF DESCRIPTION OF THE DRAWINGS

The invention will now be described with reference to the drawings in which.

Figure 25:
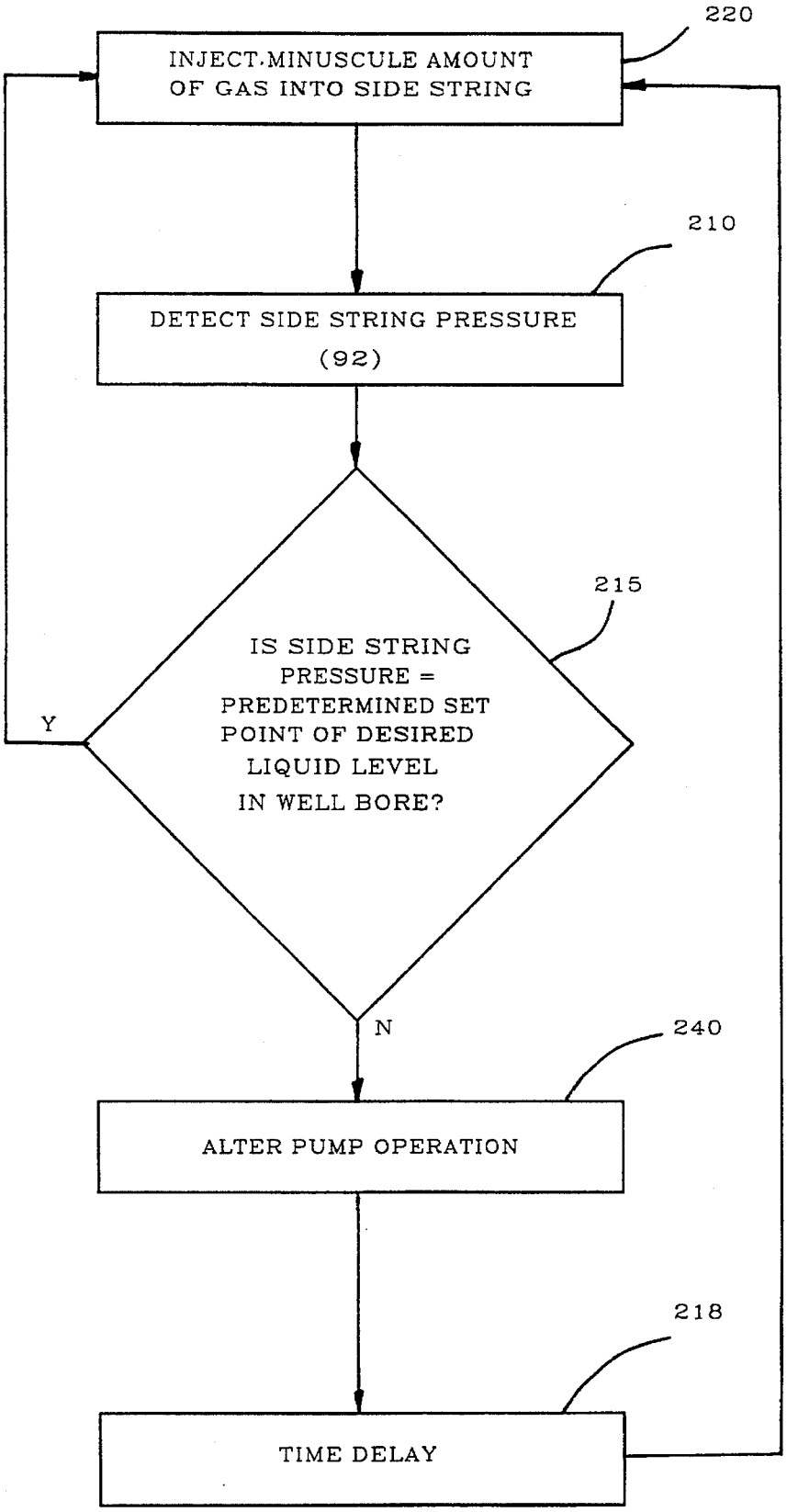
Figure 26:
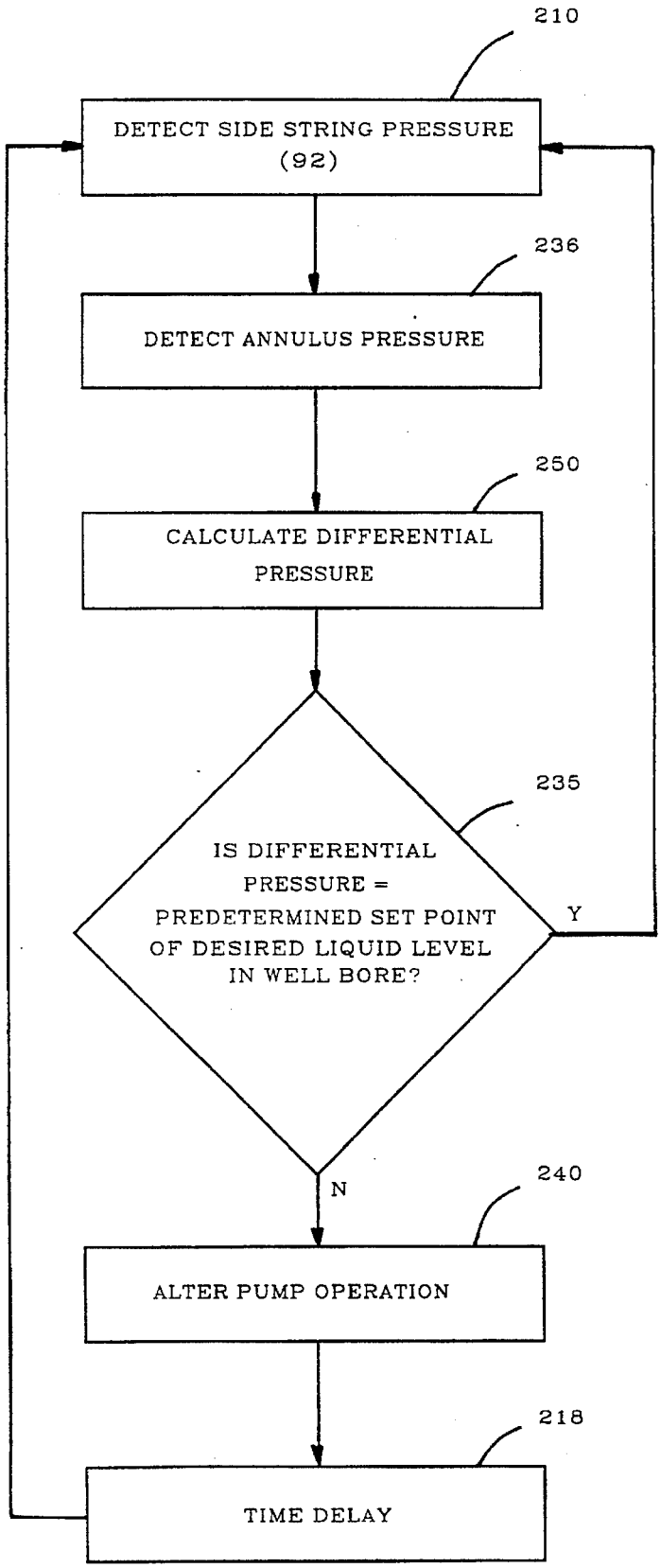
Figure 27:
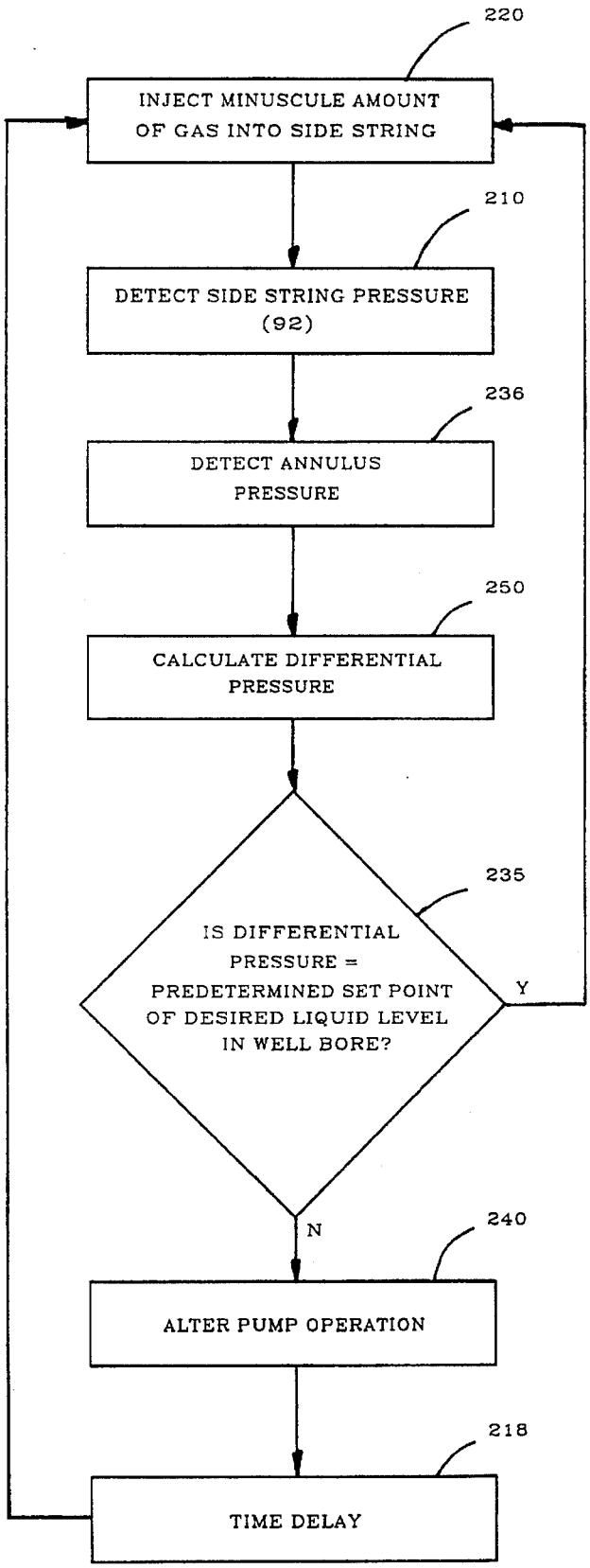
Figure 28:
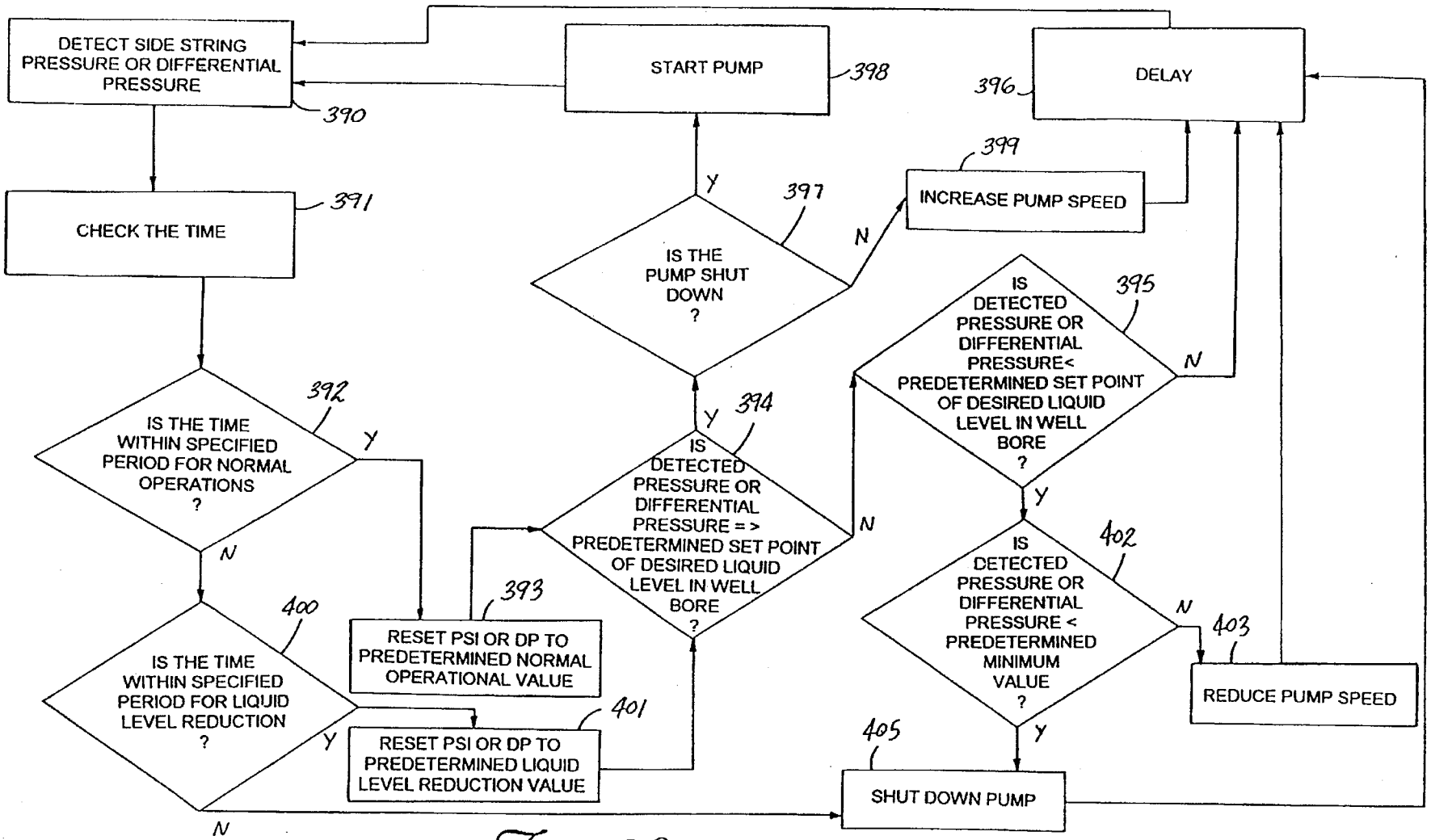

FIG, 24 is a block diagram illustrating a method according to the invention for controlling a pump in an oil or gas well having an artificial lift system;

FIG. 25 is a block diagram illustrating yet another method according to the invention for controlling a pump in an oil or gas well having an artificial lift system;

FIG. 26 is a block diagram illustrating still another method according to the invention for controlling a pump in an oil or gas well having an artificial lift system;

FIG. 27 is a block diagram illustrating and still another method according to the invention for controlling a pump in an oil or gas well having an artificial lift system; and FIG. 28 is a block diagram illustrating a method according the invention for dynamically adjusting a predetermined set point to reduce energy drawn by the artificial lift system during peak load hours and optimize production.

DESCRIPTION OF THE PREFERRED EMBODIMENTS

To avoid an unreasonable amount of redundance, the invention will be described in two parts.

In part one, as the invention applies to an artificial lift system incorporating sub surface gas lift SSGL (FIG. 1 through 14), and in part two, as the invention applies to artificial lift systems incorporating the use of a pump (FIGS. 10, and 15 through 28). In each of these artificial lift systems the invention will be describe from its most simple form using only one sensor 92 to a complete system that is both dynamic and interactive using multiple sensors 91, 92, 93, 94 and in the case of the SSGL system including the use of a magnetic sensor 95.

Figure 1:
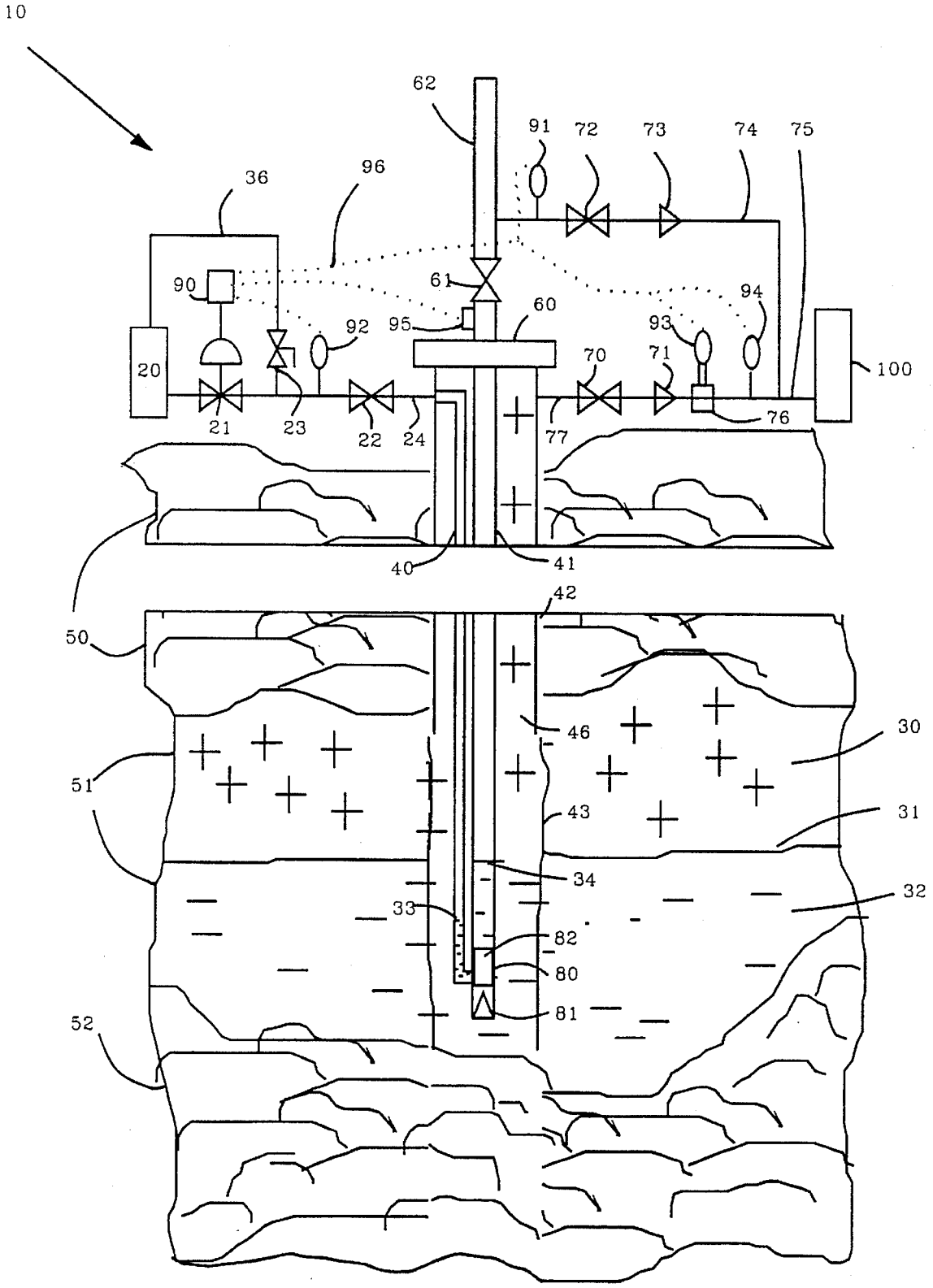
FIG. 1 is a schematic cross sectional view of a bore hole with a subsurface gas lift artificial lift system incorporating a control system according to the invention.

In part one, FIG. 1 illustrates a well assembly having an artificial lift system 10 that incorporates a subsurface gas lift system (SSGL) and an electronic controller 90 in conjunction with electronic sensors 91, 92, 93, 94, and 95. The controller 90 can be one of any well known micro controllers having a central processing unit, arithmetic logic unit, memory locations, input/output ports, timer(s), etc, or can be an electronic circuit having a comparator depending on the particular well assembly complexity. The comparator can also be associated with a display, such as a monitor or printer for displaying well conditions. The system is closed to atmosphere, creating a closed artificial lift system.

As illustrated, the formation contains two types of fluid, natural gas 30 and water 32 in the liquid state. However, other types of liquid such as liquid hydrocarbons can be in the formation 51. The natural gas 30 and liquid 32 are typically separated because of their different densities. The liquid 32 can have some natural gas in solution. The formation 51 can also hold substantial quantities of natural gas that is retained within the formation 51. The natural gas 30 and liquid 32 are usually under pressure in the formation 51. The pressure of the fluids in the formation can be caused by the weight of overburden 50 acting on the formation and the pressure of the liquids in the formation 51. This internal pressure of the formation is known as the head pressure. The natural gas 30 and liquid 32 are at static equilibrium within the formation 51. To deplete the natural gas from the formation 51, it is necessary to remove the liquid from the formation 51 so that the head pressure is reduced to release the natural gas 30 from the formation 51 and so the natural gas 30 in the formation 51 can fill the well bore in the area vacated by the removed liquid 32.

The well assembly 60 comprises a casing 42 disposed from the surface and extending into the bore hole 43 and into the formation 51. Preferably, the casing 42 extends substantially to the bottom of the overburden 50 and to the formation 51 and is open at the lower end or has suitable perforations through which the gas 30 and liquids 32 can pass. However, a rat hole portion 45 of the bore hole, shown in FIGS. 2 and 3, can be drilled below the bottom of the formation 51 and into the substrata 52 and the casing 42 can extend into the rat hole 45.

The casing 42 is sealed with respect to the atmosphere at its upper end by a wellhead 60. A production tube 41 extends through the wellhead 60 and extends substantially near the bottom of the bore hole 43. The casing 42 may or may not extend to the bottom of the formation, depending on the application. Although the casing 42 is illustrated as extending the entire length of the bore hole, (FIGS. 2 and 3), the casing 42 typically extends only to a depth dictated by engineering preference or completion technique because of the relatively high cost of installing and perforating the casing 42. However, the casing 42 is present at the surface of the bore hole and cooperates with the wellhead 60 to seal the bore hole with respect to the atmosphere.

An annulus 46 is formed by the inner diameter of the casing 42 or bore hole 43 and the outer diameter of the production tube 41. The lower end of the production tube 41 has an injection mandrel 80 in which is mounted a one-way standing valve 81. A high pressure side string injection line 24 extends from a high pressure gas source 20 through the well head 60 to a high pressure side string injection tube 40 and to the injection mandrel 80. Preferably, the side string injection tube 40 is fluidly connected with the I.D. of injection mandrel 80 above the standing valve 81. When high pressure gas is directed from the high pressure gas source 20 through the side string injection tube 40 and into the production tube 41, the standing valve 81 prohibits the high pressure gas from escaping from the production tube 41 and keeps the high pressure gas out of the annulus 46. A plunger 82 can be disposed in the production tube 41 above the inlet for the side string injection tube 40 and is sized to fit within close tolerance of the inner diameter of the production tube 41. In some SSGL systems, the plunger is eliminated.

An open hole or uncased section of the bore hole 43 (FIG. 1) or a series of perforations 44 (FIGS. 2 and 3) are formed in the casing so that the fluids, such as the natural gas and liquid, can enter the annulus 46. The casing 42 also has a production line 77 positioned at the surface, and extending to a collector 100 which separates liquid from gas, so that the natural gas entering the annulus 46 through the perforations 44 or open hole 43 can be directed to the collector 100. A valve 70 and a check valve 71 are disposed within the production line 77 between the casing 42 and the collector 100. The valve 70 and the check valve 71 control the flow of natural gas 30 from the annulus 46 to the collector 100. Preferably, the valve 70 is a manually operated valve to close the production line 77, whereas the check valve 71 is a one-way valve that permits the flow of the natural gas 30 from the annulus 46 to the collector 100 but prohibits flow from the collector 100 into the annulus 46. The production line 77 further has in it a measurement orifice 76 and pressure sensors and transmitters 93 and 94. The measurement orifice 76 is operably connected to the differential pressure transmitter 93 and pressure transmitter 94 is operably connected to the production line 77. (While only a single method of gas measurement is presented herein it is to be understood that any method of gas measurement such as a turbine meter or vortex meter, etc. may be used as long as an output signal is generated representative of the flow in the production line 77.) The collector 100 is further connected to the production tube 41 through master valve 61, lubricator 62, ejection line 74 and commingling line 75. The ejection line 74 has a pressure sensor and transmitter 91, and isolation valve 72 and a check valve 73.

A motor valve 21, pressure sensor and transmitter 92 and a valve 22 are positioned in the side string injection line 24. The valve 22 is preferably a manually operated valve for opening and closing the side string injection tube 40 when desired. The motor valve 21 is connected to a controller 90 having a timer. A small branch line 36 extends from the high pressure source 20 to the side string injection line 24 between the motor valve 21 and the pressure sensor and transmitter 92. The branch line 36 has a regulator 23 to control the pressure and volume flowing therethrough. The controller 90 can be programmable and opens and closes the motor valve 21 so that the high pressure gas from the high pressure gas source 20 can be injected through the side string tube 40 and into the production tube 41 at either predetermined or dynamic intervals according to the invention. The controller 90 can be any suitable controller which is programmable to make the computations from the pressure signals from the sensors 91, 92, 93, 94 and 95, compare the resultant signals to predetermined set points, and open the valve 21 for a predetermined length of time during the SSGL cycle. The controller 90 is further programmable to make the computations described hereinafter for adjusting the time of the gas injection cycle and to adjust the predetermined set points on the controller as described hereinafter. A suitable controller for this purpose is a Pumpmate Control, sold by OKC Products of Longmont, Colo. Further the controller 90 can be a simple monitoring device incorporating a timer and a telemetry unit 290 (FIG. 14) that transmits the value from the sensors 91, 92, 93, 94 and 95 to a remote data receiver 292 and computer 294 which completes the logic functions and then transmits the control parameters according to the invention back to the telemetry unit 292 and to the timer 90 for control of the artificial lift system 10.

A lubricator 62 is mounted to the wellhead 60 above the production tube 41 and is fluidly connected to the production tube 41. The lubricator 62 is an extension of the production tube 41. The lubricator preferably has a cushioning device, such as a spring, positioned at the upper end of the lubricator 62 when a plunger 82 is disposed in the production tube 41. The spring functions to cushion or arrest the upward movement of the plunger 82. The lubricator 62 can consist of any device with an outlet to the ejection line 74 if a plunger 82 is not disposed in the production tube 41. A valve 61 is connected to the production tube 41 at an upper portion thereof and is preferably manually operated to open and close the flow from the production tube 41 and through the lubricator 62 when desired.

An ejection line 74 extends from the lubricator 62, preferably above the valve 61, and is connected to the production line 77. Alternately, according to FIGS. 4 and 5, the ejection line 74 can be isolated from the production line 77 or intermittently equalized with the production line 77. Preferably a valve 72 and a check valve 73 are connected in the ejection line 74. The pressure sensor and transmitter 91 is also mounted in the ejection line 74 to detect the pressure in the production tube 41 at the surface of the ground. The valve 72 is a manually operated valve to open and close the ejection line 74, whereas the check valve 73 is preferably a one-way valve for controlling the flow from the lubricator 62 to the production line 77, but preventing flow from the production line 77 to the ejection line 74 and into the production tube 41. The check valves 71 and 73 keep fluids from back flowing from the commingling line 75 into the production tube 41 or the annulus 46.

The check valves 71 and 73 isolate the annulus 46 and the production tube 41 from back flowing into each other at the surface but allow them to equalize in pressure with respect to the commingling line 75. Because the production tube 41 and the annulus 46 are fluidly connected to commingling line 75, they are equalized in pressure at surface and the liquid can reach a static equilibrium with similar levels in the production tube 41 and the annulus 46. Alternately, the ejection line 74 and the production line 77 can be isolated to their respective collectors (FIG. 4), and, therefore, static equilibrium can be achieved with dissimilar liquid levels in the production tube 41 and the annulus 46. During the injection of high pressure gas from the high-pressure gas source 20 through the side string injection line 24 down the side string injection tube 40 and the ejection of liquids up the production tube 41 through the ejection line 74 and into the commingling line 75, the check valve 71 directs the liquid flow to the collector 100 rather than allowing the liquid to reenter the annulus 46.

Although only one plumbing arrangement is shown in FIG. 1, there are many possible variations. It should be understood that the well assembly 60 and the SSGL 10 can be reconfigured so as to eliminate or include various components as long as sensors 91 and 92 are mounted in the injection line 24 and the ejection line 74, respectively, to gather pressure information to determine the static liquid level 34 within the production tube 41. Sensors 93 and 94 are mounted in gas production line 77 to gather pressure information to determine production through the production line 77 and sensor 95 is mounted to the lubricator 62 or to the upper portion of the production tube 41 to detect the plunger 82 or liquid 32 travel time to surface. Further, even though the pressure sensors and transmitters 91, 92, 93, 94 are shown in only one configuration, various arrangements can be used. For example in FIG. 1, pressure sensor 94 could serve the dual purpose of pressure measurement of the production line 77 and ejection line 74 because these lines are substantially equalized. Therefore many possible plumbing and electronic arrangements exist within the scope of the invention without departing from the spirit of the invention.

There are several pressure measurements relevant to determining the bottom hole or head pressure in the artificial lift system 10 and the location of the liquid level 34 in the production tube 41 and therefore the annulus 46. Besides the pressure of the side string injection line 24 at surface and the production tube 41 at surface, the pressures in the length of bore hole 43 and the production tube 41 must also be considered. The pressures in the length of bore hole 43 and the production tube 41 are commonly referred to in the terms of pressure gradients. "Gradient" is defined as pounds of pressure per square inch (psi) per vertical foot in the bore hole. For example, fresh water will have gradient of 0.433 psi per vertical foot, whereas an unpressurized gas gradient may be as low as 0.002 psi per vertical foot. In effect, a 1000-foot column of fresh water will have a bottom hole or head pressure of 433 psi whereas a 1000-foot column of unpressurized gas would have a bottom hole or head pressure of 2 psi.

Most artificial lift systems discharge their liquids or gas into a pressurized production line 77, such as a pipeline system that directs the liquids or gas to a collector, such as collector 100 at a production facility. This gathering system pressure promotes flow from the well head to the production facility and also aids in the separation of the gas and liquid in that the collector 100 may require pressure to discharge the liquid from the collector 100 to a tank. Also, the compressors used to compress the gas up to sales line pressure, except in rare configurations, require a positive inlet pressure to perform efficiently. Variations in this pipeline pressure and, therefore, the production line 77 pressure will cause the SSGL artificial lift system 10 to perform erratically in that higher pressures often cause the static liquid level 31 in the annulus 46 to decrease. Decreasing the liquid level in the annulus 46 will decrease the liquid level in the production tube 41. Without a corresponding decrease in the volume of injection gas 20 injected into the production tube 41, the plunger 82 will rise in the production tube 41 with ever increasing velocity. If this condition is unchecked, damage may result. On the other hand, a decreasing pressure on the pipeline system and, therefore, in the production line 77 will cause the static liquid level 31 in the annulus 46 to rise. A rising static liquid level 31 in the annulus 46 will cause the liquid level 34 in the production tube 41 to rise. An increase in the liquid level in the production tube 41 without a corresponding increase in the volume of injection gas 20 injected into the production tube 41 under the plunger 82 will cause the plunger to fail to rise to surface and eject the liquid. If this condition is unchecked, the well will load up with liquid and gas production 30 into the annulus 46 will become suppressed. Therefore, a method of detecting the static liquid level 31 in the well bore to initiate the artificial lift 10 cycle and automatically adjusting the injection gas 20 volumes injected into the production tube 41 to sustain a consistent production gas 30 volume in a system with ever changing pressures and liquid level is of great importance.

Referring to FIG. 1, the operation of the SSGL artificial lift system 10 begins with the opening of valves 22, 61, 70, and 72. Valves 22, 61, 70, and 72 are normally open during normal production operations. The liquid 32 in the formation 51 can then more fully enter the production tube 41 through the standing valve 81 attached to the injection mandrel 80 to reach a point of static equilibrium with the liquid level 31 in the formation 51 because the production tube 41 is fluidly equalized at the surface with the annulus 46 via the production line 77, the ejection line 74 and the commingling line 75. The controller 90 initiates the injection of gas into the side string 40 and into the mandrel 80 under the plunger 82 by opening the motor valve 21 to physically raise the liquid 32 in the production tube 41 to the surface and remove the liquid 32 through the lubricator 62 into the ejection line 74 and to the collector 100. After a predetermined and arbitrary period of injection into the side string tube 40, the controller 90 will close the motor valve 21 until the next injection cycle is to begin. The blast of injection gas from source 20 is prohibited from exiting the bottom of the production tube 41 by the one way standing valve 81 which allows the liquid 32 to enter the production tube 41 but prohibits the liquid 32 and the injection gas in the production tube 41 from escaping into the annulus 46. Further, the check valve 71 on the production line 77 directs the flow of liquid 32 and injection gas from the ejection line 74 down the commingling line 75 to the collector 100 and prohibits the back flow of liquid 32 or injection gas 20 into the annulus 46.

A pressure sensor 92 is fluidly connected to the side string injection line 24 to detect the pressure caused by the influx of liquid 32 into the production tube 41. The liquid 32 entering the production tube 41 will rise to a point 34 where the combined head pressure of the gas and liquid in the production tube 41 will be equal to the combined head pressure of the gas and liquid in the annulus 46 at the injection mandrel 80. As the liquid 32 enters the production tube 41, it will also enter the side string tube 40 through the side string tube 40 attachment port on the mandrel 80. However, the side string tube 40 influx liquid 33 entering into the side string tube 40 will achieve only a portion of the liquid level 34 in the production tube 41 because the side string injection line 24 motor valve 21 is shut and the side string tube 40 is not equalized with the production line 77 or ejection line 74 at surface. This influx of liquid 33 will cause the pressure of the side string injection line 24 at surface to rise until the combined head pressures of the gas in the side string tube 40 and the liquid level 33 in the side string tube 40 are equal to the combined head pressure of the gas and liquid in the production tube 41 at the side string tube 40 attachment point on the mandrel 80. At this point, the difference between the side string injection line 24 pressure at surface and the production tube 41 pressure at surface multiplied by the appropriate liquid gradient pressure factor will give an approximate liquid level 34 in the production tube 41. It is important to understand, however, that the liquid level is approximate due to the fact that liquid has entered the side string tube 40 to compress the gas in the upper portion thereof which results in two different gradients in the side string tube 40, one for gas and one for influx liquid 33, the level of which is unknown. This side string injection line 24 pressure detected by pressure sensor 92 can be used to determine an estimated pressure set point to be programmed into the controller 90 to initiate the SSGL injection cycle based on an estimated liquid level. To this end, the pressure sensor 92 is electrically connected to the controller 90 so that a signal representative of the pressure in the side string line 24 as detected by the pressure sensor 92 is input into the controller 90. The controller is programmed with a predetermined set point representative of the desired liquid level in the production tube 41 for initiation of the SSGL injection cycle.

Figure 6:
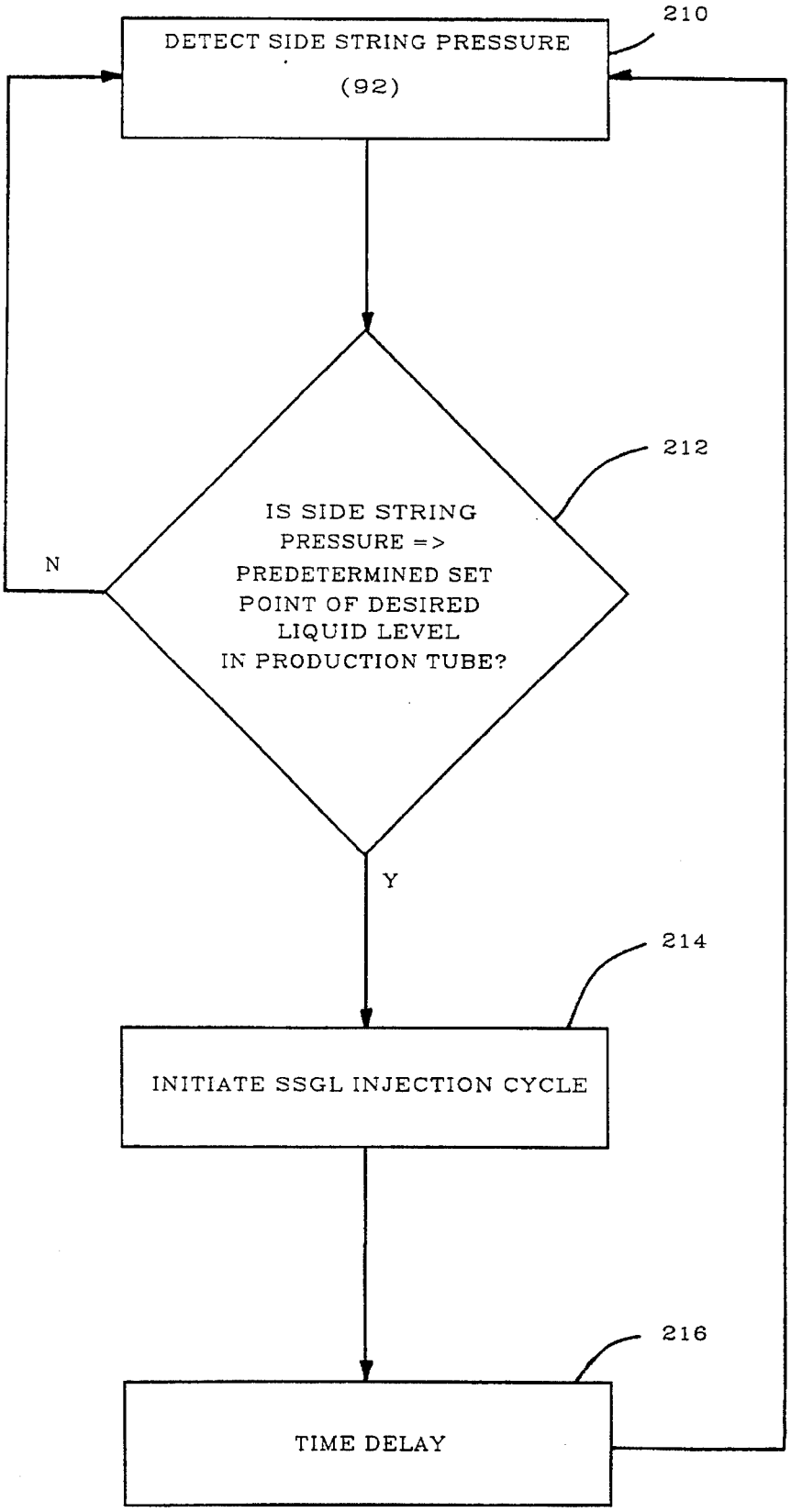
FIG. 6 is a block diagram illustrating a method according to the invention for controlling a gas injection cycle in an oil or gas well having an SSGL artificial gas lift system.

The basic method of controlling the SSGL cycle, as shown in FIG. 6, includes reiteratively monitoring the production tube liquid level throughout the SSGL non-injection or off cycle by detecting the side string tube (sst) pressure with pressure sensor 92 as represented in block 210. The controller 90 then compares the detected side string pressure to the predetermined set point as represented at block 212. If the side string pressure is less than the predetermined set point, the side string pressure is again detected. When the production tube 41 liquid level 34 (as indicated by pressure) substantially equals the predetermined set point in the controller 90, controller 90 will initiate the SSGL injection cycle as represented at block 214. In this step, the controller 90 will open control valve 21 for a predetermined period of time to deliver a high-pressure blast of gas to the bottom of the production tube 41. During initiation of the SSGL injection cycle, a time delay as represented at block 216 is activated. This time delay allows the liquid column and/or plunger 82 to reach the surface and also allows the plunger 82 to return under gravity to its position proximal to the side string injection tube 40 inlet to the injection mandrel 80 before commencing another reiterative monitoring of the production tube 41 liquid level 34.

This method will require the greatest amount of operator intervention to work with nominal efficiency. This method will only give a rough estimate of the liquid level 34 in the production tube 41 due to the fact that there will be an influx of liquid 32 into the side string 40 the level 33 of which unknown. This method is also prone to error in that the predetermined SSGL artificial lift 10 injection initiation pressure set point programmed into the controller 90 is subject to errors that can be induced by fluctuations in production line 77 or ejection line 74 pressures (FIG. 4) due to the fact the operator must assume an average production line 77 or ejection line 74 pressure when programming the predetermined set point in controller 90. Therefore, this method will perform best on wells with substantial rat hole 45 (FIGS. 2 and 3) or with very high liquid levels 31 where side string injection line 24 pressure will become noticeably elevated due to the production tube 41 liquid gradient.

Figure 7:
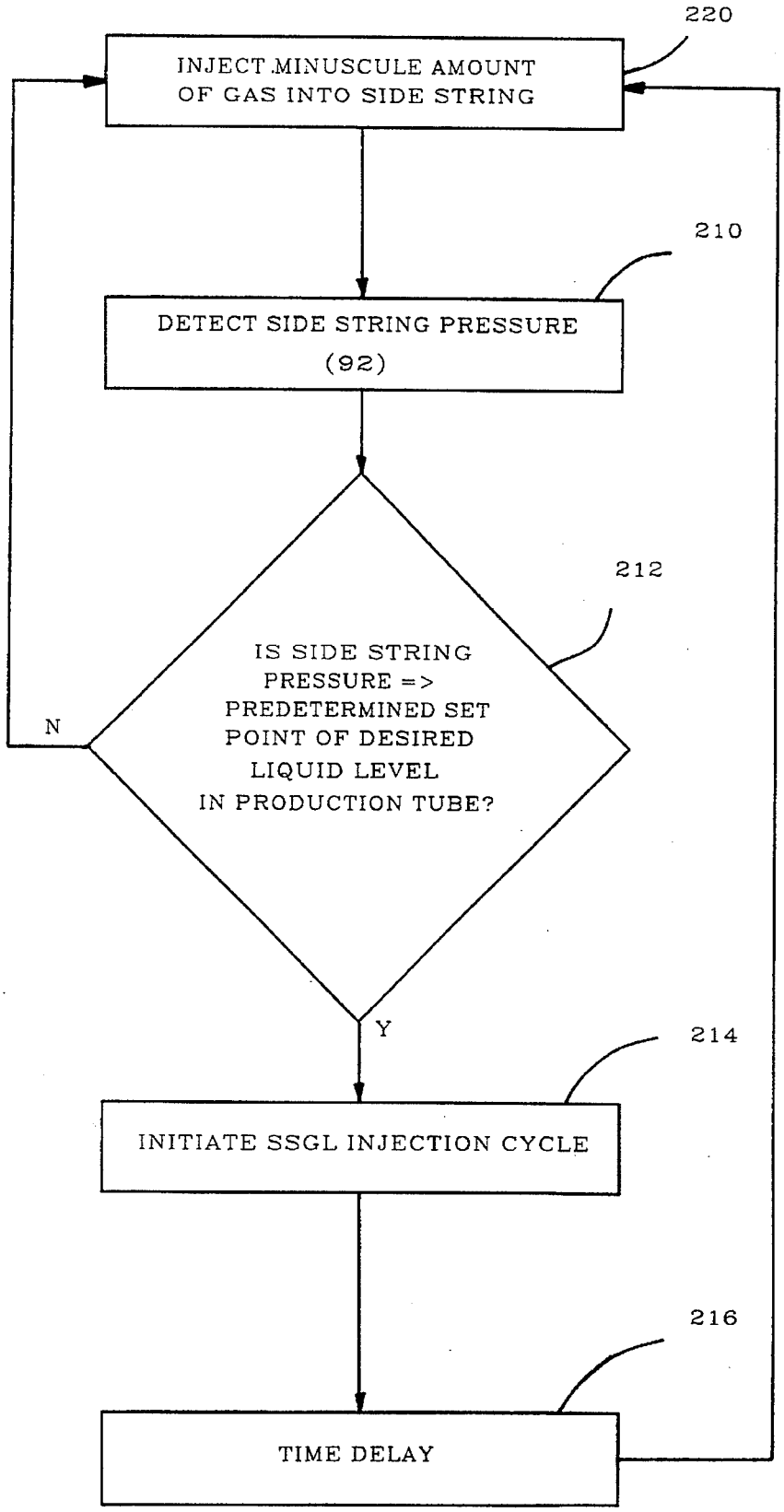
FIG. 7 is a block diagram illustrating yet another method according to the invention for controlling a gas injection cycle in an oil or gas well having an SSGL artificial gas lift system.
Figure 8:
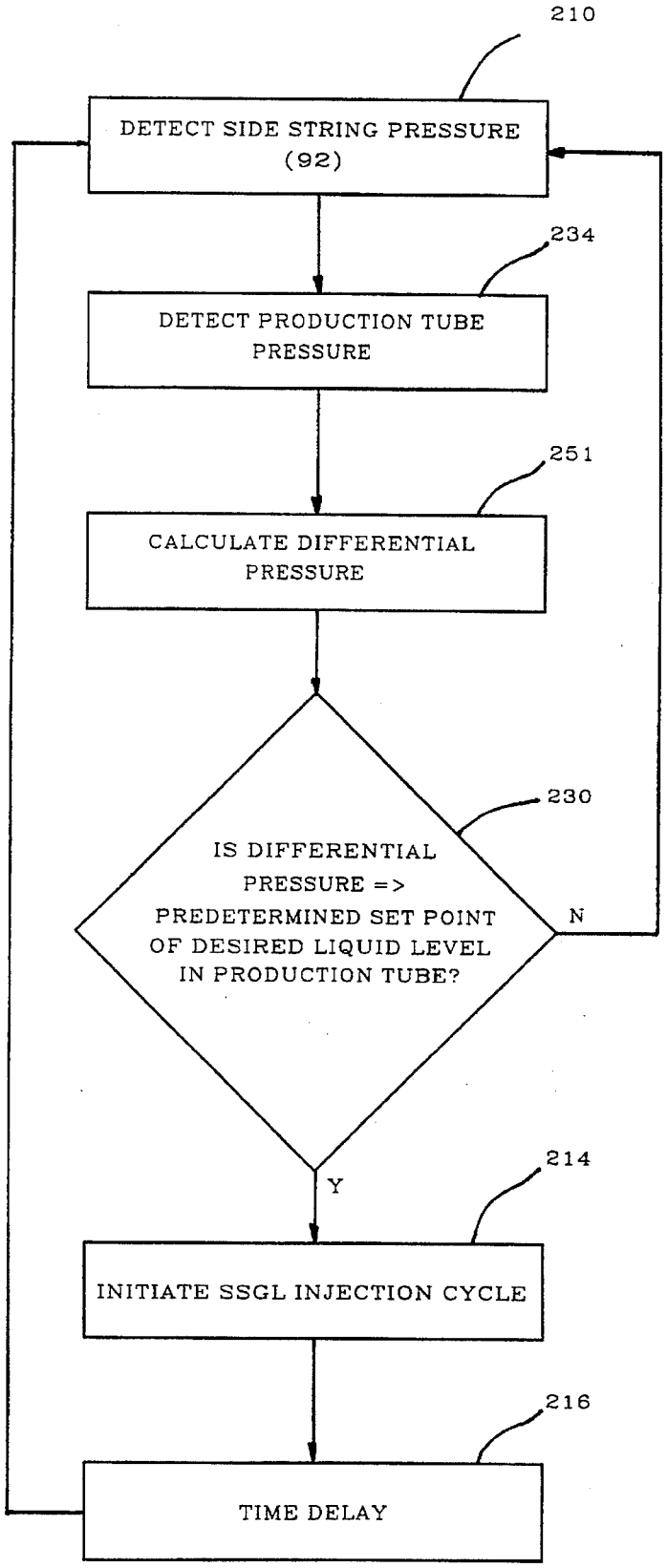
FIG. 8 is a block diagram illustrating still another method according to the invention for controlling a gas injection cycle in an oil or gas well having an SSGL artificial gas lift system.

The second embodiment of a method according to the invention, as schematically represented in FIG. 7, incorporates all the steps of the first embodiment illustrated in FIG. 6 plus the improvement step of injecting a relatively small or minuscule volume of injection gas from source 20 through a regulator 23 into the side string injection line 24 to remove the influx liquid level 33 in the side string tube 40 down to the level of the side string tube 40 connection on the injection mandrel 80 so that the pressure in the side string injection line 24 more accurately represents the head pressure in the production tube 41. This method of controlling the SSGL injection cycle includes injecting a minuscule volume of gas into the side string at block 220 during the SSGL non-injection or off cycle. Simultaneously, the side string pressure is detected by pressure sensor 92 as a measure of the level of liquid 34 in the production tube 41 as represented at block 210. When the minuscule volume of gas is injected, the pressure at surface in the side string injection line 24 will rise until all of the liquid is expelled from the side string injection tube 40, at which time the pressure in the side string injection line at surface will stabilize. The volume of injected gas can be monitored or can be estimated during this step. The removal of all the influx liquid 33 (with its accompanying unknown level) in the side string tube 40 causes only a gas gradient to be present in the side string tube 40 and thus leads to a more precise liquid level computation in the production tube 41 and therefore the annulus 46. The operator can then use this more precise liquid level detection method to enter a predetermined value representative of the desired liquid level in the well bore. This predetermined value is referenced by the controller 90 at block 212 and subsequently the SSGL injection cycle is automatically initiated for an arbitrary period of time by the controller 90 by opening valve 21 at block 214 when the monitored liquid level as determined by pressure is substantially equal to the predetermined set point in the controller 90 as represented at block 212. As in the method of FIG. 6, a time delay represented at block 216 can be provided to allow the liquid column and/or plunger 82 to reach the surface and also allow the plunger 82 to return under gravity to its position proximal to the side string injection tube 40 inlet to the injection mandrel 80 before commencing another reiterative monitoring of the production tube 41 liquid level 34.

While this method is more accurate than the method of FIG. 6, it is still prone to the same weakness as the first method in that fluctuations in production line 77 or ejection line 74 pressures are not compensated for and it may be necessary for the operator to assume an average production line 77 or ejection line 74 pressure when programming the predetermined set point into the controller 90 to initiate the SSGL 10 injection cycle. Therefore, this method will perform best on wells with substantial rat hole 45 (FIGS. 2 and 3) or with a high annulus 46 and production tube 41 liquid levels where side string injection line 24 pressure will become noticeably elevated due to production tube 41 liquid gradient during the injection of the minuscule quantity of gas into the side string injection line 24.

The third embodiment of the invention is shown most clearly in FIGS. 1, 4, 5 and 8. The pressure sensor 92 senses the side string injection line 24 pressure increase caused by the influx of liquid 34 into the production tube 41 and a pressure sensor 91 fluidly connected to the ejection line 74 senses the pressure of the production tube 41. The pressure sensors 91 and 92 are connected to the controller 90 by wires or through a transmitter to input a signal from the sensors 91 and 92 representative of the pressure in the ejection line 74 and the side string injection line 24. Alternatively, sensors 91 and 92 can be replaced by a single transducer (not shown) that directly measures the difference between the line pressures. While pressure sensor 91 is shown attached to the ejection line 74 it may be attached to the well head or associated plumbing in any position that is equalized is such a way that the sensor 91 can correctly detect the pressure in the production tube 41 at surface. The liquid 32 entering the production tube 41 will rise until the combined head pressure of the liquid 32 and gas 30 in the production tube 41 will be equal to the combined head pressure of the liquid 32 and gas 30 in the annulus 46 at the injection mandrel 80. However, the influx of liquid 33 into the side string tube 40 will only be a portion of the level of the liquid 34 in the production tube 41 because the motor valve 21 is shut and the side string tube 40 is not equalized with the production line 77 or ejection line 74 at the surface. This influx of liquid 33 will cause the pressure of the side string injection line 24 to rise until the combined head pressures of the gas in the side string tube 40 and the liquid in the side string tube 40 are equal to the combined head pressure of the gas and liquid in the production tube 41 at the side string tube 40 attachment port on the mandrel 80. At this point, the difference between the side string injection line 24 pressure at surface and the production tube 41 pressure at surface multiplied by the appropriate liquid gradient pressure factor will give an approximate liquid level 34 in the production tube 41. The reason the liquid level is only approximate is due to the fact that liquid has entered the side string tube 40 to compress the gas in the upper portion of the side string tube 40 which results in two different gradients in the side string tube 40, one for gas and one for influx liquid 33, the level of which is unknown. These pressure measurements are used in this embodiment of the invention by the controller 90 to compute a value representative of the liquid level 34 in the production tube 41. This computed value is then compared to the predetermined set point in the controller 90 to determine when the level of liquid 34 in the production tube 41 reaches the desired level, at which time, the controller 90 will initiate the SSGL artificial lift 10 injection cycle. Thus, the pressure monitoring method of control of the SSGL cycle of this embodiment includes the steps of: one, reiteratively detecting both the side string injection line pressure and the production tube pressure at surface throughout the SSGL non-injection or off cycle as represented in blocks 210 and 234 and generating signals representative thereof; two, calculating a differential pressure between the side string pressure and production tube pressure as represented in block 251 based on the pressure signals, which is approximately representative of the level of liquid in the production tube; three, comparing the calculated differential pressure to a predetermined differential pressure representative of the desired level of liquid in the production tube as represented in block 230 and; four, initiating the SSGL gas injection cycle represented in block 214 when the measured pressure is substantially equal to the predetermined value. As in the first and second embodiments of the invention, a time delay represented in block 216 can be provided.

The improvement of this embodiment over the first two embodiments is that the system now compensates for fluctuations in production line 77 or ejection line 74 (FIG. 4) pressure. In this method, while the exact level of liquid 34 in the production tube 41 is not known, the pressure differential between the pressure in side string injection line 24 (as detected by pressure sensor 92) and the pressure in the ejection line 74 (as detected by pressure sensor 91 ) will represent a liquid head pressure constant, regardless of the fluctuations in production line 77 or ejection line 74 pressure. The difference between the side string injection line 24 pressure detected by pressure sensor 92 and the ejection line 74 pressure detected by pressure sensor 91 is then used by the controller to reiteratively monitor the level 34 of liquid 32 in the production tube 41 as represented by the pressure differential to determine when the liquid level 34 reaches the predetermined and desired level. The controller 90 then initiates the SSGL 10 injection cycle when the detected liquid level reaches the predetermined and desired liquid level (as detected by pressure) regardless of whether the exact production tube 41 liquid level 34 and annular liquid level 31 are known.

Figure 9:
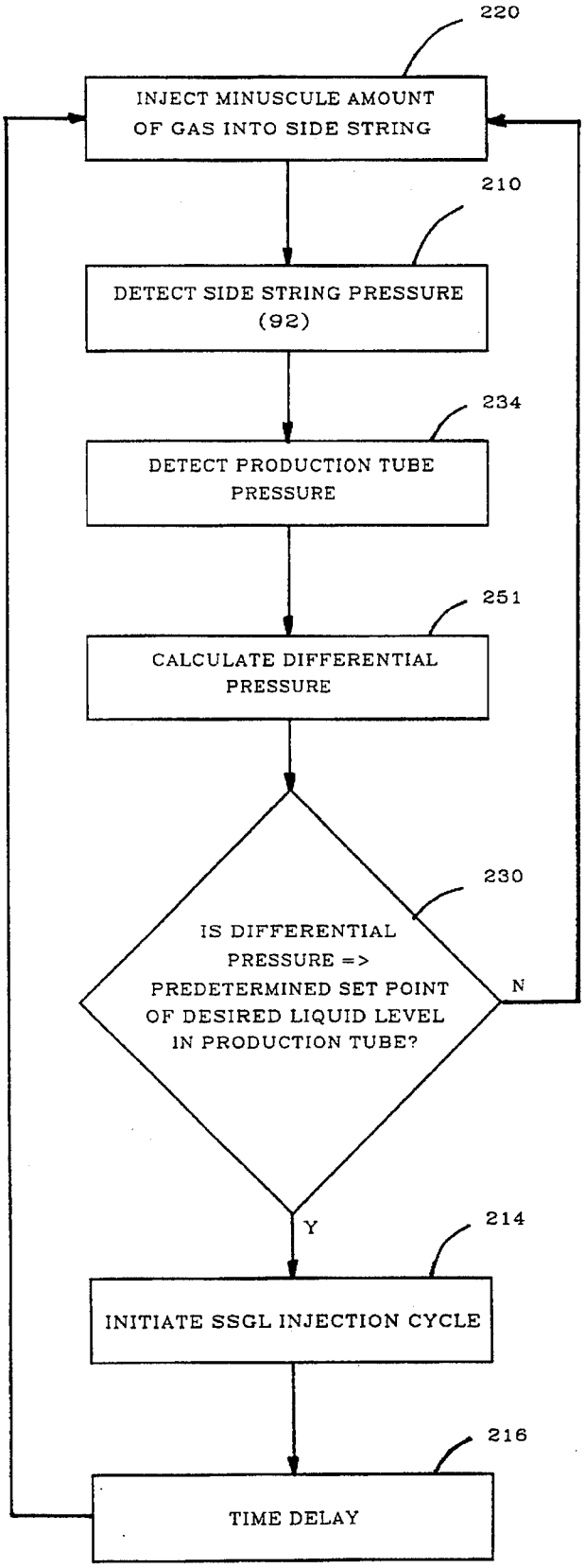
FIG. 9 is a block diagram illustrating still another method according to the invention for controlling a gas injection cycle in an oil or gas well having an SSGL artificial gas lift system.
Figure 10:
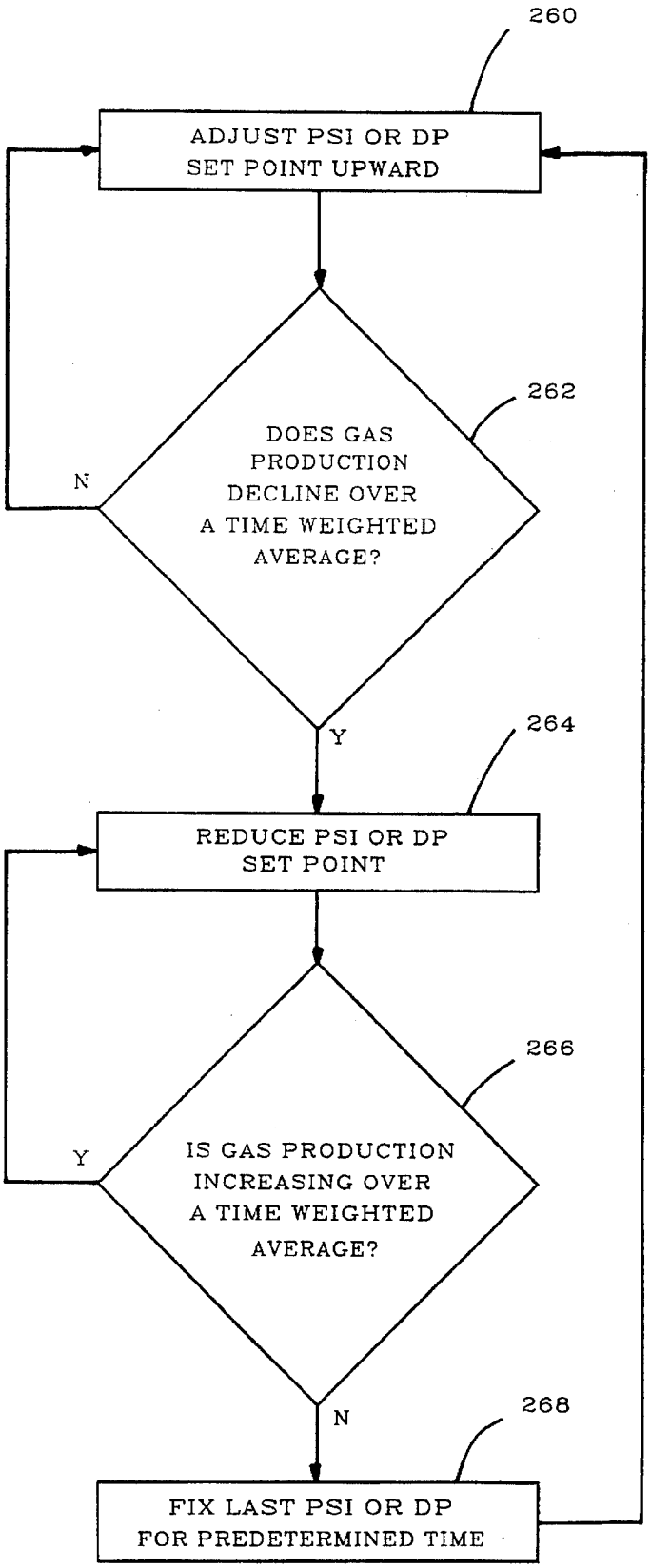
FIG. 10 is a block diagram illustrating a method according to the invention for dynamically adjusting a predetermined artificial lift liquid level set point in an oil or gas well having an artificial lift system.

Referring now to FIG. 9, the fourth embodiment of the invention for control of the SSGL cycle includes the steps of: one, injecting a minuscule volume of gas into the side string as represented in block 220 throughout the SSGL non-injection or off cycle; two, simultaneously detecting the side string pressure by pressure sensor 92 at block 210 and production tube pressure by pressure sensor 91 as represented in block 234 and generating pressure signals representative thereof; three, calculating a differential pressure between the production tube pressure and side string pressure based on the pressure signals as represented in block 251, the differential pressure being representative of the level of liquid in the production tube; four, comparing the measured differential pressure to a predetermined differential pressure representative of the desired level of liquid in the production tube as represented in block 230 and; five, initiating the SSGL gas injection cycle as represented in block 214 when the calculated differential pressure is substantially equal to the predetermined differential pressure value. As in the first three embodiments, a time delay as represented in block 216 is desirably provided.

This embodiment, like the previous embodiment, uses the pressure sensor 92 fluidly connected to the side string injection line 24 to sense the pressure increase caused by the influx of liquid 32 into the production tube 41 and the pressure sensor 91 fluidly connected to the ejection line 74 to sense the pressure of the production tube 41. The improvement over the previous embodiment is the injection of a minuscule volume of injection gas from source 20 through the regulator 23 into the side string injection line 24 to reduce the liquid level 33 in the side string tube 40 down to the level of the side string tube 40 connection on the injection mandrel 80 thereby producing a single gradient pressure in the side string tube 40, i.e., gas only. Thus, the differential pressure calculated will be an accurate representation of the liquid head pressure in the production tube 41. The removal of all the influx liquid column 33 in the side string tube 40 results in only a gas gradient in the side string tube 40. At this point, the difference between the side string injection line pressure 24 at surface and the production tube 41 pressure at surface multiplied by the appropriate liquid gradient pressure factor will give a very precise production tube liquid level 34. The difference between the side string injection line 24 pressure detected by pressure sensor 92 and the ejection line 74 pressure detected by pressure sensor 91 can then be used by the controller 90 to compute the liquid level in the production tube 41 and initiate the SSGL 10 injection cycle when the computed liquid level substantially equals the predetermined and desired liquid level as represented by the predetermined set point in the controller.

Referring now to FIGS. 1, 4, 5 and 10, yet another method according to the invention can be used with any of the four embodiments disclosed above. This fifth embodiment of the invention dynamically sets and resets the predetermined artificial lift initiation set point using values from the side string pressure sensor 92, production tube pressure sensor 91, differential pressure sensor 93 and production line pressure sensor 94. The differential pressure sensor 93 is fluidly connected to a measurement orifice or other industry standard gas measurement device in the production line 77 and the pressure sensor 94 is fluidly connected to the production line 77. The pressure sensor 93 and the pressure sensor 94 are electrically connected to the controller to input to the controller signals representative of the pressures sensed by the pressure sensors 93 and 94. The pressure values from sensors 93 and 94 are used to determine the production gas 30 flow rate from the annulus 46 into the production line 77. According to this embodiment of the invention, the predetermined pressure set point (PSI) for the first two embodiments, or differential pressure set point (DP) as used in the third and fourth embodiments to initiate the SSGL injection cycle, is automatically adjusted upwardly as represented in block 260 by the controller 90 to raise the liquid level 31 in the annulus 46. This adjustment, in effect, increases the liquid level DP or PSI value necessary to initiate the injection cycle of the SSGL artificial lift system 10 and thus results in an increased liquid level 31 in the annulus so that the liquid level in the production tube 41 rises farther before initiating the SSGL injection cycle. As the liquid level rises, there will come a time when the gas production will decline within a specified time weighted average, as represented in block 262. The time weighted average is determined through well known statistical analysis for the amount of production over a specified time period or number of SSGL cycles. At that point, controller 90 automatically begins the reduction of the predetermined PSI or DP value set point at block 264 to reduce the liquid level 31 in the annulus 46 by reducing the liquid level PSI or DP value necessary to initiate the SSGL injection cycle. The well bore response in the form of increased volumetric production is then monitored by the controller 90 as represented in block 266. As the production increases within the specified time and volume parameters, the predetermined set point for the desired liquid level will continue to decrease until no more increase in production volume 266 is determined by controller 90 within the specified time or cycle parameters. At this stable production period, the PSI or DP values in the controller 90 enter a dormant or nonadjustment state at block 268 for an arbitrary period before the controller 90 will initiate another change to the predetermined set point.

In this dynamic and interactive method, maximum production down the production line 77 is balanced with optimum liquid level 31 in the annulus 46 to best automatically economize the volume of injection gas from source 20 necessary to sustain production. At the end of the specified non-management period, the liquid level management procedure described above will be repeated until the next dormant period. It is to be understood that the automated liquid level management method will be done with adjustments taking place over the course of many hours and possibly days, the end result being the maximum liquid level sustainable within a given well bore with minimal interference with production and a reduced need of injection gas.

Figure 11:
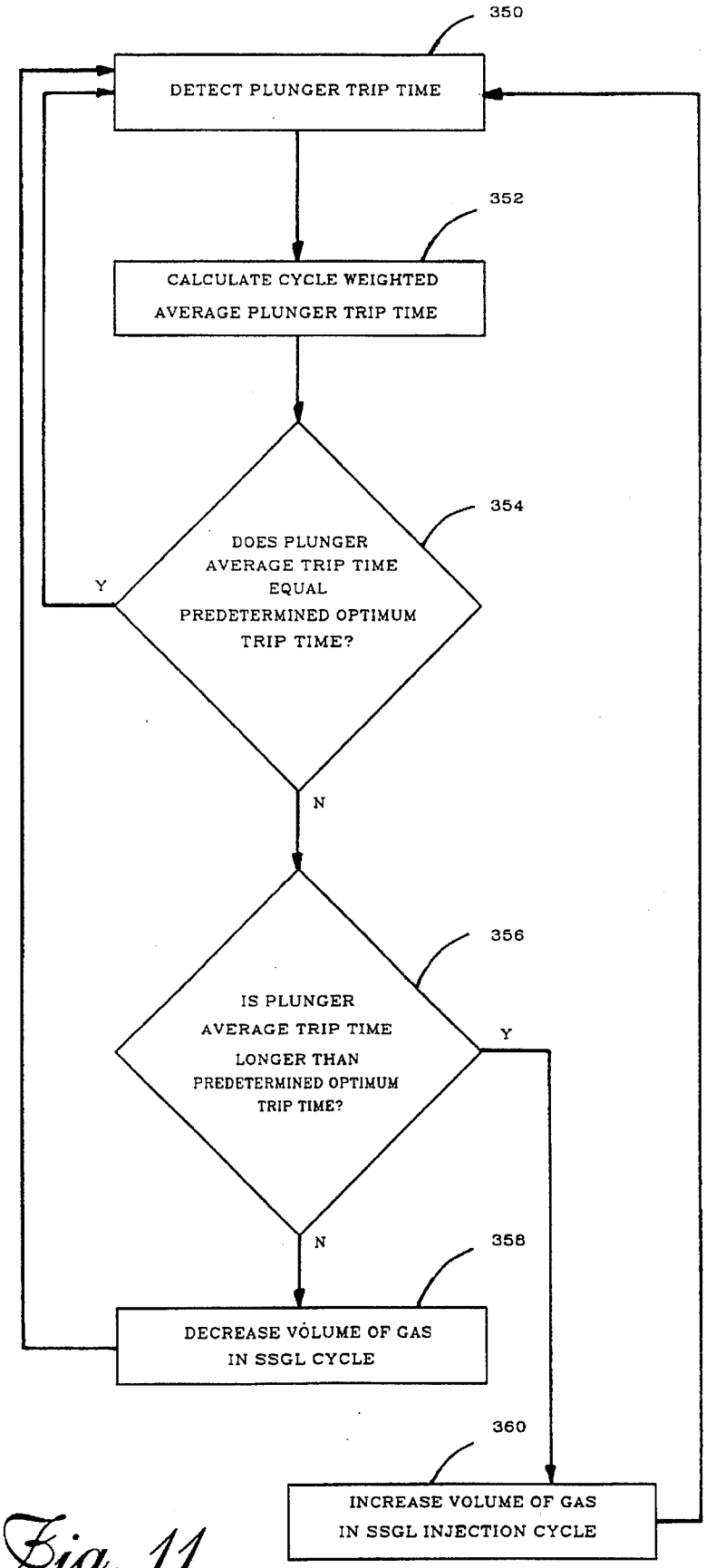
FIG. 11 is a block diagram illustrating a method according to the invention for dynamically controlling the necessary volume of gas injected during a gas injection cycle in an oil or gas well having an SSGL artificial gas lift system.

A sixth embodiment of the invention will now be described with reference to FIGS. 1 and 11. A magnetic sensor (MSO) 95 is attached to the production tube 41 or lubricator 62 to detect the arrival of the plunger 82 at surface subsequent to the injection of a blast of injection gas from source 20 down the side string tube 40 during the injection cycle of the SSGL artificial lift system 10 to control the ejection of the liquid 32 in the production tube 41 into the ejection line 74. The magnetic sensor 95 is electrically connected to the controller 90 to input to the controller a signal representative of the magnetic flux sensed by the magnetic sensor 95. The plunger 82 travel time from the initiation of the SSGL injection cycle to surface is calculated by the controller 90 and used by the controller 90 to adjust the SSGL artificial lift system 10 injection gas volumes from source 20 to accommodate a varying liquid level 34 in the production tube 41, thereby controlling the average velocity of the plunger 82 in the production tube 41 and the impact of the plunger into the lubricator 62 as the liquid 32 in the production tube 41 is being ejected into the ejection line 74. The magnetic sensor detects the arrival of the plunger as represented in block 350 and transmits a signal representative of the plunger arrival to the controller 90. The controller 90 in turn calculates the trip time for the plunger 82 and compares the detected plunger trip time over a time weighted average (which is determined through well known statistical methods for a number of detected plunger trip times over a predetermined number of cycles) with a predetermined plunger trip time set point and adjusts the volume of gas injected during the subsequent SSGL injection cycles so that the detected trip time matches the predetermined trip time set point. For example, if the calculated average trip time of the plunger at block 352 does not equal the predetermined set point as represented in block 354 and is longer than the predetermined set point as represented in block 356, the gas volume in the subsequent SSGL injection cycles is increased as represented in block 360. If the detected plunger trip time is less than the predetermined trip time set point represented at block 356, the gas volume during the subsequent SSGL injection cycles is decreased as represented in block 358. The predetermined plunger trip time set point is determined by dividing the distance between the bottom of the production tube and the surface of the ground by the desired average rate of travel for the plunger 82 from the bottom of the production tube 41 to the surface. This value is then used by the controller 90 to adjust the SSGL artificial lift system 10 injection cycle so as to either increase or decrease the plunger 82 trip time to allow the plunger 82 reach the sensor 95 at the desired time. The sensor 95 can be any suitable magnetic sensor which measures a change in magnetic flux. An example of a suitable sensor is an Omni sensor manufactured by OKC Products Company. This method and apparatus of this embodiment can be used with any of the five embodiments discussed above.

Figure 2:
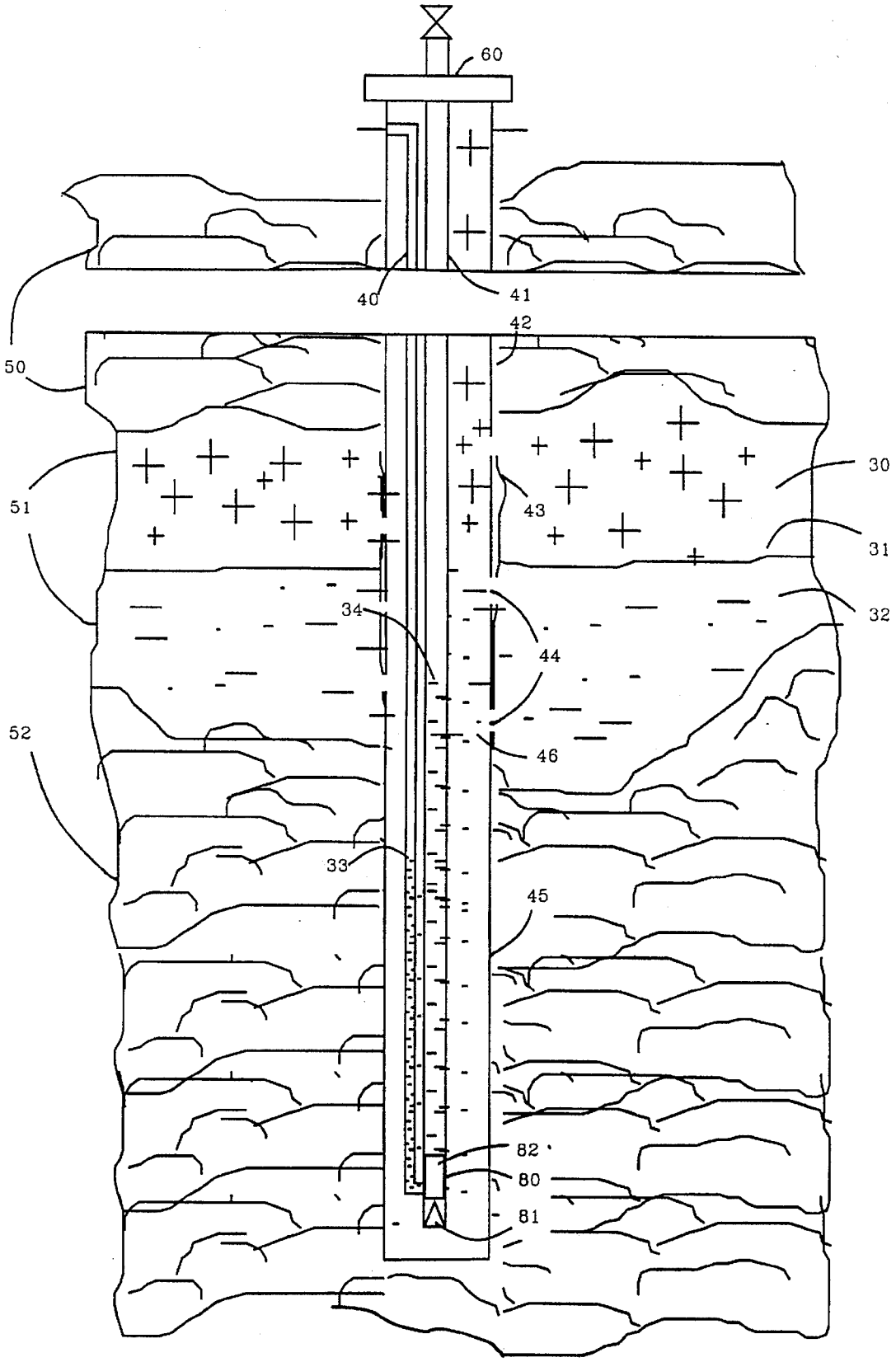
FIG. 2 is a schematic cross sectional view of an alternate bore hole which can be used with an SSGL artificial lift system according to the invention.
Figure 3:
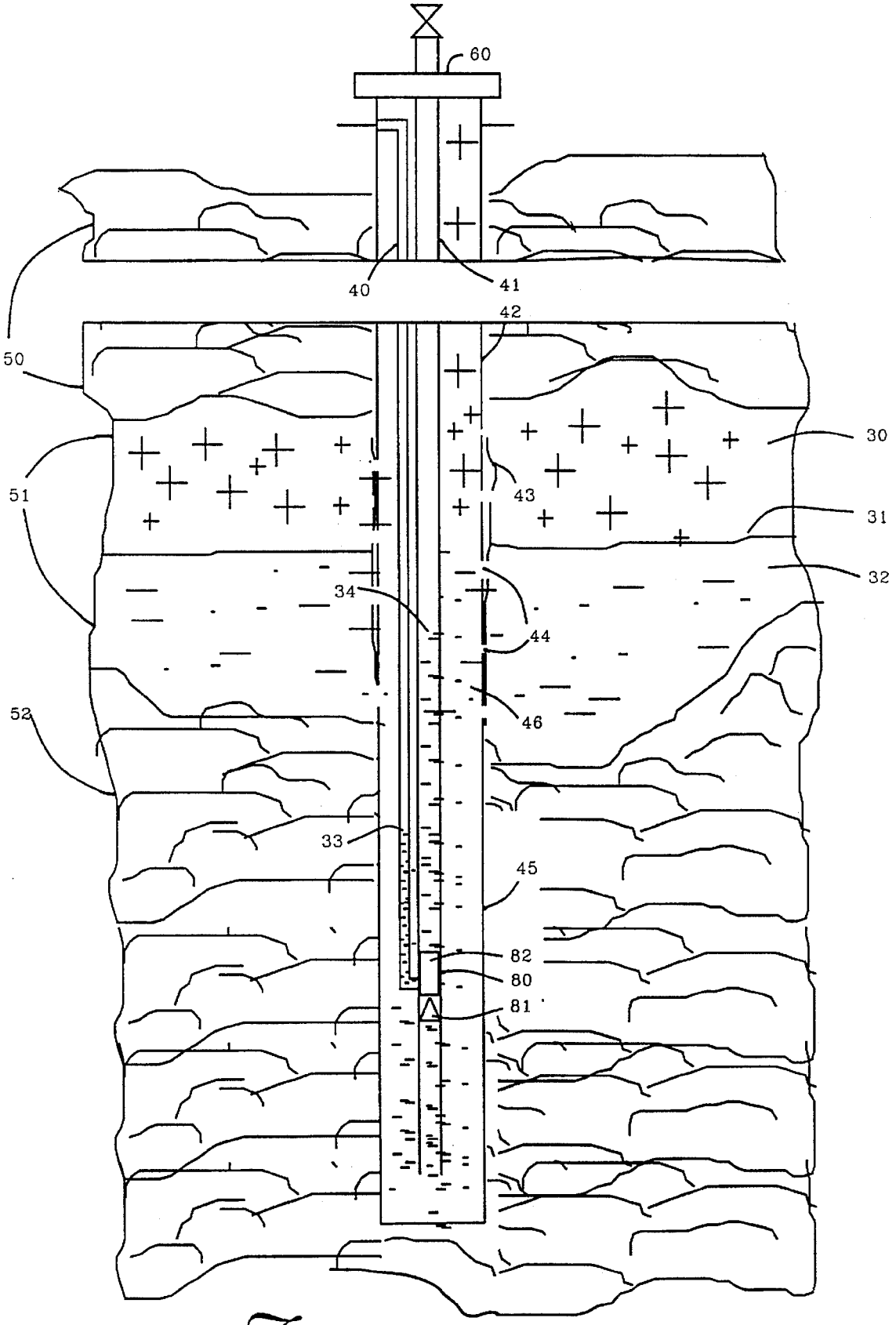
FIG. 3 is a schematic cross sectional view of an alternate bore hole which can be used with an SSGL artificial lift system according to the invention.
Figure 4:
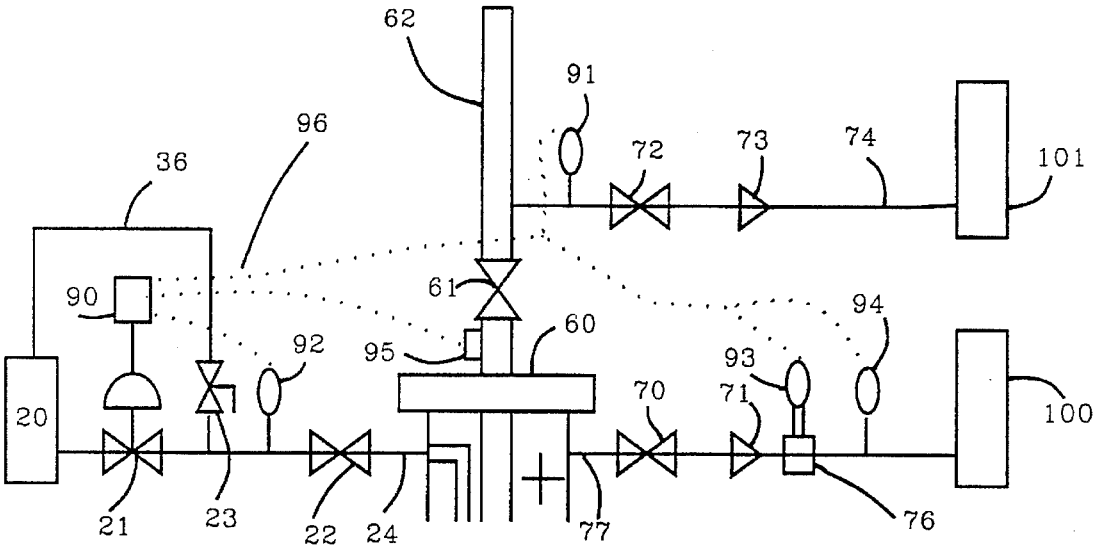
FIG. 4 is a schematic representation of an alternate well head assembly which can be used with an SSGL artificial lift system incorporating a control system according to the invention.
Figure 5:
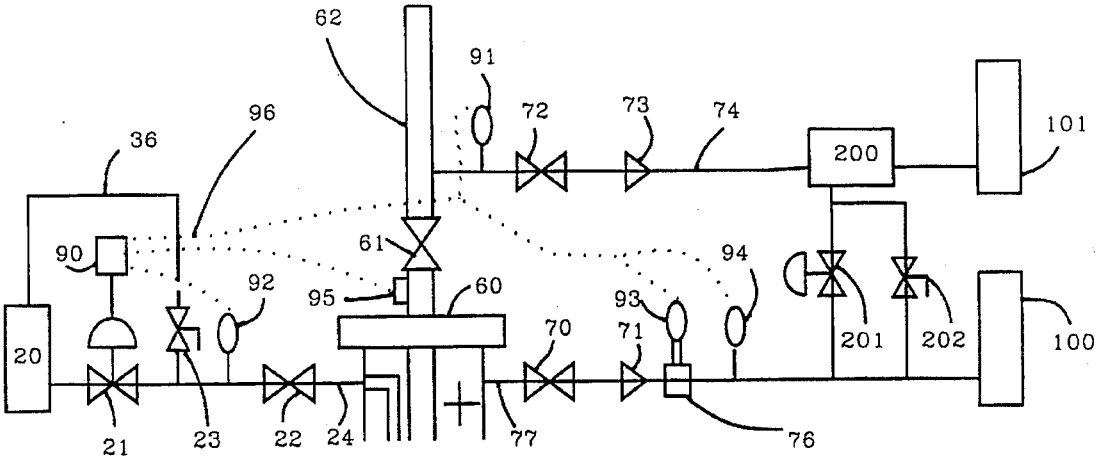
FIG. 5 is a schematic representation of a second alternate well head assembly which can be used with an SSGL artificial lift system incorporating a control system according to the invention.
Figure 12:
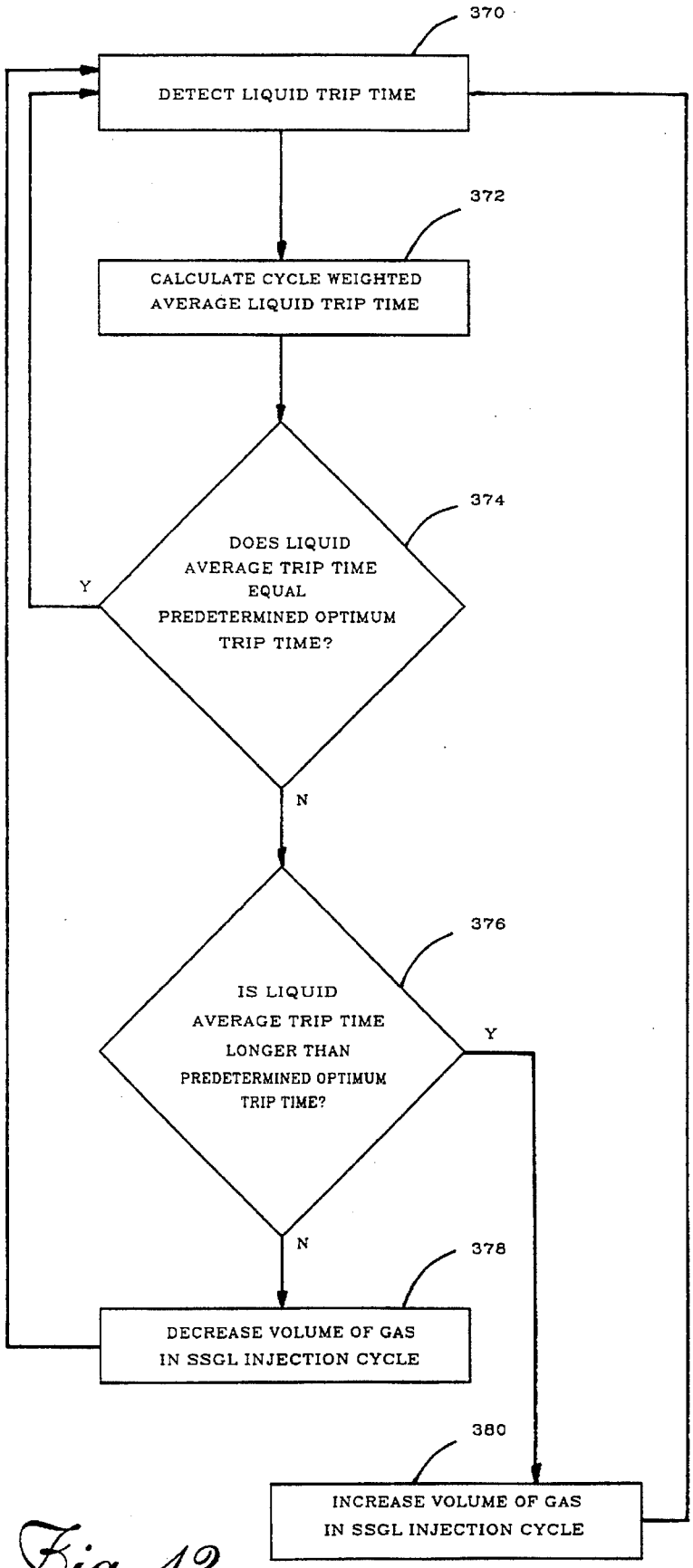
FIG. 12 is a block diagram illustrating another method according to the invention for dynamically controlling the necessary volume of gas injected during a gas injection cycle in an oil or gas well having an SSGL artificial gas lift system.
Figure 13:
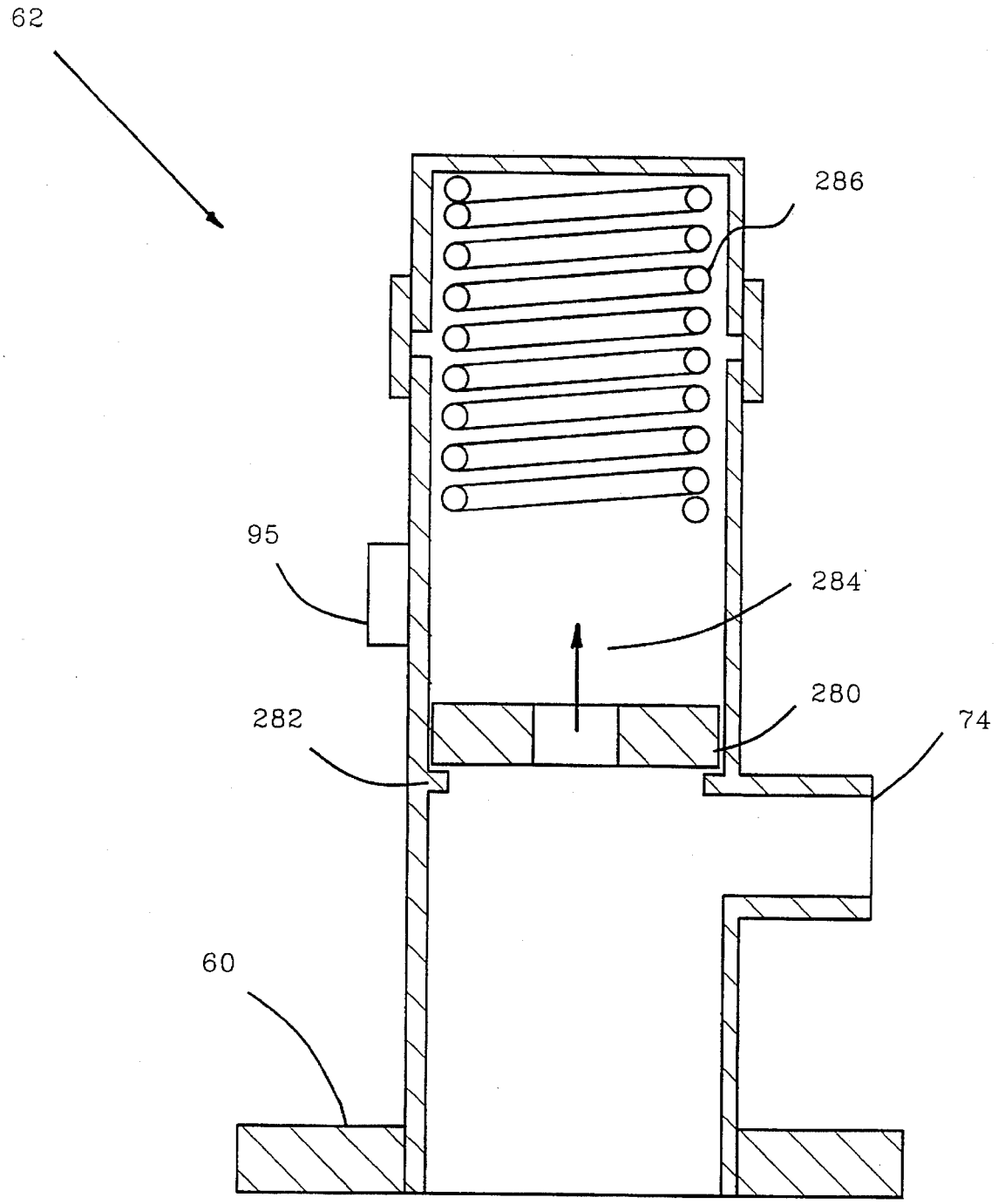
FIG. 13 is an enlarged cross sectional view of a modified lubricator for detecting liquid arrival according to the invention.

Referring now to FIG. 12 and 13, an alternate arrangement for use with the sixth embodiment is shown. Although the system as illustrated in FIGS. 1–3 show a plunger 82 for removing liquid from the production tube, it is not always necessary nor desirable to use a plunger. Plungers are most commonly used in production tubes with little or no rat hole and relatively short liquid columns to be ejected from the production tube. The use of a plunger in this instance significantly reduces the percentage of liquid loss. However, in production tubes having rat holes and large columns of liquid, gas can be injected directly into the production tube without a plunger from the side string without a significant percentage of liquid loss. Common production tubes may contain as much or even more than 150 feet of liquid. In the event that a plunger is not used, it is still desirable to adjust the volume of gas injected into the side string to control the average liquid ejection velocity in the most efficient manner. For this purpose, a donut-shaped lubricator plunger 280, preferably constructed of ferromagnetic material, is supported on a flange 282 within lubricator 62 or production tube 41. A magnetic sensor (MSO) 95 is attached to the lubricator 62 or production tube 41 to detect movement of the lubricator plunger 280. When gas is injected from source 20 down the side string tube 40 during the injection cycle of the SSGL artificial lift system 10 to eject the column of liquid 32 from the production tube 41 into the ejection line 74, an upper portion of the liquid column will contact the lubricator plunger 280 when it arrives at surface. The force of the liquid displacing upward will move the lubricator plunger 280 in the direction of arrow 284 until lubricator plunger 280 contacts compression spring 286 and trips MSO 95. Thereafter, the lubricator plunger 280 will fall under gravity and rest on flange 282 until the next SSGL injection cycle. The signal from MSO 95 is transmitted to the controller 90 and can be manipulated in the same way as the method of the sixth embodiment for adjusting the SSGL injection cycle.

In embodiments one through six, the injection of gas from the source 20 through the injection valve 21 and down the side string tube 40 is commonly described as a blast of gas which infers that the injection valve 21 is fully open from the source 20 to the side string tube 40. However, under certain conditions such as a well having a deep rat hole, as shown in FIGS. 2 and 3, or in a well that may have a high bottom hole or head pressure in the formation 51, it may be desirable to inject a sustained and controlled flow of gas from the source 20 through the injection valve 21 and side string tube 40 and into the production tube 41 to the surface. To this end, the controller 90 may be operably adapted to position the injection valve 21 in a partially open position to constantly inject gas from the source 20 through the side string tube 40 to constantly lift liquid 32 to the surface. The injection valve 21 may be adjusted to a more open or restricted position to maintain the side string tube 40 pressure or differential pressure within the desired parameters according to any of the pressure monitoring methods previously described. This sustained and controlled flow of gas is to be differentiated from the relatively small or minuscule volume of gas injected into the side string tube 40 for clearing any liquid from the side string tube. The minuscule volume of gas is insufficient to raise the liquid in the production tube to the surface.

Figure 19:
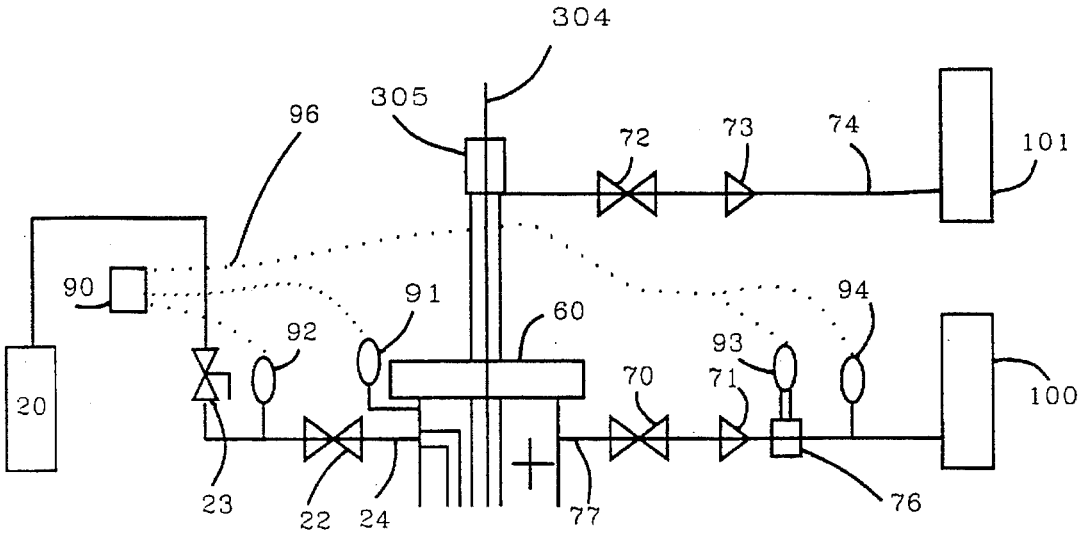
FIG. 19 is a schematic representation of an alternate well head assembly which can be used with a beam pump or progressive cavity pump artificial lift system incorporating a control system according to the invention.
Figure 15:
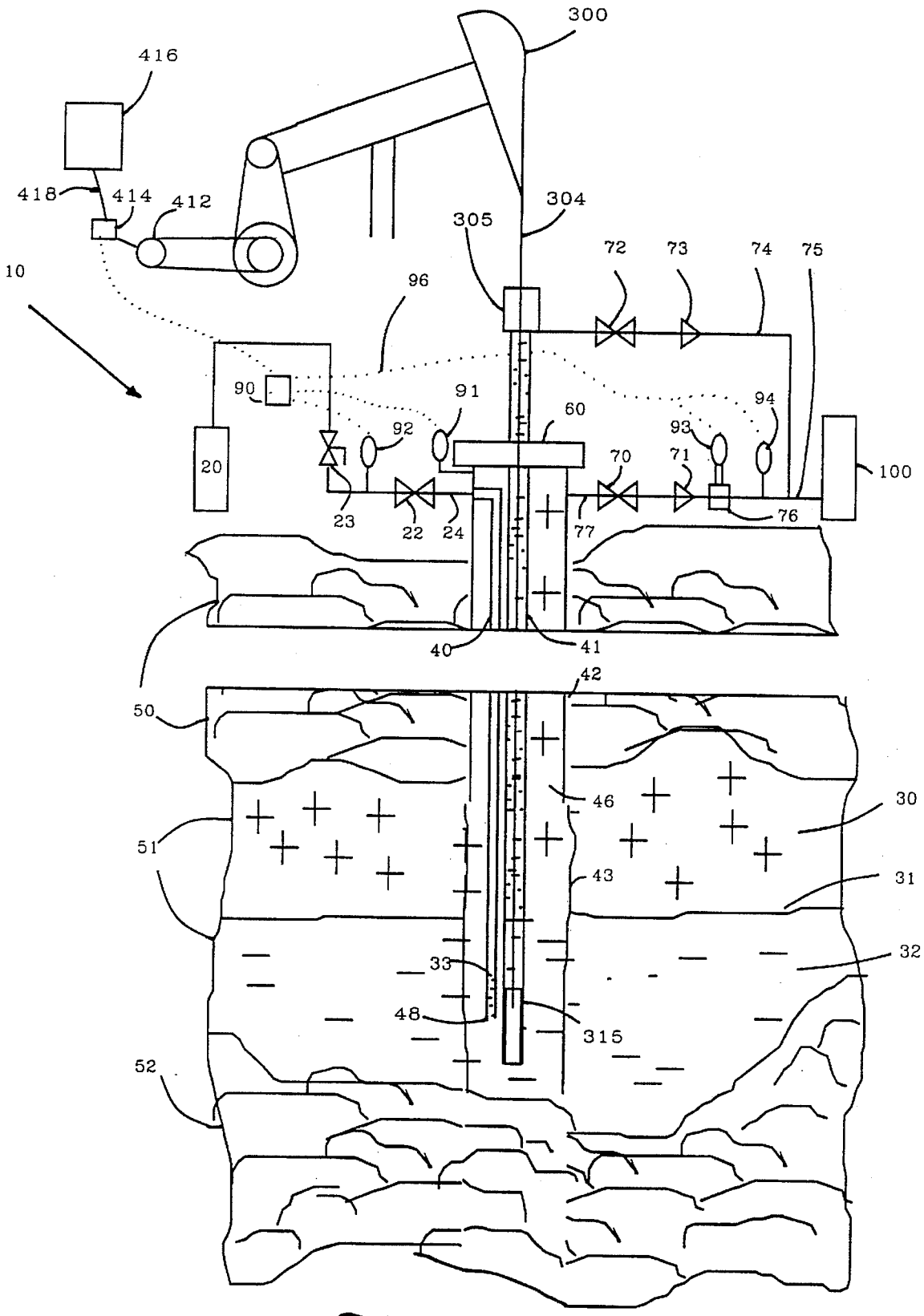
FIG. 15 is a schematic cross sectional view of a beam pump artificial lift system and bore hole with a control system according to the invention.
Figure 16:
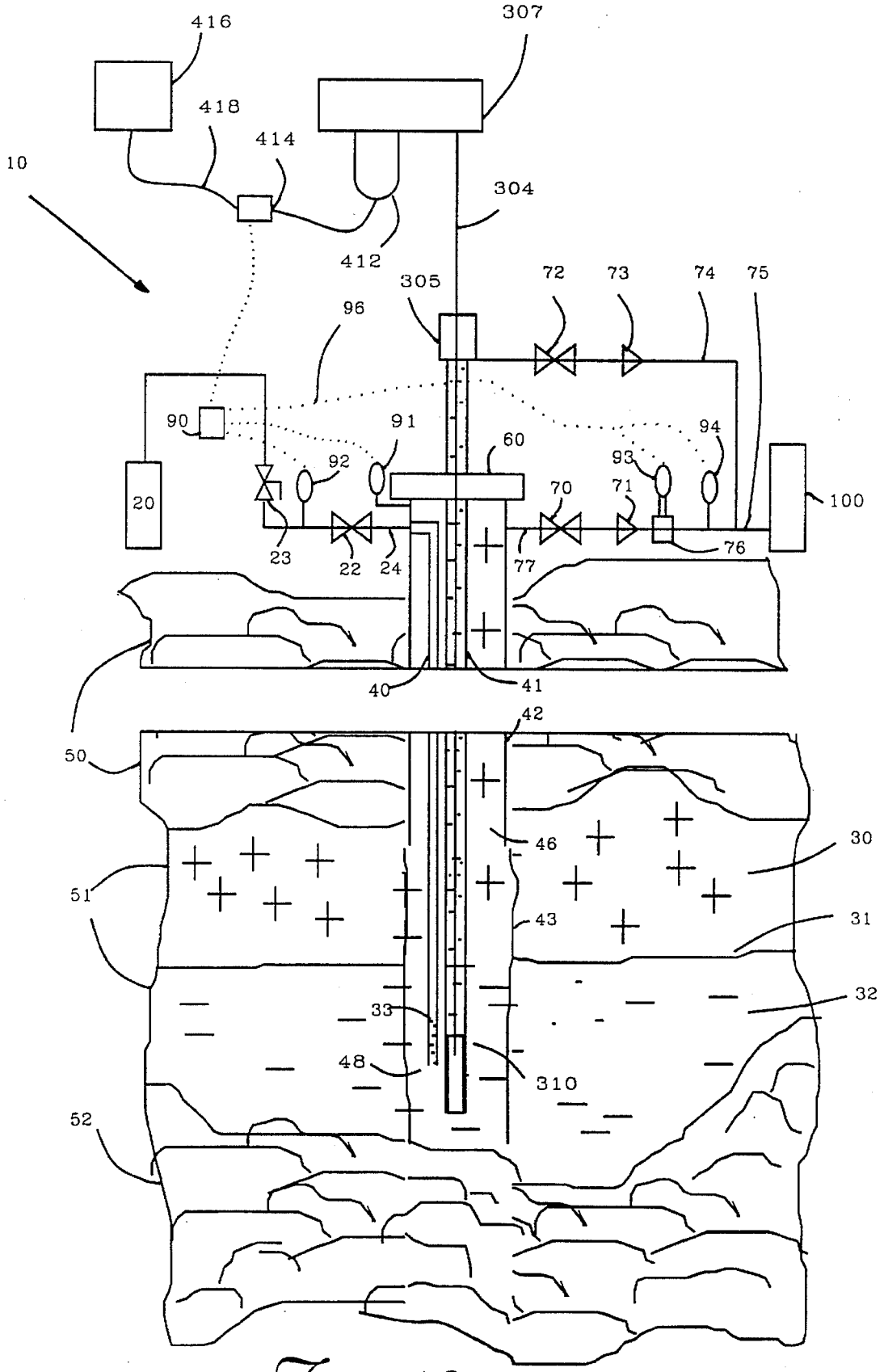
FIG. 16 is a schematic cross sectional view of a progressive cavity pump artificial lift system and bore hole with a control system according to the invention.
Figure 20:
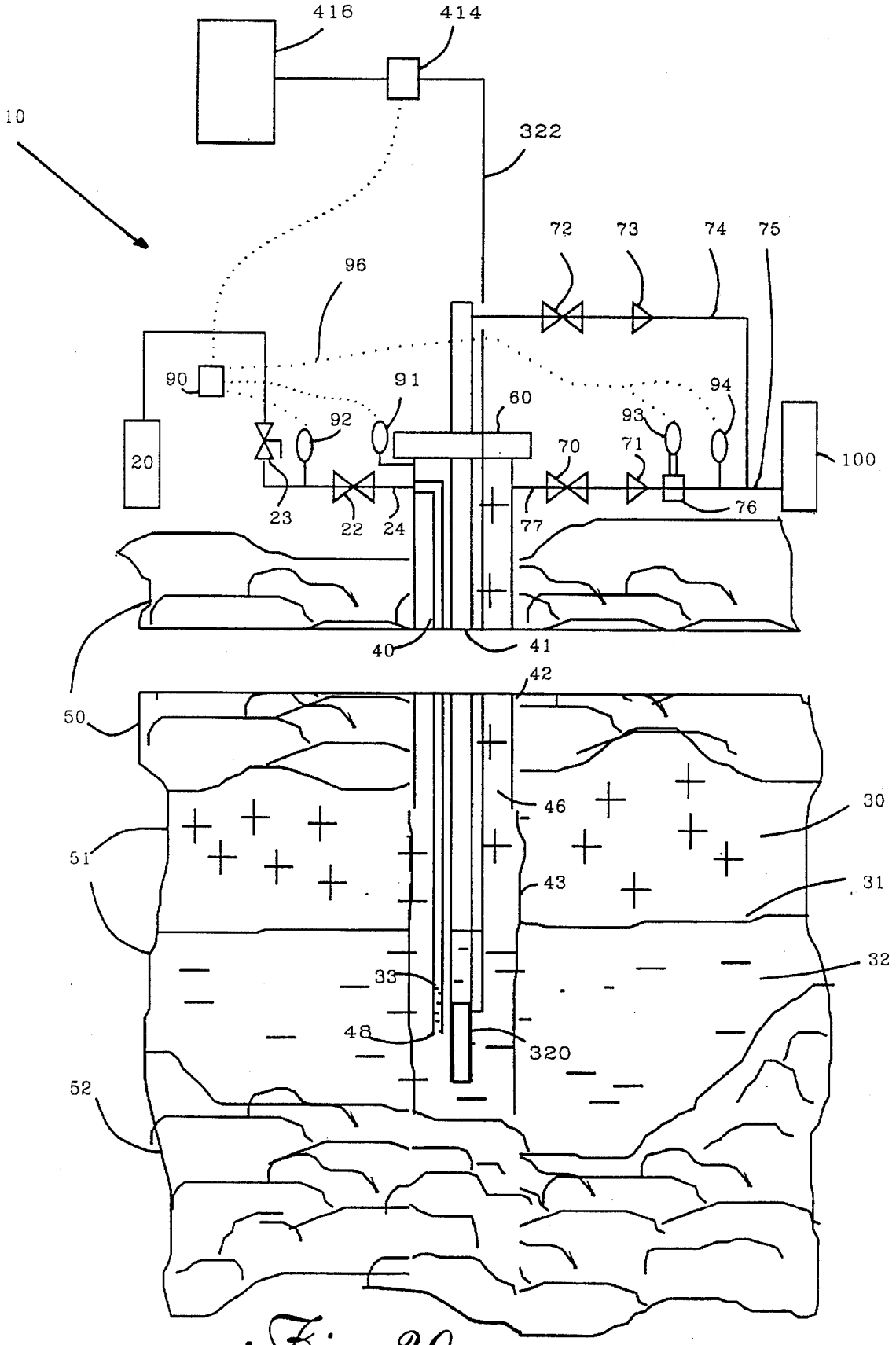
FIG. 20 is a schematic cross sectional view of a submersible pump artificial lift system and bore hole with a control system according to the invention.

In part 2, as shown in FIGS. 15 and 16, bore holes using a beam pump 300 and a progressive cavity pump 307 are employed for raising the liquid 32 in the production tube 41 to the surface of the ground. FIG. 20 shows a submersible pump system for raising the liquid 32 in the production tube 41 to the surface of the ground. While each of these pump artificial lift systems 10 incorporate the side string tube 40 method of liquid level 31 detection, they vary from the SSGL method of artificial lift in that the side string tube 40 termination point 48 is in the annulus 46 because in these lift systems the production tube 41 will be completely full of liquid 32 to surface when the artificial lift system 10 is in operation. Therefore, the side string tube 40 termination point 48 is in the annulus 46 to detect the level of liquid 31 in the bore hole to provide for control of the artificial lift system 10. Also, while the termination point 48 of the side string tube 40 is demonstrated as being substantially equal with the position of the pumps 310, 315 and 320 (FIGS. 15, 16 and 20) in the well bore it is to be understood that the termination point 48 of the side string tube 40 may be lower or higher than the pump as long as the side string tube 40 termination point 48 is below the lowest point in the well bore that the operator desires to control liquid level 31. Further, in FIGS. 15, 16, 19, 20 and 23 pressure sensor and transmitter 91 is illustrated as being fluidly attached to the annulus to detect the differential pressure between the side string tube 40 and the annulus 46 to detect the liquid level in the bore hole 43. Alternatively, pressure sensor 94 could serve the dual purpose of production line pressure 77 and annulus 46 pressure detection because the annulus 46 and the production line 77 are substantially equalized or alternatively, sensors 91 and 92 can be replaced by a single transducer (not shown) that directly measures the difference between the line pressures.. Thus, the invention can be used to control the operation of a beam pump 300, a progressive cavity pump 307 and a submersible pump 320.

Figure 17:
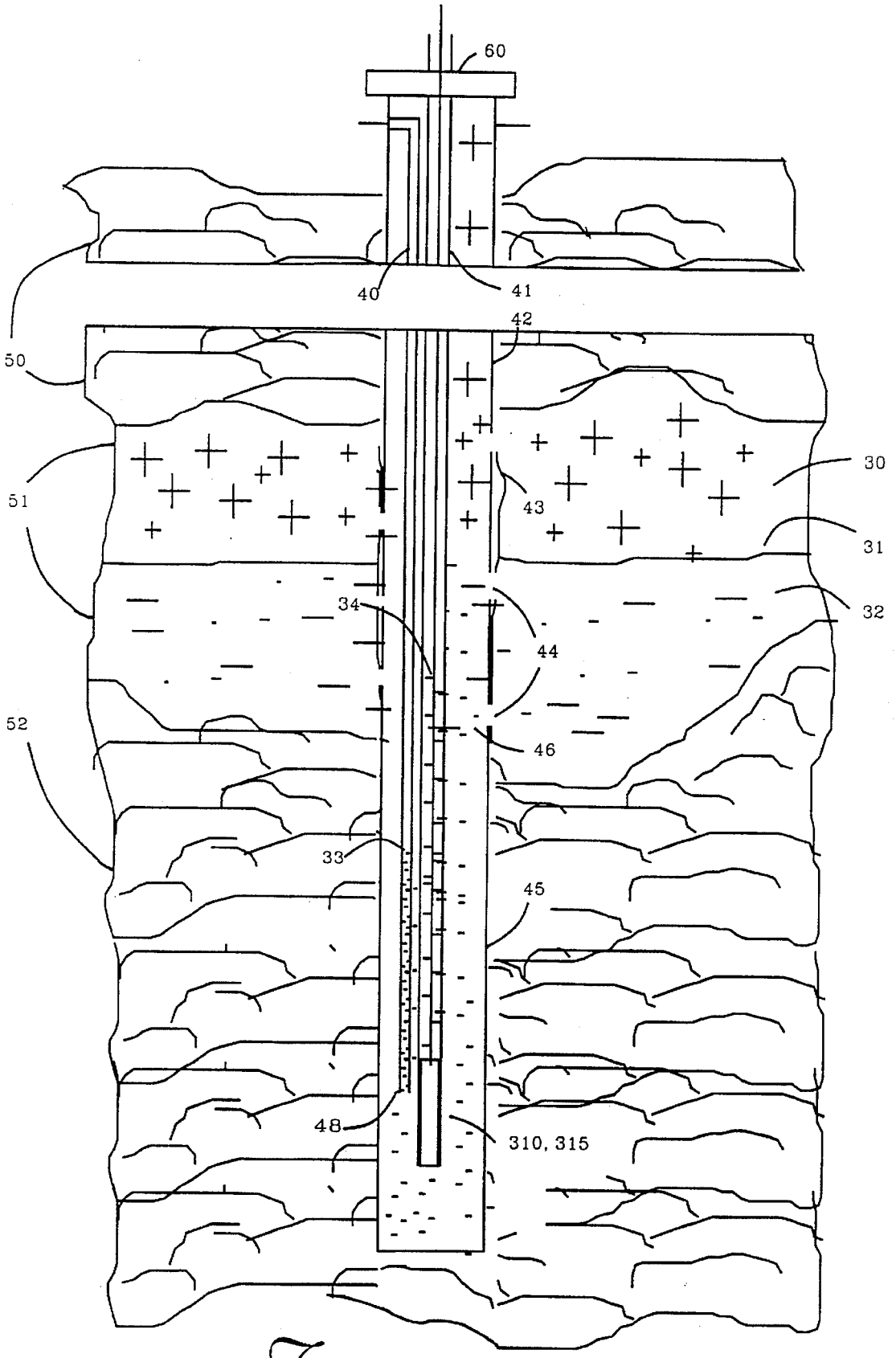
FIG. 17 is a schematic cross sectional view of an alternate bore hole which can be used with a beam pump or progressive cavity pump artificial lift system according to the invention.
Figure 18:
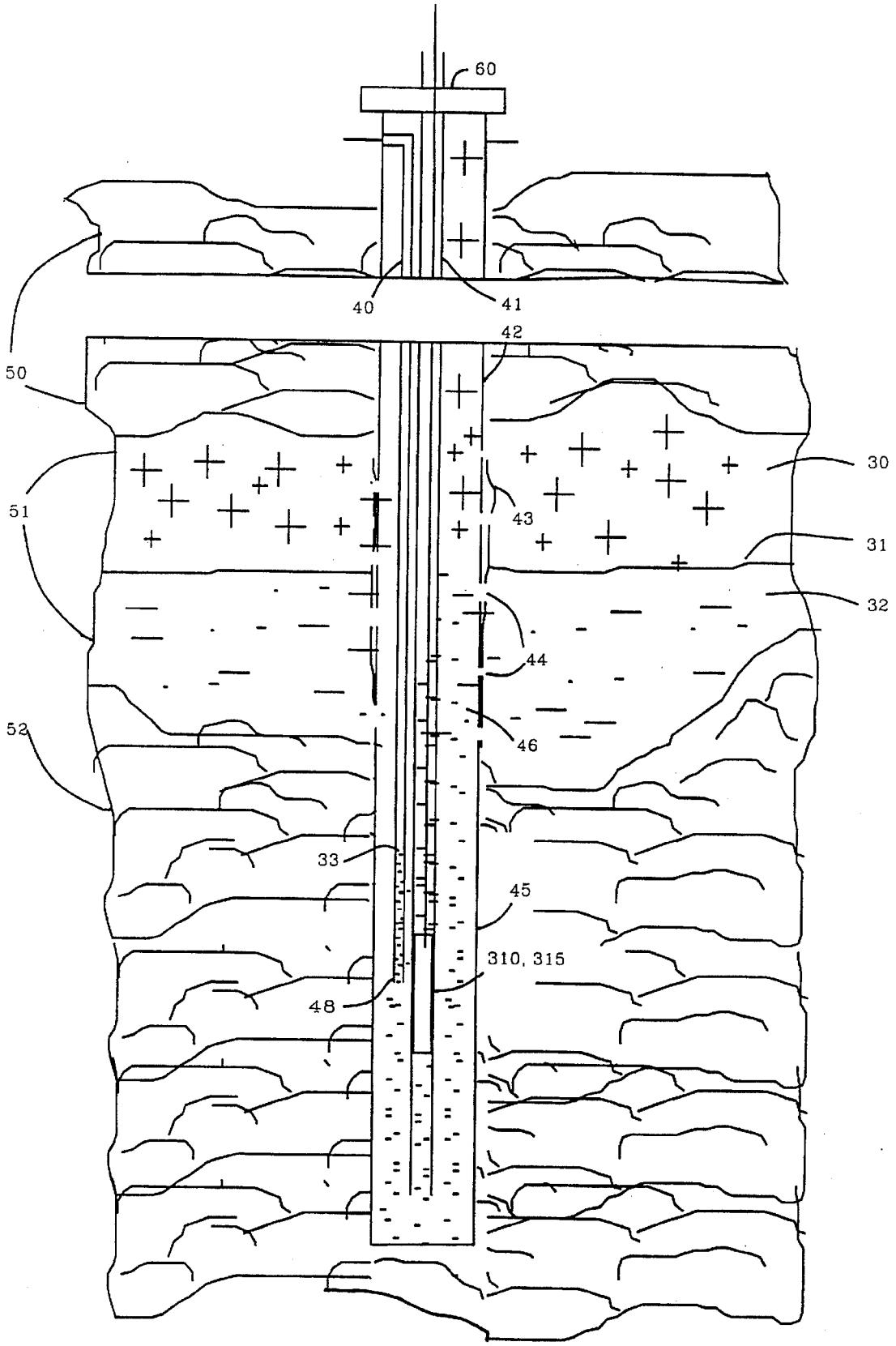
FIG. 18 is a schematic cross sectional view of an alternate bore hole which can be used with a beam pump or progressive cavity pump artificial lift system according to the invention.

Referring to FIGS. 15 and 16, sucker rod 304 is connected to the pumps 315 or 310 at a lower portion of the production tube 41 and to a beam pump head 300 or progressive cavity (PC) pump head 307 at an upper portion to drive the pump in a conventional manner. The barrel pump 315 or PC pump stator 310 is positioned at the lower portion of the well bore and is adapted to pump liquid 32 from the bottom of the bore hole to the surface of the ground. A side string tube 40 extends down along the outside of the production tube 41 in the annulus 46 and is open at a bottom portion thereof to be fluidly connected with and terminated in the annulus 46. Electric or hydraulic lines 418 are connected to the prime mover 412 to drive the beam pump 300 or PC pump head 307 to operate the pumps 315 or 310 respectively. The prime mover 412 is connected to a controller 414 which is connected to the controller 90 and controller 90 is use to control controller 414 to maintain the level of liquid 31 in the bore hole above a predetermined minimum and preferable also below a predetermined maximum as measured by any of the pressure measurement techniques disclosed herein. FIGS. 17, 18 and 19 are alternate well bore and well head configurations that can be used with the beam pump 300 or PC pump 307 artificial lift systems.

Figure 23:
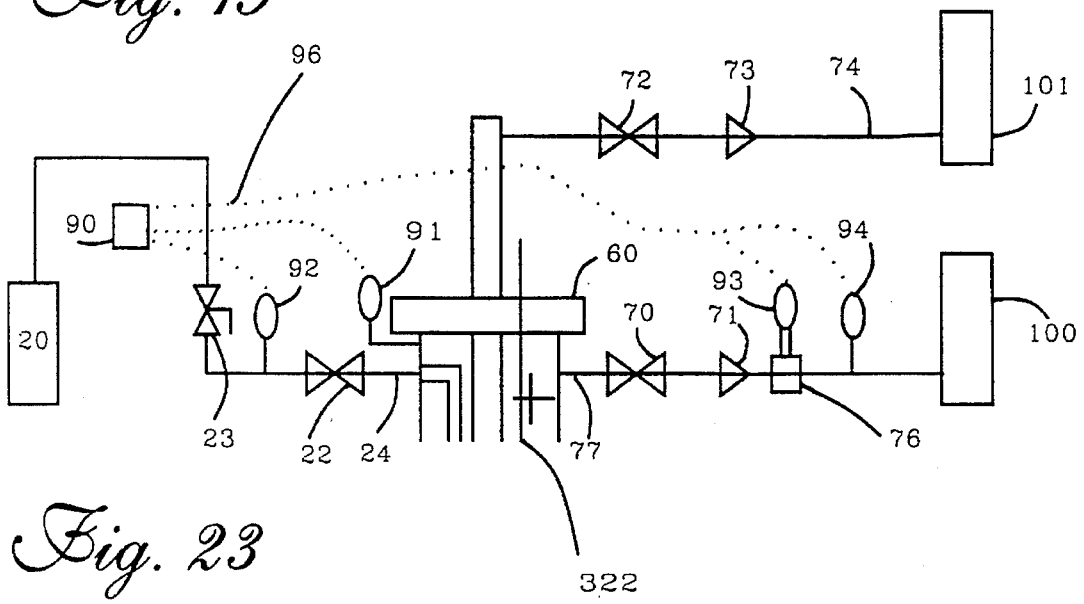
FIG. 23 is a schematic representation of an alternate well head assembly which can be used with a submersible pump artificial lift system incorporating a control system according to the invention.
Figure 21:
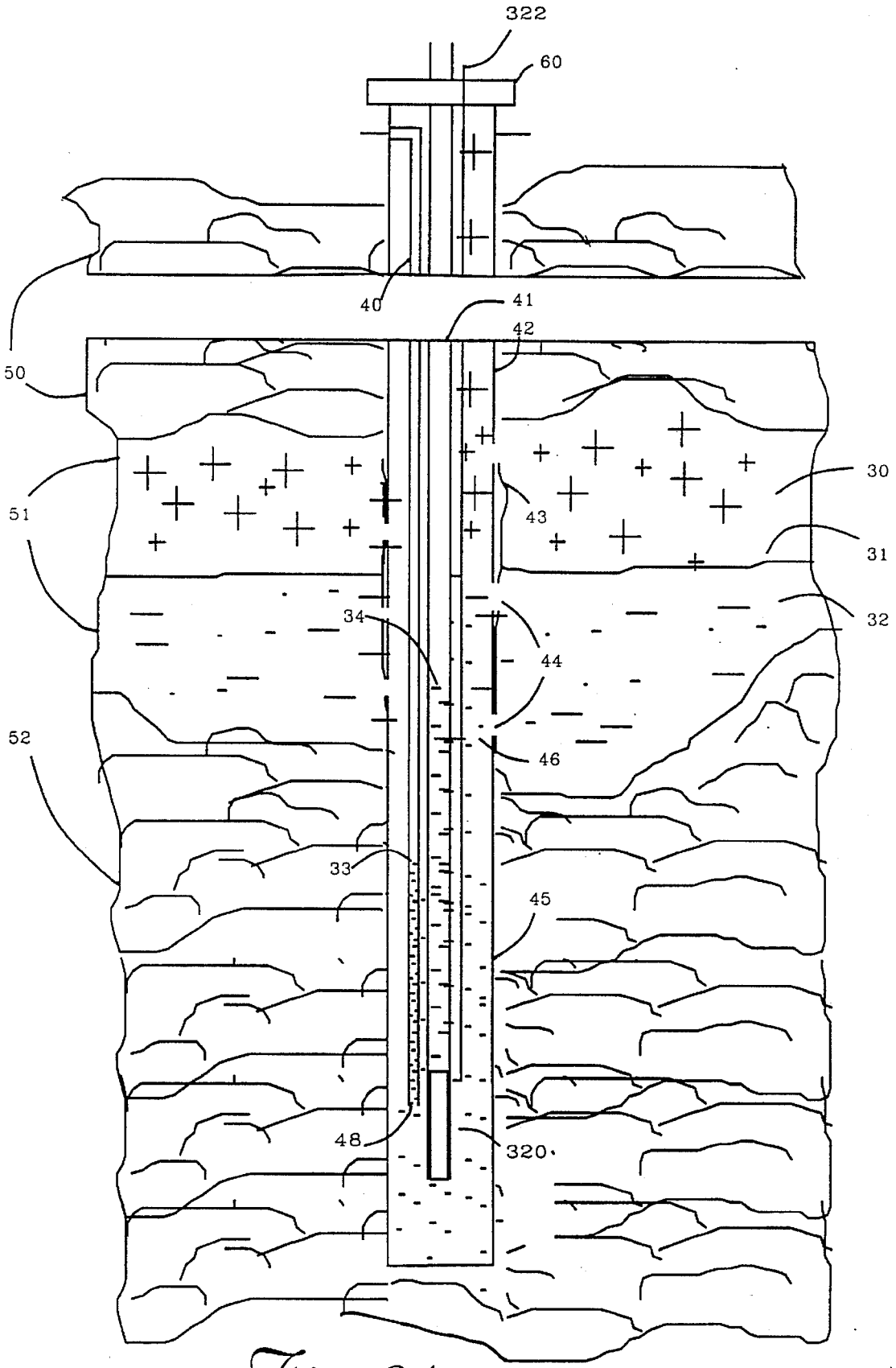
FIG. 21 is a schematic cross sectional view of an alternate bore hole which can be used with a submersible pump artificial lift system according to the invention.
Figure 22:
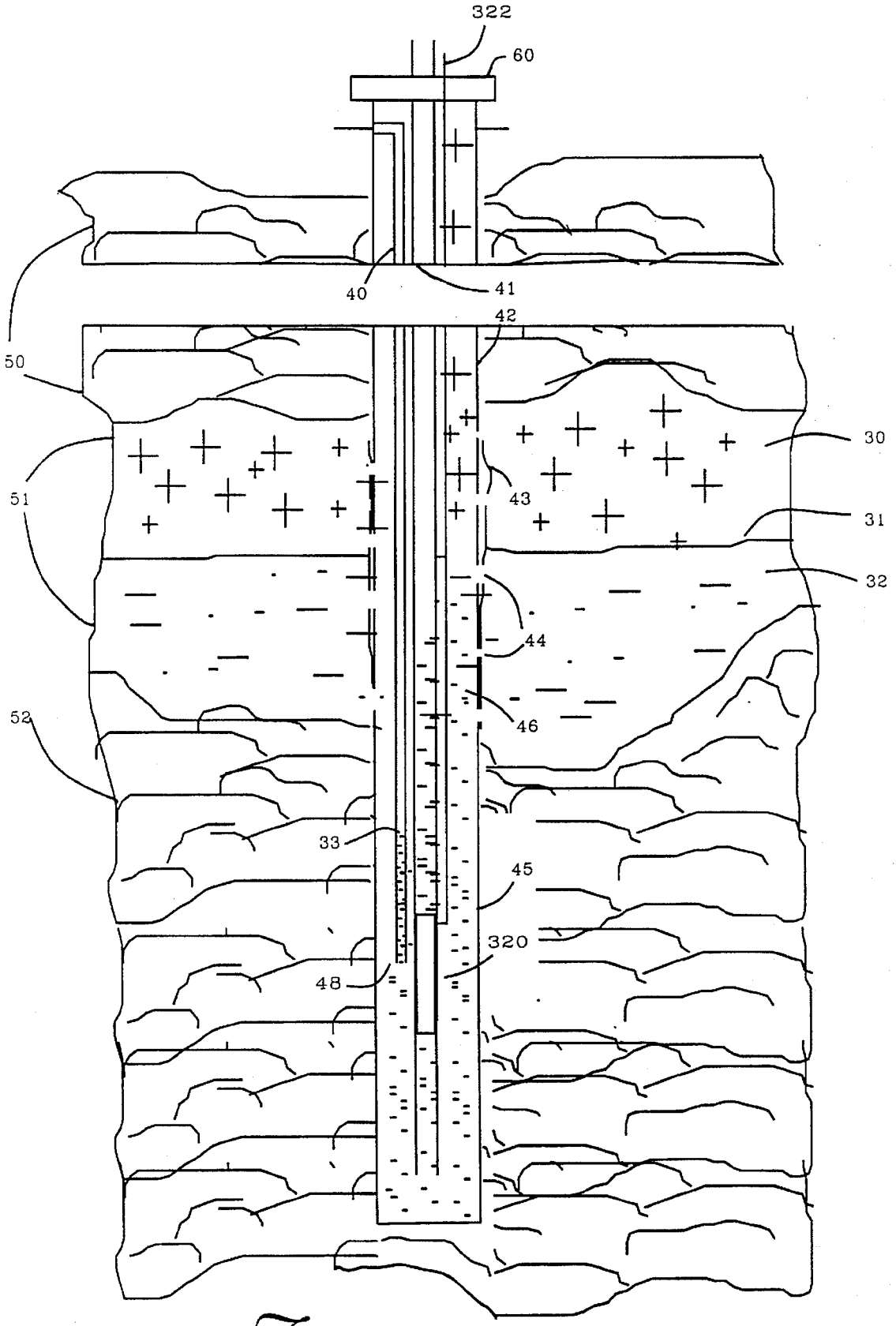
FIG. 22 is a schematic cross sectional view of an alternate bore hole which can be used with a submersible pump artificial lift system according to the invention.

Referring to the submersible pump artificial lift system 10 in FIG. 20 the submersible pump 320 is located at the lower portion of the production tube 41. In this arrangement the submersible pump 320 is attached to the production tube 41 and an electrical cord 322 passes through the well head 60 and is operably attached to the submersible pump 320 to lift the liquid 32 from the bottom of the bore hole to the surface of the ground and a side string tube 40 has a termination point 48 in the annulus 46 to allow for the detection of liquid level 31 in the annulus 46. A prime mover control 414 is connected to the electrical cord 322 and to the controller 90 to allow controller 90 to control the submersible pump 320 to maintain the liquid level 31 in the bore hole above a predetermined minimum and preferable also below a predetermined maximum as measured by any of the pressure measurement techniques disclosed herein. FIGS. 21, 22 and 23 are alternate bore hole and wellhead assemblies that can be used with the submersible pump artificial lift system 10.

In the embodiments of the invention as applied to the beam pump 300, progressive cavity pump 307 and the submersible pump 320 artificial lift systems 10, the pressure sensor and transmitter 91 is operably connected to the well casing 42 to detect the pressure in the annulus 46 and the side string tube 40 termination point 48 is in the annulus to allow for detection of the liquid level 31 in the well bore. The embodiments that will now be described can be used with, but are not limited to, the pump systems herein disclosed. Like numerals in the previous embodiments have been used to described like parts.

Figure 24:
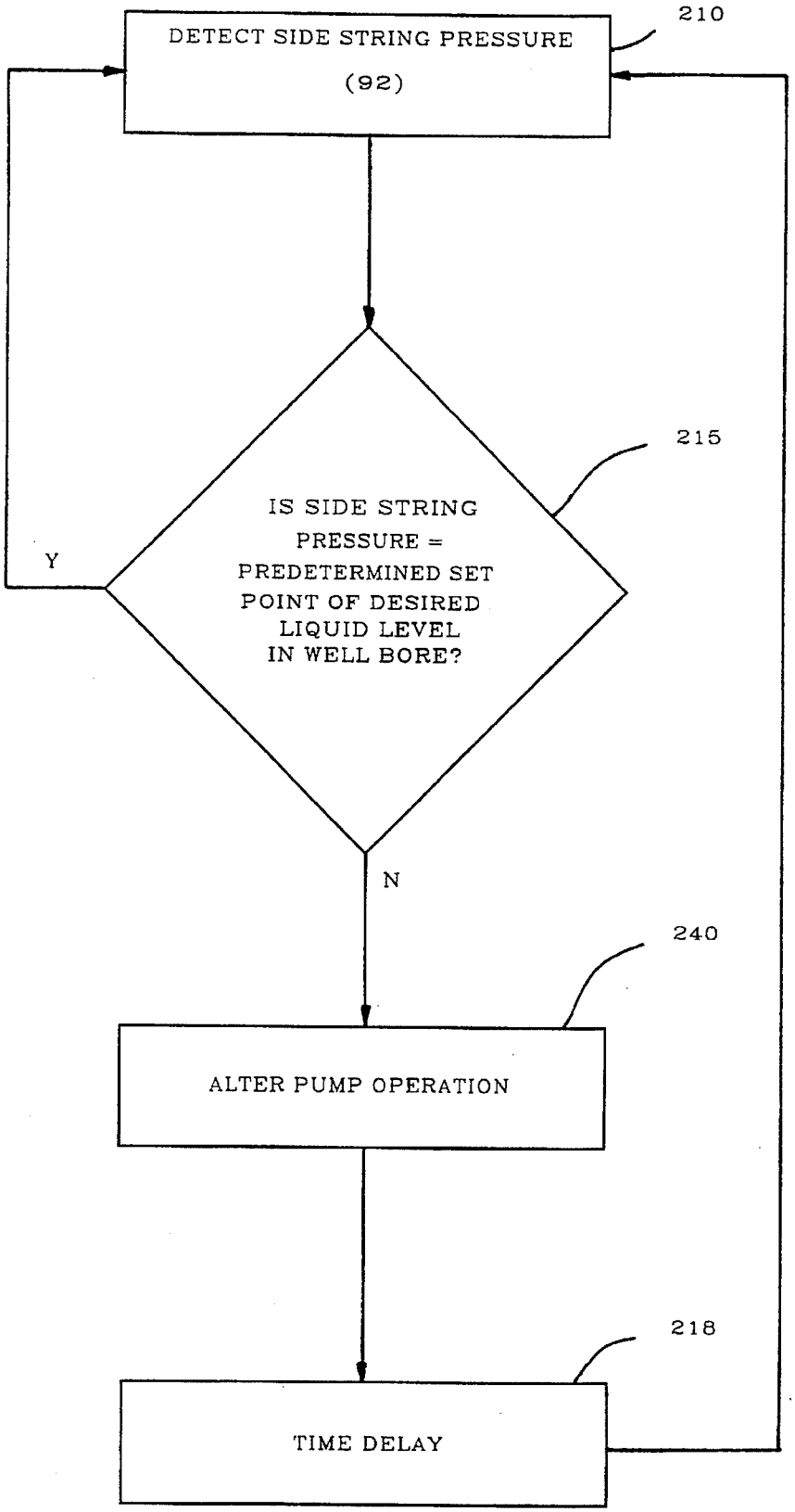

A method according to a seventh embodiment of the invention includes the operation and control of a pump associated with artificial lift systems. This method is similar to the first embodiment with the exception that a pump is controlled for removing liquid from the well bore instead of the gas injection. The basic method of controlling the pumping cycle as shown in FIG. 24, includes reiteratively monitoring the annulus 46 liquid level 31 by detecting the side string (sst) pressure with pressure sensor 92 as represented in block 210. The controller 90 then compares the detected side string pressure to the predetermined set point as represented at block 215. If the side string pressure substantially equals the predetermined set point, the side string pressure is again detected. When the well bore liquid level (as indicated by pressure) no longer equals the predetermined set point in the controller 90, controller 90 will alter pump operations at block 240. Altering of pump operations at block 240 can include but is not limited to increasing or decreasing pump speed and starting the pump or stopping the pump by use of controller 90 to control the prime mover control 414 as shown in FIGS. 15, 16 and 20. After the altering the pump operations at block 240 a time delay as represented at block 218 is activated. This time delay allows for a period of stable pump operation to determine the effect of the altered pump operation on the liquid level 31 in the well bore.

As with the first embodiment, this method will require the greatest amount of operator intervention to work with nominal efficiency. This method will only give a rough estimate of the liquid level 31 in the annulus 46 due to the fact that there will be an influx of liquid 32 into the side string tube 40 the level of which is unknown. This method is also prone to error in that the predetermined "alter pump operation" pressure set point programmed into the controller 90 is subject to errors that can be induced by fluctuations in production line 77 pressures (FIGS. 15, 16, 19, 20 and 23) due to the fact the operator must assume an average production line 77 pressure when programming the predetermined set point into controller 90. Therefore, this method will perform best on wells with substantial rat hole 45 (FIGS. 17, 18, 21 and 22) or with very high liquid levels 31 where side string tube 40 pressure will become noticeably elevated due to the annulus 46 liquid gradient. Further, this method is susceptible to errors that may be induced by any leak in the side string injection line 24 at surface causing a reduced side string tube 40 pressure and therefore an inability to detect the annulus 46 liquid level 31.

An eighth embodiment according to the invention is similar to the second embodiment with the exception that a pump is used for fluid removal from the well bore, as represented in FIG. 25. This embodiment incorporates all the steps of the seventh embodiment illustrated in FIG. 24 with the added improvement step of injecting a minuscule volume of injection gas from source 20 through a regulator 23 into the side string injection line 24 to remove the influx liquid level 33 in the side string tube 40 down to the level of termination point 48 of the side string tube 40 in the annulus 46 so that the pressure in the side string injection line 24 more accurately represents the liquid head pressure in the annulus 46. This method for controlling the artificial lift system includes injecting a minuscule volume of gas into the side string at block 220 while simultaneously detecting the side string pressure by pressure sensor 92 as a measure of the level of liquid in the annulus represented at block 210. When the gas is injected, the pressure at surface in the side string injection line 24 will rise until all of the liquid is expelled from the side string injection tube 40, at which time the pressure in the side string injection line at surface 24 will stabilize. The volume of injected gas can be monitored or can be estimated during this step. The removal of all the influx liquid 33 (with its accompanying unknown level) in the side string tube 40 causes only a gas gradient to be present in the side string tube 40 and thus leads to a more precise liquid level computation in the annulus 46. The operator can then use this more precise liquid level to enter a predetermined liquid level value into the controller 90 to be referenced by the controller 90 at block 215. If the detected value is no longer equal to the predetermined value at 215 the pump operation is then altered at block 240 based on the pressure criteria. The altering of pump operation is automatically initiated by the controller 90 controlling the prime mover control 414 (FIGS. 15, 16 and 20) when the detected pressure is no longer equal to the predetermined set point in the controller 90 as represented at blocks 210 and 215. As in the method of FIG. 24, a time delay represented at block 218 can be provided to allow for a period of stable pump operation to determine the effect the altered pump operation has on the liquid level 31 in the bore hole.

While this method is more accurate than the method of FIG. 24, it is still prone to the same weakness as the first and seventh methods in that fluctuations in production line 77 pressures are not compensated for and it may be necessary for the operator to assume an average production line 77 pressure when programming the controller 90 to alter pump operation 240. Therefore, this method will perform best on wells with substantial rat hole 45 (FIGS. 17, 18, 21 and 22) or with a high liquid level 31 where side string injection line 24 pressure will become noticeably elevated due to annulus 46 liquid gradient during the injection of the minuscule quantity of gas into the side string injection line 24.

The ninth embodiment of a method according to the invention is shown most clearly in FIGS. 15, 16, 19, 20, 23 and 26, and is similar to the third method, with the exception of the operation of a pump for artificially lifting the liquid from the bore hole. The pressure sensor 92 senses the side string injection line 24 pressure increase caused by the influx of liquid 33 into the side string tube 40 and a pressure sensor 91 fluidly connected to the annulus 46 senses the pressure of the annulus 46. The pressure sensors 91 and 92 are connected to the controller 90 by wires or through a transmitter to input a signal from the sensors 91 and 92 representative of the pressure in the annulus 46 and the side string injection line 24. The liquid 32 in the annulus 46 will rise and enter the side string tube 40. However, the influx of liquid 33 into the side string tube 40 will only be a portion of the level of the liquid in the annulus 46 because the side string 40 is not equalized with the production line 77 at the surface. This influx of liquid 33 will cause the pressure of the side string injection line 24 to rise until the combined head pressures of the gas in the side string tube 40 and the liquid in the side string tube 40 are equal to the combined head pressure of the gas and liquid in the annulus 46 at the termination point 48 of the side string tube 40. At this point, the difference between the side string injection line 24 pressure at surface and the annulus 46 pressure at surface multiplied by the appropriate liquid gradient pressure factor will give an approximate liquid level 31 in the annulus 46. The reason the liquid level is only approximate is due to the fact that liquid has entered the side string tube 40 to compress the gas in the upper portion of the side string tube 40 which results in two different gradients in the side string tube 40, one for gas and one for influx liquid 33, the level of which is unknown. These pressure measurements are used in this embodiment of the invention by the controller 90 to compute a value representative of the liquid level in the annulus 46. This computed value is then compared to the predetermined set point in the controller 90 to determine when the level of liquid 31 in the annulus 46 reaches a point either greater or less than the desired level, at which time, the controller 90 will alter pump operation. Thus, referring to FIG. 26, the pressure monitoring method of control of artificial lift systems incorporating a pump includes the steps of: one, reiteratively detecting both the side string injection line 24 pressure and the annulus pressure 46 at surface as represented in blocks 210 and 236 and generating signals representative thereof; two, calculating a differential pressure between the side string pressure and annulus pressure as represented in block 250 based on the pressure signals, which is approximately representative of the level of liquid in the annulus 46; three, comparing the calculated differential pressure to a predetermined differential pressure representative of the desired level of liquid in the annulus 46 as represented in block 235 and; four, altering pump operation in block 240 when the measured pressure is no longer substantially equal to the predetermined value. As in the previous embodiment of the invention, a time delay represented in block 218 can be provided to allow for a period of stable pump operation to determine the effect the altered pump operation has on the liquid level 31 in the well bore.

The improvement of this embodiment over the seventh and eighth embodiments is that the system now compensates for fluctuations in production line 77 pressure. In this method, while the exact level of liquid 31 in the annulus 46 is not known, the pressure differential between the pressure in side string injection line 24 (as detected by pressure sensor 92) and the pressure in annulus 46 at surface (as detected by pressure sensor 91) will represent a liquid head pressure constant, regardless of the fluctuations in production line 77 pressure. The difference between the side string injection line 24 pressure detected by pressure sensor 92 and the ejection line 74 pressure detected by pressure sensor 91 is then used by the controller to reiteratively monitor the level 31 of liquid 32 in the annulus 46 as represented by the pressure differential to determine when the liquid level 31 reaches the predetermined value. The controller 90 then alters the pump operation when the detected liquid level pressure differential value no longer equals the predetermined set point regardless of whether the exact annulus 46 liquid level 31 is known. Again, alteration of pump operation can include but is not limited to increasing or decreasing pump speed and starting or stopping the pump system.

Referring now to FIGS. 15, 16, 20 and 27, the tenth embodiment of the invention for control of artificial lift systems incorporating a pump is similar to the fourth embodiment, and includes the steps of: one, injecting a minuscule volume of gas into the side string line 24 as represented in block 220; two, simultaneously detecting the side string pressure 24 by pressure sensor 92 at block 210 and annulus 46 pressure by pressure sensor 91 as represented in block 236 and generating pressure signals representative thereof; three, calculating a differential pressure between the annulus 46 pressure and side string line 24 pressure based on the pressure signals as represented in block 250, the differential pressure being representative of the level of liquid in the annulus 46; four, comparing the measured differential pressure to a predetermined differential pressure representative of the desired level of liquid in the annulus 46 as represented in block 235 and; five, altering pump operation represented in block 240 when the calculated differential pressure is no longer substantially equal to the predetermined differential pressure value. As in the previous three embodiments, a time delay as represented in block 218 is desirably provided.

This embodiment, like the previous embodiment, uses the pressure sensor 92 fluidly connected to the side string injection line 24 to sense the pressure increase caused by the influx of liquid 32 into the side string tube 40 and the pressure sensor 91 fluidly connected to sense the annulus 46 pressure. The improvement over the previous embodiment is the injection of a minuscule volume of injection gas from source 20 through the regulator 23 into the side string injection line 24 to reduce or eliminate the liquid level 33 in the side string tube 40 down to the level of the side string tube termination point 48 thereby producing a single gradient pressure in the side string tube 40, i.e., gas only. Thus, the differential pressure calculated will be a very precise representation of the liquid head pressure in the annulus 46. The removal of all the influx liquid column 33 in the side string tube 40 results in only a gas gradient in the side string tube 40. At this point, the difference between the side string injection line pressure 24 at surface and the annulus pressure 46 at surface multiplied by the appropriate liquid gradient pressure factor will give a very precise annulus 46 liquid level 31. The difference between the side string injection line 24 pressure detected by pressure sensor 92 and annulus pressure sensor 91 can then be used by the controller 90 to compute the liquid level in the annulus 46 and alter pump operation when the computed liquid level no longer substantially equals the predetermined level as represented by the predetermined set point in the controller.

Referring now to FIGS. 10, 15, 16 and 20 yet another method according to the invention can be used with any of the embodiments seven through ten disclosed above. This eleventh embodiment of the invention is similar to the fifth embodiment and dynamically sets and resets the predetermined set point for altering pump operation using values from the side string pressure sensor 92, annulus pressure sensor 91, the differential pressure sensor 93 and production line pressure sensor 94. The differential pressure sensor 93 is fluidly connected to a measurement orifice, or other industry standard gas measurement device capable of outputting a signal representative of gas volume, in the production line 77 and the pressure sensor 94 is fluidly connected to the production line 77. The pressure sensor 93 and the pressure sensor 94 are electrically connected to the controller to input to the controller signals representative of the pressures sensed by the pressure sensors 93 and 94. The pressure values from sensors 93 and 94 are used to determine the production gas 30 flow rate from the annulus 46 into the production line 77. According to this embodiment of the invention, the predetermined pressure set point (PSI) for the embodiments seven and eight, or differential pressure set point (DP) as used in embodiments nine and ten to alter pump operation, is automatically adjusted upwardly as represented in block 260 by the controller 90 to raise the liquid level 31 in the annulus 46. This adjustment, in effect, increases the liquid level DP or PSI value necessary to alter pump control and thus results in an increased liquid level 31 in the annulus so that the liquid level in the annulus will be maintained at a greater level than before altering pump operations. As the liquid level rises, there will come a time when the gas production will decline within a specified time weighted average, as represented in block 262. The time weighted average is determined through well known statistical analysis for the amount of production over a specified time period. At that point, controller 90 automatically begins the reduction of the predetermined PSI or DP value set point at block 264 to reduce the liquid level 31 in the annulus 46 by reducing the liquid level PSI or DP value necessary to alter pump operation. The well bore response in the form of increased volumetric production is then monitored by the controller 90 as represented in block 266. As the production increases within the specified time and volume parameters, the predetermined set point for the desired liquid level will continue to be reduced until no more increase in production volume 266 is determined by controller 90 within the specified time period. At this stable production period, the PSI or DP values in the controller 90 enter a dormant or nonadjustment state at block 268 for an arbitrary period before it will initiate another change to the predetermined set point.

In this dynamic and interactive method, maximum production down the production line 77 is balanced with optimum liquid level 31 in the annulus 46 to best automatically economize the energy required by the pump to lift the liquid to the surface of the ground and sustain production. At the end of the specified non-management period, the liquid level management procedure described above will be repeated until the next dormant period. It is to be understood that the automated liquid level management method will be done with adjustments taking place over the course of many hours and possibly days, the end result being the maximum liquid level sustainable within a given well bore with minimal interference with production and a reduced need of energy for the prime mover 412.

A twelfth embodiment of a method according to the invention in an artificial lift system (FIGS. 15, 16 and 20), to reduce or control the power requirements of a pump system during peak load hours, as shown in FIG. 28. The method entails the responsible use of electrical energy by reducing the power requirement of the artificial lift system 10 during certain periods of the day with minimal well production interference by altering the artificial lift system 10 operation to reduce or increase the liquid level 31 in the annulus 46. To this end, the liquid level 31 in the annulus 46 is detected from the side string pressure or from the differential pressure as described in embodiments seven through ten and as represented in block 390. Real time is monitored by the control 90 at block 391 and compared to the relevant specified time period in blocks 392 or 400. Subsequently, the predetermined pressure set point for altering pump operation is adjusted in blocks 393 or 401 or the pump is shut down in block 405. The predetermined PSI or DP set point in block 393 or 401 is compared in block 394 to the detected side string or differential pressure in block 390. Subsequently if the detected pressure in block 390 is determined in block 394 to be greater than the appropriate predetermined PSI or DP set point in block 393 or 401 the state of pump operation will be monitored in block 397 to determine if the pump needs to be started in block 398 or if the pump speed should be increased in block 399 if a variable speed drive is available on the particular artificial lift system. Further, if at block 394 it is determined that the side string pressure or differential pressure value detected at block 390 is not greater than the predetermined value set in block 393 or 401 the pressure as detected in block 390 will then be compared in block 395 to the predetermined value set forth in block 393 or 401 to determine if the detected pressure represents a liquid level value that is less than the optimum level of liquid in the well bore. Next, the detected pressure in block 390 is compared in block 402 to a predetermined minimum PSI or DP as provided at block 402. This predetermined minimum can be the reduction value set in block 401 or the normal operational value set in block 393, or any other value that prevents pump damage. If the measured pressure is not less than the predetermined value, the pump speed can be reduced at block 403 in wells using an artificial lift system incorporating a variable speed drive. Alternatively, the pump can be shut down at block 405 if the side string pressure or differential pressure has declined below the predetermined minimum value set forth in block 402 to keep the artificial lift system from pumping off and damaging itself. A delay time is provided in block 396 to allow for a period of stable pump operation to determine the effect the altered pump operation has on the liquid level 31 in the bore hole.

Thus, a very desirable method of energy efficiency based on liquid level detection in a bore hole to control the artificial lift system by the above method is demonstrated. As is commonly known, peak load hours require utility companies to invest large sums to meet the high demand caused by residential use for a short period in the morning and evening. Often oil and gas wells are drilled in great numbers in small geographical areas and use electrical power from the same power grid as supplies the surrounding residences. If the power requirements for the oil or gas well artificial lift systems can be reduced or eliminated during the peak residential load hours a benefit will be realized by all the parties involved in electricity production and usage. In this method time is monitored relative to the peak load time established by the electrical utility company and pump operations are altered to balance the liquid removal requirements of the well bore and reduce energy consumption at an appropriate time. The pump artificial lift system can be shut down to prevent the system from drawing power during peak hours but this shut down may cause the liquid level to rise in the well bore and reduce production down the gas production line. In this new and unique method the controller detects a time prior to peak load hours and adjusts the predetermined set point of liquid level in the well bore to a minimum value. Subsequently the pump operation is altered to reduce the liquid level in the well bore to substantially equal the predetermined value then during the peak load hours the pump system can be shut down or operated at a reduced speed to either eliminate or reduce the artificial lift system power draw from the electrical grid. Further, because the liquid level has been reduced to a minimum level the empty rat hole in the well becomes storage for liquid entering the well bore to minimized the effect of liquid level on production volumes due to the fact the liquid must first fill the rat hole before it can begin to cover the productive formation and interfere with production. In this method, while the pump will require increased amounts of energy to reduce the liquid level into the rat hole below the productive formation, the energy will be required at an off peak load time when the electrical grid has power to spare. In this embodiment the prudent and timely use of electrical energy will benefit all parties involved with the electrical grid while allowing the operator minimize impact on production.

Figure 14:
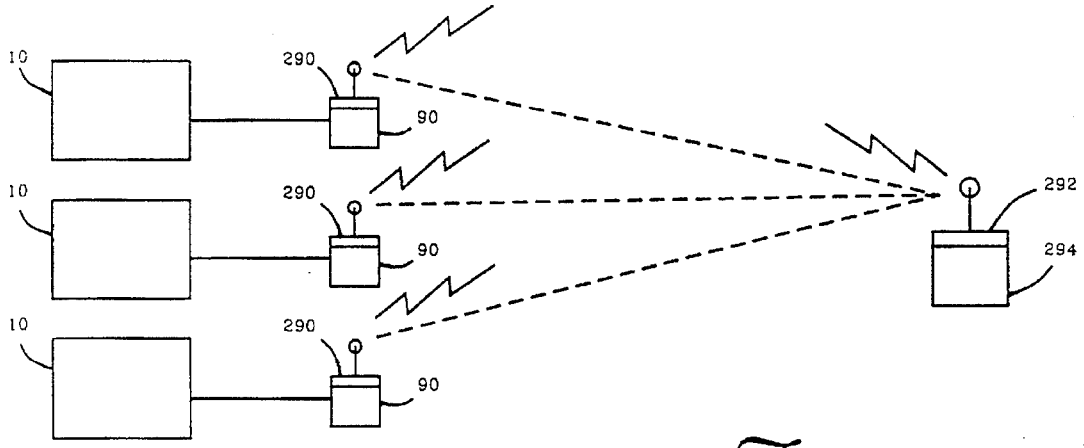
FIG. 14 is a diagrammatic representation of a plurality of well systems arranged for telemetric communication between a remote computer which can be used for control in any of the methods or systems according to the invention.

Referring now to FIG. 14, a plurality of artificial lift systems 10 having a respective local controller 90 can be arranged at a number of well sites. Each controller 90 includes a telemetry unit 290 that receives signals from pressure sensors 91, 92, 93, 94 and MSO 95, and any other system parameters and then transmits them to data receiver and control transmitter unit 292 in a well known manner. These signals are then transferred to a central controller 294 that can include a computer. The controller computer 294 separates, processes and performs the logic functions on the data for each well. The updated information is then transmitted back to the respective controller 90 through control transmitter unit 292 and the respective telemetry unit 290 to operate each well following any of the embodiments previously described, depending on each well's particular needs and the operator's preferences. In place of the telemetry unit 290, conventional electrical lines can be used. Although a separate local controller 90 and remote central controller 294 have been described, it is to be understood that a single controller could be located at the remote location. Signals are directly transferred from the well and processed in the central controller 294.

While particular embodiments of the invention have been shown, it will be understood, of course, that the invention is not limited thereto since modifications may be made by those skilled in the art, particularly in light of the foregoing teachings. For example, each method presented is capable of functioning as a stand alone improvement or being combined with any other of the methods presented to create either a partially dynamic or fully dynamic and interactive artificial lift control methods that can be used with the SSGL or pump artificial lift systems. Reasonable variation and modification are possible within the scope of the foregoing disclosure of the invention without departing from the spirit of the invention.

The embodiments of the invention in which an exclusive property or privilege is claimed are defined as follows:

1. In a method of producing gas from a gas and liquid containing underground stratum in which a well bore extends between a ground surface and the underground stratum and the well bore has a casing and a production tube defining an annulus through which the gas from the underground stratum passes and is collected at the ground surface through a production line connected to the annulus, the production tube extending from the ground surface and into fluid communication with the gas and liquid containing stratum and through which the liquid is collected from the well bore and removed to the ground surface by the step of artificially raising the liquid in the production tube to the ground surface to thereby release the gas from the gas and liquid containing underground stratum to the casing and production line and wherein a side string tube extends from the ground surface downwardly through the annulus and below a level of liquid in the well bore, the improvement comprising the steps of:

reiteratively measuring the level of liquid in the well bore by reiteratively detecting at least the pressure in the side string tube;

comparing the measured level with a predetermined value representative of a desired level of liquid in the well bore; and controlling the step of artificially raising the liquid in the production tube in accordance with the measured level and predetermined value so that the measured level reaches the predetermined value.

2. A method of producing gas according to claim 1 wherein the step of artificially raising the liquid in the production tube comprises injecting a volume of gas into a bottom portion of the production tube through the side string tube and wherein the step of controlling the step of artificially raising the liquid further comprises the step of initiating the injection of a volume of gas into the side string tube when the measured level of liquid reaches the predetermined value.

3. A method of producing gas according to claim 2 and further comprising the step of injecting a relatively small amount of gas into the side string tube to clear any liquid that may be present in the side string tube, just prior to or during the step of detecting the pressure in the side string tube.

4. A method of producing gas according to claim 3 wherein the reiteratively measuring step further includes the steps of:

detecting the pressure in the production tube; and computing the differential pressure between the detected side string pressure and the production tube pressure.

5. A method of producing gas according to claim 4 and further comprising the steps of monitoring the rate of gas production in the production line and adjusting the predetermined value to maximize gas production.

6. A method of producing gas according to claim 5 wherein the step of adjusting the predetermined value is performed over a plurality of gas lift injection cycles.

7. A method of producing gas according to claim 6 and further comprising the steps of measuring the time during which the liquid in the production tube is artificially raised to the ground surface, comparing the measured liquid rise time with a predetermined liquid rise time; and adjusting the volume of gas injected into the production tube during a subsequent injection step until the measured liquid rise time is substantially equal to the predetermined liquid rise time.

8. A method of producing gas according to claim 2 wherein the reiteratively measuring step further includes the steps of:

detecting the pressure in the production tube; and computing the differential pressure between the detected side string pressure and the production tube pressure.

9. A method of producing gas according to claim 8 and further comprising the steps of monitoring the rate of gas production in the production line and adjusting the predetermined value to maximize gas production.

10. A method of producing gas according to claim 2 and further comprising the steps of monitoring the rate of gas production in the production line and adjusting the predetermined value to maximize gas production.

11. A method of producing gas according to claim 2 and further comprising the steps of measuring the time during which the liquid in the production tube is artificially raised to the ground surface, comparing the measured liquid rise time with a predetermined liquid rise time; and adjusting the volume of gas injected into the production tube during a subsequent injection step until the measured liquid rise time is substantially equal to the predetermined liquid rise time.

12. A method of producing gas according to claim 1 wherein the reiteratively measuring step further includes the steps of:

detecting a second pressure in the production tube or the annulus; and computing the differential pressure between the detected side string pressure and the second pressure.

13. A method of producing gas according to claim 1 and further comprising the steps of monitoring the rate of gas production in the production line and adjusting the predetermined value to maximize gas production.

14. A method of producing gas according to claim 1 and further comprising the step of injecting a relatively small amount of gas into the side string tube to clear any liquid that may be present in the side string tube, just prior to or during the step of detecting the pressure in the side string tube.

15. A method of producing gas according to claim 1 wherein a pump is operatively associated with the production tube, and the step of artificially raising the liquid in the production tube comprises the step of operating the pump to pump the liquid from the underground stratum to the ground surface through the production tube; and wherein the step of controlling the step of artificially raising the liquid comprises altering operation of the pump so that the measured level of liquid reaches the predetermined value.

16. A method of producing gas according to claim 15 wherein the step of altering operation of the pump comprises at least one step taken from the group of starting, stopping, increasing the speed of, and decreasing the speed of, the pump.

17. A method for producing gas according to claim 1 wherein the artificial lift system comprises a pump positioned in a bottom portion of the well bore and the step of controlling the step of artificially raising the liquid in the production tube comprises the step of controlling the operation of the pump to maintain the level of liquid at least at a minimum level in the well bore.

18. A method for producing gas according to claim 17 wherein the step of controlling the operation of the pump further comprises maintaining the level of liquid in the well bore below a predetermined maximum level.

19. A method for producing gas according to claim 1 and further comprising the step of monitoring the time at which the level of liquid in the well bore is measured, and wherein the predetermined value is altered when the monitored time substantially equals a first predetermined time.

20. A method for producing gas according to claim 19 wherein the step of altering the predetermined value includes lowering the predetermined value to a lower value to thereby lower the level of liquid in the well bore to a second desired level of liquid.

21. A method for producing gas according to claim 20 and further including raising the lower value to the predetermined value to thereby raise the level of liquid in the well bore to the desired level when the monitored time substantially equals a second predetermined time.

22. A method for producing gas according to claim 21 wherein the step of artificially raising the liquid is altered during a time interval between the first and second predetermined times.

23. In a method of producing gas according to claim 1 wherein the step of reiteratively measuring the level of liquid in the well bore includes detecting a differential pressure between the side string tube and one of the production tube and the annulus.

24. In a method of producing gas from a gas and liquid containing underground stratum in which a well bore extends between a ground surface and the underground stratum and the well bore has a casing and a production tube defining an annulus through which the gas from the underground stratum passes and is collected at the ground surface through a production line connected to the annulus, the production tube extending from the ground surface and into fluid communication with the gas and liquid containing stratum and through which the liquid is collected from the well bore and removed to the ground surface by the injection of gas at a predetermined rate down a side string tube which extends down through the annulus from the ground surface and is connected to a lower portion of the production tube to thereby release the gas from the gas and liquid containing underground stratum to the casing and production line, the improvement comprising the steps of:

monitoring the rate of gas production in the production line and adjusting the predetermined rate at which gas is injected into the side string tube to maximize gas production in the production line.

25. In a method of producing gas from a gas and liquid containing underground stratum in which a well bore extends between a ground surface and the underground stratum and the well bore has a casing and a production tube defining an annulus through which the gas from the underground stratum passes and is collected at the ground surface through a production line connected to the annulus, the production tube extending from the ground surface and into fluid communication with the gas and liquid containing stratum and through which the liquid is collected from the well bore and removed to the ground surface by the injection of a volume of gas down a side string tube which extends through the annulus from the ground surface and is connected to a lower portion of the production tube to thereby release the gas from the gas and liquid containing underground stratum to the casing and production line, the improvement comprising the steps of:

measuring the time during which the liquid in the production tube is artificially raised to the ground surface;

comparing the measured liquid rise time with a predetermined liquid rise time; and adjusting the volume of gas injected into the production tube during a subsequent injection step until the measured liquid rise time is substantially equal to the predetermined liquid rise time.

26. A method of producing gas according to claim 18 wherein a plunger is provided in the production tube and is adapted for travel in the production tube between lower and upper portions of the production tube, and wherein the step of measuring the time at which the liquid in the production tube is artificially raised includes computing the time for the plunger to arrive at the ground surface from the initiation of the injection of the volume of gas;

and wherein the step of comparing the measured time includes comparing the plunger arrival time with a predetermined arrival time;

and wherein the step of adjusting the volume of injected gas includes the steps of:

decreasing the volume of gas injected during a subsequent gas lift injection cycle if the plunger arrival time is less than the predetermined arrival time; and increasing the volume of gas injected during a subsequent gas lift injection cycle if the plunger arrival time is greater than the predetermined arrival time.

27. A method of producing gas according to claim 19 wherein the step of comparing the plunger arrival time is performed for an average plunger arrival time taken over a plurality of gas injection steps.

28. A method of producing gas according to claim 18 wherein the step of measuring the time at which the liquid in the production tube is artificially raised includes the step of measuring the time for a column of liquid in the production tube to arrive at the ground surface from initiation of the injection of the volume of gas;

and wherein the step of comparing the measured time includes comparing the liquid column arrival time with a predetermined arrival time;

and wherein the step of adjusting the volume of injected gas includes the steps of:

decreasing the volume of gas injected during a subsequent gas lift injection cycle if the liquid column arrival time is less than the predetermined arrival time; and increasing the volume of gas injected during a subsequent gas lift injection cycle if the liquid column arrival time is greater than the predetermined arrival time.

29. A method of producing gas according to claim 21 wherein the step of comparing the liquid column arrival time is performed for an average liquid column arrival time taken over a plurality of gas injection steps.

30. In a system for producing gas from a gas and liquid containing underground stratum in which a well bore extends between a ground surface and the underground stratum and the well bore has a production tube and a casing defining an annulus through which the gas from the stratum passes and is collected at the ground surface through a production line connected to the annulus, the production tube extending from the ground surface and being in fluid communication with the gas and liquid containing underground stratum and adapted to collect the liquid from the well bore and to remove the liquid from the well bore by an artificial lift system for artificially raising the liquid in the production tube to the ground surface to thereby release the gas from the gas and liquid containing underground stratum to the casing and production line and wherein a side string tube extends from the ground surface downwardly through the annulus and below a level of liquid in the well bore, the improvement comprising:

a first pressure sensor operably coupled to the side string tube for detecting the pressure in the side string tube and for generating a first pressure signal representative of the detected pressure in the side string tube; and a controller operably connected to the first pressure sensor and to the artificial lift system for reiteratively computing the level of liquid in the well bore in response at least in part to the first pressure signal for comparing the computed level of liquid in the well bore to a predetermined value representative of a desired level of liquid in the well bore and for controlling the artificial lift system to allow the level of liquid in the well bore to reach the desired level of liquid in the well bore.

31. In a system for producing gas according to claim 29 wherein the side string tube is fluidly connected to the production tube, and the artificial lift system comprises an injector for periodically injecting a volume of gas into a bottom portion of the production tube through the side string tube and the controller is operably connected to the injector and is adapted to control the initiation of the gas volume injection into the production tube; and the controller actuates the injector to initiate the injection of gas into the side string tube when the measured level of liquid reaches the predetermined value.

32. In a system for producing gas according to claim 30 wherein said controller is programmed to actuate the injector to periodically inject a relatively small volume of gas into the side string tube sufficient to substantially clear the side string of liquid, and the controller is adapted to compute the level of liquid in the production tube in response to the first pressure signal after liquid has been substantially cleared from the side string tube.

33. In a system for producing gas according to claim 31 and further comprising a second pressure sensor, said second pressure sensor is operably coupled to the production tube to sense the pressure therein and to generate a second pressure signal representative of the pressure in the production tube; said controller is operably coupled to the second pressure sensor and is adapted to compute the level of liquid in the production tube in response at least in part to the first and second pressure signals.

34. In a system for producing gas according to claim 32 wherein the controller is adapted to compute the level of liquid in the production tube in response to the difference between the first and second pressure signals.

35. In a system for producing gas according to claim 33 and further comprising:

an arrival detector at an upper portion of the production tube to detect the arrival of the liquid or injected gas lifted from the bottom portion of the production tube and to generate an arrival signal representative thereof; and wherein the controller is operably coupled to the arrival detector and is adapted to compute the time interval during which the liquid rises from the bottom portion of the production tube in response to the arrival detector signal, to compare the computed time interval of the liquid rise to a predetermined time, and to control the operation of the injector to adjust the volume of gas injected into the side string tube during a subsequent gas injection step until the computed time interval of the liquid rise substantially equals the predetermined time.

36. In a system for producing gas according to claim 34 and further comprising:

a production detector operably coupled to the production line for measuring the rate of gas production and for generating a production signal responsive thereto; and wherein the controller is operably coupled to the production detector and is adapted to compute the rate of gas production responsive to the production signal and to adjust the predetermined value representative of the desired level in the well bore to maximize gas production in the production line.

37. In a system for producing gas according to claim 30 and further comprising a second pressure sensor, said second pressure sensor is operably coupled to the production tube to sense the pressure therein and to generate a second pressure signal representative of the pressure in the production tube; said controller is operably coupled to the second pressure sensor and is adapted to compute the level of liquid in the production tube in response at least in part to the first and second pressure signals.

38. In a system for producing gas according to claim 30 and further comprising:

an arrival detector at an upper portion of the production tube to detect the arrival of the liquid or injected gas lifted from the bottom portion of the production tube and to generate a signal representative thereof; and wherein the controller is operably coupled to the arrival detector and is adapted to compute the time interval during which the liquid rises from the bottom portion of the production tube in response to the arrival detector signal, to compare the computed time interval of the liquid rise to a predetermined time, and to control the operation of the injector to adjust the volume of gas injected into the side string tube during a subsequent gas injection step until the computed time interval of the liquid rise substantially equals the predetermined time.

39. In a system for producing gas according to claim 30 and further comprising:

a production detector operably coupled to the production line for measuring the rate of gas production and to generate a production signal responsive thereto; and wherein the controller is operably coupled to the production detector and is adapted to compute the rate of gas production responsive to the production signal and to adjust the predetermined value representative of the desired level in the production tube to maximize gas production in the production line.

40. In a system for producing gas according to claim 29 and further comprising:

a production detector operably coupled to the production line for measuring the rate of gas production and to generate a production signal responsive thereto; and wherein the controller is operably coupled to the production detector and is adapted to compute the rate of gas production responsive to the production signal and to adjust the predetermined value representative of the desired level in the well bore to maximize gas production in the production line.

41. In a system for producing gas according to claim 29 wherein the artificial lift system comprises an injector fluidly connected to the side string tube, and said controller is programmed to actuate the injector to periodically inject a relatively small volume of gas into the side string tube sufficient to substantially clear the side string of fluid, and the controller is adapted to compute the level of liquid in the well bore in response to the first pressure signal after liquid has been substantially cleared from the side string tube.

42. In a system for producing gas according to claim 29 and further comprising a second pressure sensor, said second pressure sensor is operably coupled to the well bore to sense the pressure therein and to generate a second pressure signal representative of the pressure in the well bore; said controller is operably coupled to the second pressure sensor and is adapted to compute the level of liquid in the well bore in response at least in part to the first and second pressure signals.

43. In a system for producing gas according to claim 41 wherein the controller is adapted to compute the level of liquid in the well bore in response to the difference between the first and second pressure signals.

44. In a system for producing gas according to claim 42 wherein the artificial lift system further comprises a pump operatively associated with the production tube, and wherein the controller alters operation of the pump when the measured level of liquid reaches the predetermined value.

45. In a system for producing gas according to claim 43 wherein the pump is of the type taken from the group of: progressive cavity, beam, and electrical submersible pumps.

46. In a system for producing gas according to claim 29 wherein the artificial lift system further comprises a pump operatively associated with the production tube, and wherein the controller alters operation of the pump when the measured level of liquid reaches the predetermined value.

47. In a system for producing gas according to claim 45 wherein the pump is of the type taken from the group of: progressive cavity, beam, and electrical submersible pumps.

48. In a system for producing gas according to claim 29 wherein the controller is located remotely from the well bore.

49. In a system for producing gas according to claim 29 wherein the first pressure sensor is a differential pressure sensor operatively coupled to the side string robe and one of the production robe and annulus for sensing a differential pressure between the side string tube and one of the production tube and annulus.

* * * * *

UNITED STATES PATENT AND TRADEMARK OFFICE

CERTIFICATE OF CORRECTION

PATENT NO. : 5,634,522

DATED : June 3, 1997

INVENTOR(S) : Michael D. Hershberger

It is certified that error appears in the above-identified patent and that said Letters Patent is hereby corrected as shown below:

Claim 26, col. 40, line 66, "18" should read --25--
Claim 30, col. 42, line 2, "signal for" should read --signal, for--
Claim 31, col. 42, line 8, "29" should read --30--.
Claim 32, col. 42, line 19, "30" should read --31--.
Claim 33, col. 42, line 27, "31" should read --32--.
Claim 34, col. 42, line 36, "32" should read --33--.
Claim 35, col. 42, line 40, "33" should read --34--.
Claim 36, col. 42, line 57, "34" should read --35--.
Claim 37, col. 43, line 1 "30" should read --31--.
Claim 38, col. 43, line 10, "30" should read --31--.
Claim 39, col. 43, line 28, "30" should read --31--.
Claim 40, col. 43, line 38, "29" should read --30--.
Claim 41, col. 44, line 1, "29" should read --30--.
Claim 42, col. 44, line 9, "29" should read --30--.
Claim 43, col. 44, line 19, "41" should read --42--.
Claim 44, col. 44, line 22, "42" should read --43--.
Claim 45, col. 44, line 27, "43" should read --44--.
Claim 46, col. 44, line 31, "29" should read --30--.
Claim 47, col. 44, line 36, "45" should read --46--.

UNITED STATES PATENT AND TRADEMARK OFFICE

CERTIFICATE OF CORRECTION

PATENT NO. : 5,634,522

DATED : June 3, 1997

INVENTOR(S) : Michael D. Hershberger

It is certified that error appears in the above-identified patent and that said Letters Patent is hereby corrected as shown below:

Claim 48, col. 44, line 39, "29" should read --30--.
Claim 49, col. 44, line 42, "29" should read --30--.

Signed and Sealed this

Thirty-first Day of March, 1998

Bruce Lehman

*Attest:*

BRUCE LEHMAN

*Attesting Officer*

*Commissioner of Patents and Trademarks*